US011299929B2

(12) United States Patent
Chen et al.

(10) Patent No.: US 11,299,929 B2
(45) Date of Patent: Apr. 12, 2022

(54) WINDOW BLIND

(71) Applicant: Nien Made Enterprise Co., Ltd., Taichung (TW)

(72) Inventors: Lin Chen, Taichung (TW); Chin-Tai Lu, Taichung (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 93 days.

(21) Appl. No.: 16/868,529

(22) Filed: May 6, 2020

(65) Prior Publication Data

US 2021/0348444 A1 Nov. 11, 2021

(51) Int. Cl.

*E06B 9/322* (2006.01)
*E06B 9/307* (2006.01)
*E06B 9/323* (2006.01)

(52) U.S. Cl.

CPC ..... *E06B 9/322* (2013.01); *E06B 9/307* (2013.01); *E06B 9/323* (2013.01); *E06B 2009/3225* (2013.01)

(58) Field of Classification Search

CPC ..... E06B 9/322; E06B 9/307; E06B 9/323; E06B 9/304; E06B 2009/3222; E06B 2009/3225; E06B 9/32

See application file for complete search history.

(56) References Cited

U.S. PATENT DOCUMENTS 8,844,603 B1 * 9/2014 Anti ..... E06B 9/307 160/176.1 R
10,533,371 B2 * 1/2020 Chen ..... B65H 75/4492
2002/0059987 A1 * 5/2002 Coleman ..... E06B 9/388 160/173 R
2010/0258253 A1 * 10/2010 Cheng ..... E06B 9/322 160/168.1 P

* cited by examiner

*Primary Examiner* — Johnnie A. Shablack
*Assistant Examiner* — John W Hanes, Jr.
(74) *Attorney, Agent, or Firm* — Winston Hsu

(57) ABSTRACT

A window blind includes a headrail, a covering assembly including a plurality of slats and a bottom rail, a lifting mechanism including a driving module and a lift cord assembly operably connected to the driving module, a tilt mechanism adapted to drive the slats to rotate, and an auxiliary unit provided between the tilt mechanism and the lifting mechanism. The lift cord assembly is connected to the bottom rail for expanding or folding the covering assembly. The covering assembly is in a first state when each and every one of the slats is substantially parallel to each other and correspondingly rotatable by the tilt mechanism, and is in a second state otherwise. When the covering assembly is in the second state, the auxiliary unit is drivable by the tilt mechanism to make the lifting mechanism further release the lift cord assembly, changing the covering assembly into the first state again.

37 Claims, 42 Drawing Sheets

531

561

WINDOW BLIND

BACKGROUND OF THE INVENTION

1. Field of the Invention

The present invention generally relates to a window blind, and more particularly to a window blind that can provide an excellent light-blocking effect when completely closed.

2. Description of the Prior Art

A conventional window blind usually includes a headrail, a bottom rail, and a plurality of slats between the headrail and the bottom rail, wherein the slats are horizontally suspended by ladder tapes. It is common for a window blind to have a lift cord assembly, which is connected to a lifting mechanism in the headrail with an end thereof, and is connected to the bottom rail with another end. By the driving of the lifting mechanism, the lift cord assembly could move the bottom rail toward or away from the headrail. In this way, the slats provided between the headrail and the bottom rail can be expanded or folded. The design of the lift cord assembly in a general window blind may include several corresponding pairs of lift cords, which respectively pass by the front and rear sides of the slats, or may include several lift cords respectively passing through center perforations of the slats. In most cases, there are usually two or more pairs of lift cords/two or more lift cords spaced out in a longitudinal direction of the slats. A ladder tape is composed of two warps and multiple wefts connected between the two warps; each of the slats is respectively placed on a corresponding weft and between the two warps. Each of said warps has an end connected to a rotatable modulation mechanism which is located in the headrail, and another end connected to the bottom rail. Rotating the modulation mechanism makes two warps create a relative vertical movement and approach each other, by which the slats that are originally placed on the wefts in a horizontal position can be correspondingly rotated, and so can the bottom rail. Rotations of different angles could provide different light-blocking effects, and therefore the amount of light allowed to pass through can be adjusted by such means.

However, when the slat assembly of a window blind is fully expanded, the position of the bottom rail is determined, and therefore the length of the lift cord assembly would be not changeable anymore despite the weight of the bottom rail being supported by the lift cord assembly and by the ladder tapes at the same time. In such circumstances, if one keeps maneuvering the modulation mechanism with the intention of rotating the slats to a fully closed position, the fixed length of the lift cord assembly would only allow the bottom rail to rotate to a limited extent. Take a window blind which has its lift cord assembly provided on the front and rear sides of the slats as an instance, the lengths of the lift cords on both sides are fixed once the slat assembly is fully expanded. In this situation, the length of the lift cord assembly cannot be changed even if the modulation mechanism is further maneuvered to create a relative vertical movement between the two warps of each ladder tape to turn the slats into a fully closed position, and therefore the rotation of the bottom rail is restricted by the fixed length of the lift cords, causing the bottom rail unable to reach a fully closed position. Consequently, the slats near the bottom rail cannot be rotated to the fully closed position, either. Therefore, the closure effect provided by the slats is not as good as expected.

To improve the above problem, some patents or patent applications, such as Chinese patent application No. 201710790554.X (i.e., U.S. patent application Ser. No. 16/105,976), have disclosed techniques that could further pull up the lift cords by interference while maneuvering a modulation mechanism, whereby the bottom rail could fully respond to the relative movement between two warps of a ladder tape and therefore be rotated as intended. However, such technique has a drawback: the force balanced between the bottom rail and the lifting mechanism would be disrupted while the lift cords are being pulled up, which causes the position of the bottom rail to raise slightly. After maneuvering the modulation mechanism several times, it could be easily noticed that the bottom rail is obviously raised to a higher position, especially when the slat assembly is in a fully expanded state. A window blind having an unintendedly raised bottom rail would have light leakage below the bottom rail. In other words, the area of a window which is actually covered by a fully expanded window blind may not be in line with the expectation of the user.

Similar defects can also be found in window blinds having lift cords on left and right sides that run through center bores of slats. Once the slat assembly is fully expanded, the lengths of lift cords are then fixed, and would not change along with the rotation of the modulation mechanism. Furthermore, since the lift cords are connected to the bottom rail at places that are not the rotation center of the bottom rail, the lift cords with fixed lengths would hinder the rotation of the parts near the connecting portions. As a result, the bottom rail is restricted by the support of the lift cords from being rotated to a fully closed position along with the ladder tapes. The slats near the bottom rail would also be affected and, therefore, not able to be turned to a fully closed position. The situations mentioned above all lead to the problem of light leakage, for the slats of a slat assembly near the bottom rail cannot be completely closed and, therefore, cannot block all the light.

Therefore, how to provide an excellent shading effect for an expected area when complete closure is required is still a problem to be solved in the industry of window blinds.

SUMMARY OF THE INVENTION

In view of the above, the objective of the present invention is to provide a window blind that has an excellent light-blocking effect for a blocked area of the window, and the blocked area could be maintained as expected. Therefore, the window covering provided in the present invention could solve an existing problem that light may still leak through the portion near the bottom rail even when a window blind is in the closed position.

The present invention provides a window blind, which includes a headrail, a covering assembly provided below the headrail, a lifting mechanism, a tilt mechanism, and an auxiliary unit provided between the lifting mechanism and the tilt mechanism. The covering assembly sequentially includes a plurality of slats and a bottom rail in a direction away from the headrail. The lifting mechanism includes a driving module and a lift cord assembly, wherein the driving module is provided in the headrail. The lift cord assembly includes a first cord and a second cord. An end of the lift cord assembly is operably connected to the driving module, while another end thereof is connected to the bottom rail. The lift cord assembly is adapted to be driven by the driving module to be released or retracted, whereby to expand or fold the covering assembly. The tilt mechanism includes a modulation module and a ladder tape, wherein the modulation module is provided in the headrail. The ladder tape includes two warps, and the slats are positioned between the warps. The modulation module is adapted to drive the warps of the ladder tape to create a relative vertical movement below the headrail, whereby to drive the slats of the covering assembly to rotate so as to block light or to allow light to pass therethrough. The covering assembly is defined to be in a first state when the slats and the bottom rail are substantially parallel to each other, and can be correspondingly rotated along with the relative vertical movement of the warps. On the other hand, the covering assembly is defined to be in a second state when at least one of the slats or the bottom rail is not correspondingly rotatable along with the relative vertical movement of the warps. When the covering assembly is in the second state, the auxiliary unit is adapted to be driven by the tilt mechanism, and the lifting mechanism is concurrently motivated by the auxiliary unit which is being driven, whereby to further release the lift cord assembly and therefore to change the covering assembly into the first state that the slats and the bottom rail are substantially parallel to each other again.

In an embodiment, when the lifting mechanism is concurrently motivated by the auxiliary unit to further release the lift cord assembly, the first cord and the second cord are synchronously released by a same length.

In an embodiment, the slats are positioned between the first cord and the second cord, and the first cord has a tension different from that of the second cord.

In an embodiment, the auxiliary unit includes a timing transmission mechanism and a driven member; the timing transmission mechanism is connected to the modulation module to be driven by the modulation module; the driven member connects the driving module and the timing transmission mechanism, and the timing transmission mechanism operably drives the driven member.

In an embodiment, the modulation module includes a modulation shaft, around which the timing transmission mechanism is provided, and the timing transmission mechanism is rotatable along with the modulation shaft. When the covering assembly is in the second state, the driven member is adapted to be driven by the timing transmission mechanism, and the driving module is concurrently motivated by the driven member which is being driven, whereby to release the lift cord assembly.

In an embodiment, the driving module includes a cord reel and an actuating device which is concurrently motivated when the cord reel is driven. The lift cord assembly is adapted to be concurrently motivated by the cord reel. The actuating device is adapted to provide a motivating force to the lift cord assembly, wherein the motivating force is for retracting the lift cord assembly back into the headrail.

In an embodiment, the actuating device includes a driving drum, a spring-receiving drum, and a torsion spring. The torsion spring connects the driving drum and the spring-receiving drum. The driving drum and the cord reel are connected in a manner that they are adapted to be concurrently motivated by each other, whereby to provide the motivating force to the cord reel.

In an embodiment, the driven member includes a toothed structure provided on the driving module, and the toothed structure concurrently moves with the cord reel. While the toothed structure is being driven by the timing transmission mechanism to concurrently motivate the cord reel to release the lift cord assembly, the motivating force has to be overcome.

In an embodiment, the timing transmission mechanism includes an incomplete gear, which is provided corresponding to the toothed structure. The incomplete gear concurrently rotates with the modulation shaft. When the covering assembly is in the first state, a toothed segment of the incomplete gear does not mesh with the toothed structure, so that the incomplete gear is adapted to independently rotate along with the modulation shaft relative to the toothed structure; when the covering assembly is in the second state, the toothed segment of the incomplete gear meshes with the toothed structure, so that the incomplete gear is adapted to be rotated along with a rotation of the modulation shaft, whereby to drive the toothed structure, which makes the cord reel rotate to further release the lift cord assembly.

In an embodiment, the timing transmission mechanism further includes an auxiliary gear, which is freely rotatable relative to the modulation shaft, and always meshes with the toothed structure.

In an embodiment, the timing transmission mechanism includes a first sleeve, a second sleeve, and a housing. The first sleeve and the second sleeve are provided on the modulation shaft and in the housing at intervals, wherein the first sleeve rotates synchronously with the modulation shaft, and is slidable relative to the modulation shaft. The second sleeve is freely rotatable relative to the modulation shaft, and always meshes with the toothed structure. When the covering assembly is in the first state, the first sleeve is driven by the modulation shaft to rotate, and is spaced out from the second sleeve; when the covering assembly is in the second state, the first sleeve is driven by the modulation shaft to rotate, and slides toward the second sleeve to become engaged with the second sleeve.

In an embodiment, the first sleeve has a first engaging portion, a first sleeve body, and a limiting portion. The first engaging portion is located at an end of the first sleeve body, and faces the second sleeve. The limiting portion is located at another end of the first sleeve body. The second sleeve has a second engaging portion, a second sleeve body, and a toothed ring. The second engaging portion is located at an end of the second sleeve body, and corresponds to the first engaging portion. The toothed ring fits around the second sleeve body and meshes with the toothed structure. When the covering assembly is in the second state, the first engaging portion engages with the second engaging portion, so that the second sleeve is adapted to rotate synchronously along with the first sleeve and the modulation shaft.

In an embodiment, the timing transmission mechanism further includes a restoring member. The housing covers the first engaging portion of the first sleeve and the second engaging portion of the second sleeve, and also covers at least a part of the first sleeve body and at least a part of the second sleeve body. The restoring member is provided near a side of the housing that corresponds to the limiting portion. The limiting portion is located between an abutting portion of the housing and the restoring member, and the restoring member provides the first sleeve a pushing force toward the second sleeve.

In an embodiment, the limiting portion of the first sleeve has a protrusion protruding toward the abutting portion of the housing, and an outline of the abutting portion has a notch formed in an axial direction of the housing. When the covering assembly is in the first state, the first sleeve is adapted to rotate along with a rotation of the modulation shaft, and is, due to the pushing force, adapted to make the protrusion abut against the abutting portion and move along the outline of the abutting portion; when the covering assembly is in the second state, the protrusion completely passes by the abutting portion and no longer contacts the abutting portion as the protrusion reaches where the notch is, and the first sleeve is moved by the pushing force in an axial direction of the modulation shaft, whereby the first engaging portion engages with the second engaging portion.

In an embodiment, the restoring member includes a blocker, which pushes against the limiting portion of the first sleeve to generate the pushing force. The limiting portion has another protrusion protruding in a direction opposite to the protrusion. When the covering assembly is in the second state, the first sleeve is adapted to rotate along with the rotation of the modulation shaft to make the another protrusion face the blocker, and the protrusion no longer contacts the abutting portion as the protrusion reaches where the notch is, whereby the first sleeve is moved toward the second sleeve by the pushing force.

In an embodiment, the restoring member includes an elastic member, which pushes against the first sleeve to generate the pushing force. When the covering assembly is in the second state, the first sleeve is adapted to rotate along with the modulation shaft, so that the protrusion no longer contacts the abutting portion as the protrusion reaches where the notch is, whereby the first sleeve is moved toward the second sleeve by the pushing force.

In an embodiment, the protrusion is helical, and includes a starting point and an ending point. When the covering assembly is in the second state, the ending point of the protrusion no longer contacts the abutting portion as the ending point reaches where the notch is, so that the first sleeve is moved toward the second sleeve by the pushing force, whereby the first engaging portion engages with the second engaging portion.

In an embodiment, the first sleeve further includes a delay member, which fits around the modulation shaft, and respectively corresponds to the first sleeve body and the restoring member. The restoring member exerts the pushing force on the delay member, and the delay member has a protruding part on a side thereof facing the first sleeve body. The first sleeve body has a path on a side thereof facing the delay member, and the protruding part is adapted to be driven by the modulation shaft to reciprocate along the path. Once the protruding part contacts an end of the path, the protruding part is able to drive the first sleeve body to rotate synchronously.

In an embodiment, the driving module further includes a transmission cord, which connects the cord reel and the lift cord assembly. The cord reel is adapted to be concurrently motivated by the actuating device to wind up or release the transmission cord, whereby to retract or release the lift cord assembly.

In an embodiment, the lifting mechanism further includes a movable seat assembly, which includes a movable seat and a positioning pin. The movable seat is movable in a longitudinal direction of the headrail, and the positioning pin is fixedly provided in the headrail. A segment of the lift cord assembly located in the headrail is arranged in a manner that runs back and forth between the movable seat and the positioning pin. An end of the transmission cord is connected to the movable seat, and another end thereof is connected to the cord reel. The cord reel is adapted to be concurrently motivated by the actuating device to retract or release the transmission cord, so that the lift cord assembly is, through the movable seat, concurrently motivated when the transmission cord is driven. When the driven member is driven by the timing transmission mechanism to concurrently motivate the cord reel to release the lift cord assembly, the motivating force provided by the actuating device has to be overcome.

In an embodiment, the driven member includes an interference device located between the cord reel and the lift cord assembly. The lifting mechanism further includes a movable seat assembly, which includes a movable seat and a positioning pin, wherein the movable seat is movable in a longitudinal direction of the headrail, and the positioning pin is fixedly provided in the headrail. A segment of the lift cord assembly located in the headrail is arranged in a manner that runs back and forth between the movable seat and the positioning pin. The transmission cord passes through the interference device, and has an end connected to the cord reel and another end connected to the movable seat. The cord reel is adapted to be concurrently motivated by the actuating device to retract or release the transmission cord, so that the lift cord assembly is, through the movable seat, concurrently motivated when the transmission cord is driven.

In an embodiment, the interference device includes a base, an interference member, and an elastic member. The interference member is movable relative to the base. Two end portions of the elastic member respectively abut against the interference member and the base. When the covering assembly is in the first state, the interference member twists the transmission cord, so that an actual cord length of the transmission cord from the cord reel to the movable seat is longer than a direct length from the cord reel to the movable seat. When the covering assembly is in the second state, the timing transmission mechanism is adapted to drive the interference member to move relative to the base, whereby to release the transmission cord twisted by the interference member, so that the movable seat is further moved in a direction away from the cord reel.

In an embodiment, the timing transmission mechanism includes an incomplete gear, and the interference member has a toothed structure provided corresponding to the incomplete gear. The incomplete gear and the modulation shaft rotate synchronously. When a toothed segment of the incomplete gear meshes with the toothed structure of the interference member, the interference member is adapted to be driven by the incomplete gear to move relative to the base.

The present invention further provides another window blind, which includes a headrail, a covering assembly, a lifting mechanism, a tilt mechanism, and an auxiliary unit. The covering assembly is provided below the headrail, wherein the covering assembly sequentially includes a plurality of slats and a bottom rail in a direction away from the headrail. The lifting mechanism includes a driving module and a lift cord assembly, wherein the driving module is provided in the headrail. The lift cord assembly includes a first cord and a second cord, wherein an end of the lift cord assembly is operably connected to the driving module, while another end thereof is connected to the bottom rail. The lift cord assembly is adapted to be driven by the driving module to be released or retracted, whereby to expand or fold the covering assembly. The tilt mechanism includes a modulation module and a ladder tape, wherein the modulation module is provided in the headrail. The ladder tape includes two warps. An end of each of the warps is operably connected to the modulation module, and another end thereof is connected to the bottom rail. The slats are positioned between the warps. The modulation module is adapted to drive the warps of the ladder tape to create a relative vertical movement below the headrail, whereby to drive the slats and the bottom rail to rotate, switching the slats between an open state, which allows light to pass therethrough, and a closed state, which blocks light. When the slats are in the open state, the slats and the bottom rail are parallel to each other, and the bottom rail in such state is defined to be at an initial position; when the slats are driven by the modulation module to be switched from the open state to the closed state, the bottom rail is tilted by a first angle relative to the initial position. The auxiliary unit is provided between the lifting mechanism and the tilt mechanism. When the bottom rail is tilted at the first angle, the auxiliary unit is adapted to be driven by the tilt mechanism, by which the lifting mechanism is concurrently motivated to further release the lift cord assembly, whereby the bottom rail is further tilted at a second angle relative to the initial position, wherein the second angle is greater than the first angle.

In an embodiment, when the lifting mechanism is concurrently motivated by the auxiliary unit to further release the lift cord assembly, the first cord and the second cord are synchronously released by a same length.

In an embodiment, the slats are positioned between the first cord and the second cord, and the first cord has a tension different from that of the second cord.

In an embodiment, when the bottom rail is tilted at the second angle, the bottom rail and the slats are parallel to each other.

In an embodiment, the auxiliary unit includes a timing transmission mechanism and a driven member. The timing transmission mechanism is connected to the modulation module to be driven by the modulation module. The driven member connects the driving module and the timing transmission mechanism, and the timing transmission mechanism operably drives the driven member.

In an embodiment, the modulation module includes a modulation shaft, around which the timing transmission mechanism is provided, and the timing transmission mechanism is rotatable along with the modulation shaft. When the bottom rail is tilted to the first angle, the driven member is adapted to be driven by the timing transmission mechanism, and the driving module is concurrently motivated by the driven member which is being driven, whereby to release the lift cord assembly.

In an embodiment, the driving module includes a cord reel and an actuating device which is concurrently motivated when the cord reel is driven. The lift cord assembly is adapted to be concurrently motivated by the cord reel. The actuating device is adapted to provide a motivating force to the lift cord assembly, wherein the motivating force is for retracting the lift cord assembly back into the headrail.

In an embodiment, the actuating device includes a driving drum, a spring-receiving drum, and a torsion spring. The torsion spring connects the driving drum and the spring-receiving drum. The driving drum and the cord reel are connected in a manner that they are adapted to be concurrently motivated by each other, whereby to provide the motivating force to the cord reel.

In an embodiment, the driven member includes a toothed structure provided on the driving module, and the toothed structure concurrently moves with the cord reel. While the toothed structure is being driven by the timing transmission mechanism to concurrently motivate the cord reel to release the lift cord assembly, the motivating force has to be overcome.

In an embodiment, the timing transmission mechanism includes an incomplete gear, which is provided corresponding to the toothed structure. The incomplete gear concurrently rotates with the modulation shaft. When the bottom rail is not tilted to the first angle yet, a toothed segment of the incomplete gear does not mesh with the toothed structure, so that the incomplete gear is adapted to independently rotate along with the modulation shaft relative to the toothed structure; when the bottom rail is tilted to the first angle, the toothed segment of the incomplete gear meshes with the toothed structure, so that the incomplete gear is adapted to be rotated along with a rotation of the modulation shaft, whereby to drive the toothed structure, which makes the cord reel rotate to further release the lift cord assembly, by which the bottom rail is further tilted to the second angle.

In an embodiment, the timing transmission mechanism further includes an auxiliary gear, which is freely rotatable relative to the modulation shaft, and always meshes with the toothed structure.

In an embodiment, the driving module further includes a transmission cord, which connects the cord reel and the lift cord assembly. The cord reel is adapted to be concurrently motivated by the actuating device to wind up or release the transmission cord, whereby to retract or release the lift cord assembly.

In an embodiment, the lifting mechanism further includes a movable seat assembly, which includes a movable seat and a positioning pin. The movable seat is movable in a longitudinal direction of the headrail, and the positioning pin is fixedly provided in the headrail. A segment of the lift cord assembly located in the headrail is arranged in a manner that runs back and forth between the movable seat and the positioning pin. An end of the transmission cord is connected to the movable seat, and another end thereof is connected to the cord reel. The cord reel is adapted to be concurrently motivated by the actuating device to retract or release the transmission cord, so that the lift cord assembly is, through the movable seat, concurrently motivated when the transmission cord is driven. When the driven member is driven by the timing transmission mechanism to concurrently motivate the cord reel to release the lift cord assembly, the motivating force provided by the actuating device has to be overcome.

In an embodiment, the driven member includes an interference device located between the cord reel and the lift cord assembly. The lifting mechanism further includes a movable seat assembly, which includes a movable seat and a positioning pin, wherein the movable seat is movable in a longitudinal direction of the headrail, and the positioning pin is fixedly provided in the headrail. A segment of the lift cord assembly located in the headrail is arranged in a manner that runs back and forth between the movable seat and the positioning pin. The transmission cord passes through the interference device, and has an end connected to the cord reel and another end connected to the movable seat. The cord reel is adapted to be concurrently motivated by the actuating device to retract or release the transmission cord, so that the lift cord assembly is, through the movable seat, concurrently motivated when the transmission cord is driven.

With the design mentioned above, the window blind provided in the present invention has the following advantages:

In summary, an auxiliary unit is further provided between the lifting mechanism and the tilt mechanism. When the covering assembly of the window blind is in the second state, i.e., when part of the covering assembly is unable to correspondingly rotate along with the relative vertical movement between two warps, the tilt mechanism could be further operated to drive the auxiliary unit to start operating. With the operation of the auxiliary unit, the lift cord assembly could be driven to be further released, which would eliminate the restriction imposed on the bottom rail by the length of the lift cord assembly, whereby the bottom rail could be further tilted by an angle. In this way, the covering assembly of the window blind could be changed into the first state again. In other words, with the presented invention, the covering assembly could be correspondingly rotated again along with the relative vertical movement created between two warps. As a result, when the window blind provided in the present invention is in the fully closed state, the region near the bottom rail would not have the problem of light leakage, and the desired shading area of the window would be in line with expectation. Therefore, an excellent light-blocking effect could be provided.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

The present invention will be best understood by referring to the following detailed description of some illustrative embodiments in conjunction with the accompanying drawings, in which.

DETAILED DESCRIPTION

Figure 1:
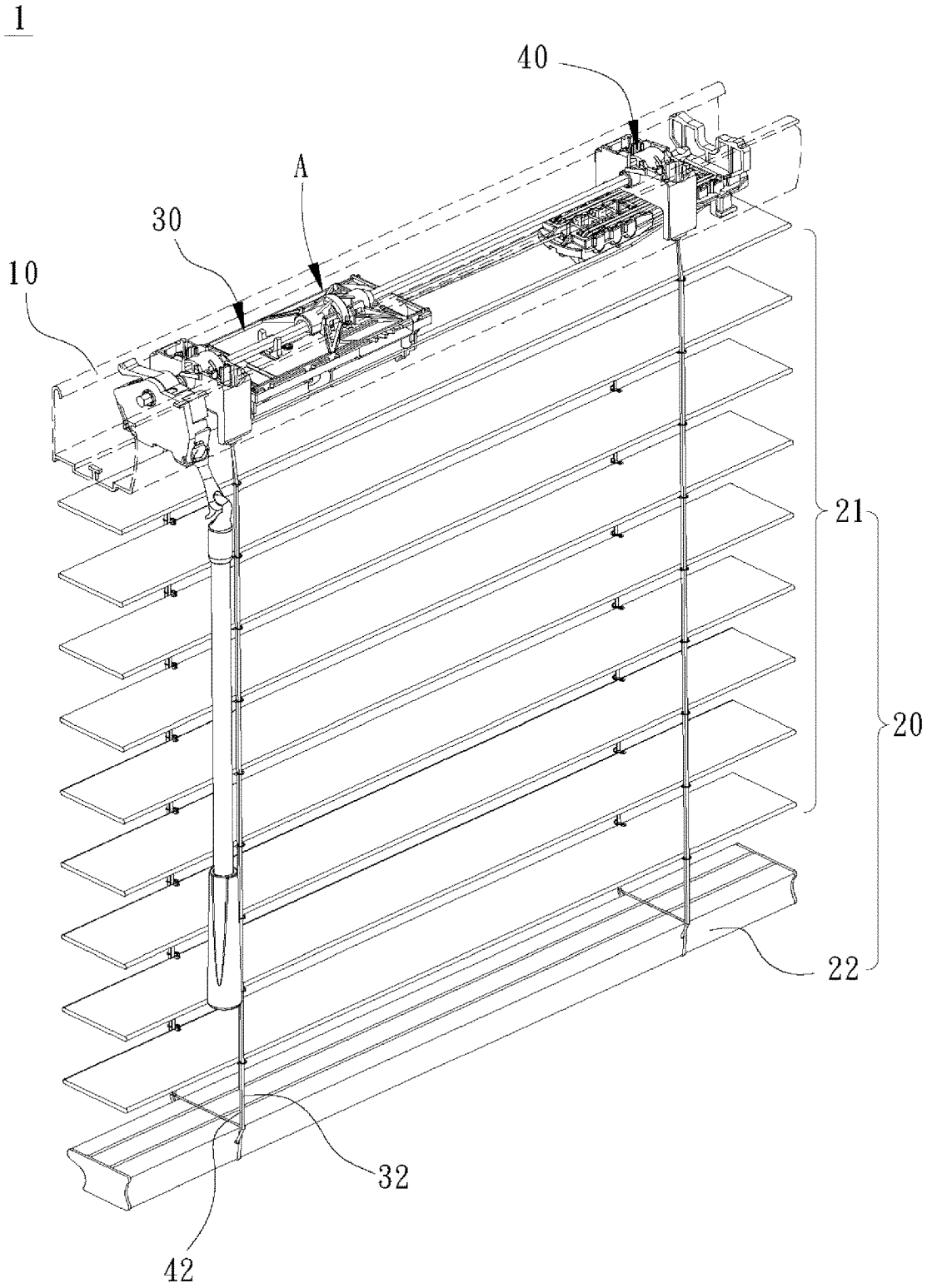
FIG. 1 is a perspective view of the window blind of the present invention.
Figure 2:
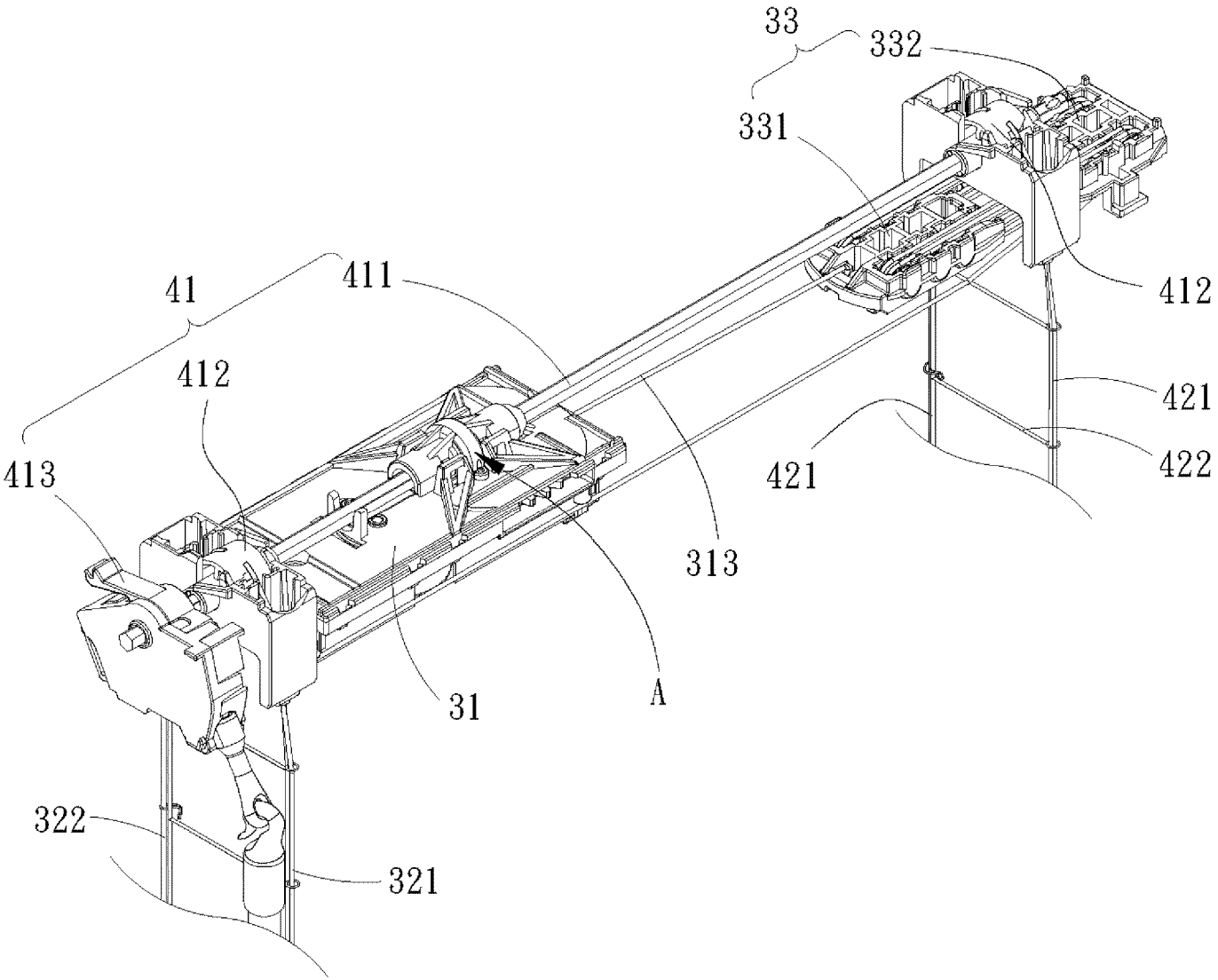
FIG. 2 is a perspective view of the mechanism inside the headrail shown in FIG. 1.
Figure 3:
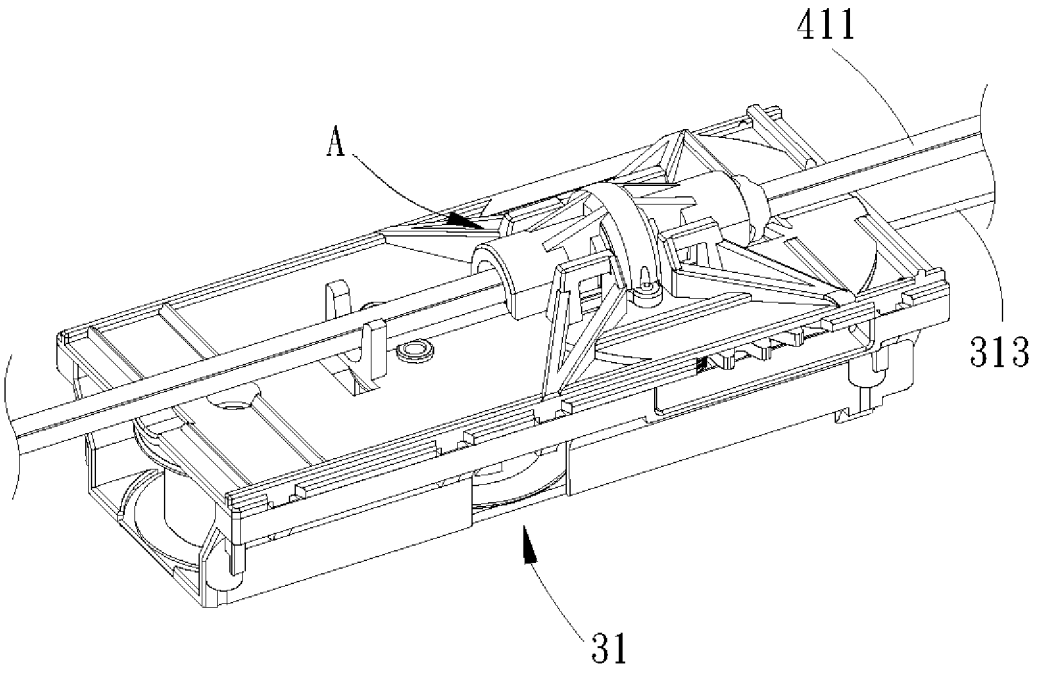
FIG. 3 is a perspective view of the auxiliary unit of a first embodiment provided in the window blind of the present invention; the driving module working with the auxiliary unit is also shown therein.

A window blind 1 provided in the present invention is shown in FIG. 1 to FIG. 10*b*, which includes a headrail 10, a covering assembly 20, a lifting mechanism 30, a tilt mechanism 40, and an auxiliary unit A. The covering assembly 20 is provided below the headrail 10, and sequentially includes a plurality of slats 21 and a bottom rail 22 in a direction away from the headrail 10. As shown in FIG. 2, the lifting mechanism 30 includes a driving module 31, a lift cord assembly 32 (shown in FIG. 1), and a movable seat assembly 33. The driving module 31 and the movable seat assembly 33 are located in the headrail 10, and each of which is concurrently motivated when the other one is driven. The lift cord assembly 32 includes a first cord 321 and a second cord 322, and is, through the movable seat assembly 33, concurrently motivated when the driving module 31 is driven. The movable seat assembly 33 includes a movable seat 331, which is movable in a longitudinal direction of the headrail 10, and a positioning pin 332, which is fixedly provided in the headrail 10. The first and the second cords 321, 322 are arranged in a manner that they both run back and forth between the positioning pin 332 and the movable seat 331, extend downward out of the headrail 10, and respectively pass by a front side and a rear side of the slats 21, wherein an end of each of the first and the second cords 321, 322 is connected to the movable seat 331, while another end thereof is connected to the bottom rail 22. As shown in FIG. 4*a*, the driving module 31 includes a cord reel 311, an actuating device 312 which is concurrently motivated when the cord reel 311 is driven, and a transmission cord 313 which is wound around the cord reel 311. An end of the transmission cord 313 is connected to the cord reel 311, and another end thereof is connected to the movable seat 331 of the movable seat assembly 33. The actuating device 312 includes a driving drum 3121, a spring-receiving drum 3122, and a torsion spring 3123. Two free ends of the torsion spring 3123 are respectively connected to the driving drum 3121 and the spring-receiving drum 3122. In an initial state, the torsion spring 3123 winds around the spring-receiving drum 3122. The cord reel 311 has a gear provided at an end thereof, and the driving drum 3121 also has a gear provided at an end thereof, wherein the gear of the driving drum 3121 meshes with the gear of the cord reel 311, by which to provide a driving effect.

To expand the covering assembly 20 of the window blind 1, the bottom rail 22 should be pulled downward, which would drive the lift cord assembly 32 to be gradually released from the headrail 10, and the movable seat 331 would be also pulled to slide at the same time in a direction away from the driving module 31. While the movable seat 331 is leaving the driving module 31 and approaching the positioning pin 332, the transmission cord 313 would be released from the cord reel 311 of the driving module 31 along with the sliding of the movable seat 331, driving the cord reel 311 to rotate simultaneously. Since the gear of the cord reel 311 meshes with the gear of the driving drum 3121, the cord reel 311 would also drive the driving drum 3121 to rotate, and the torsion spring 3123 would, therefore, be gradually released from the spring-receiving drum 3122 and wound around the driving drum 3121. On the other hand, when it is time to fold the covering assembly 20 of the window blind 1, the bottom rail 22 should be pushed upward. The balance achieved by the pulling force exerted by the covering assembly 20 on the driving module 31 and the elastic force provided by the actuating device 312 would be broken by the upward pushing force. At this time, the torsion spring 3123 would release the elastic force, driving the driving drum 3121 to rotate in an opposite direction. As a result, the torsion spring 3123 would gradually wind around the spring-receiving drum 3122. Meanwhile, the driving drum 3121 would drive the cord reel 311 to rotate, and therefore the transmission cord 313 would be gradually wound around the cord reel 311. The movable seat 331 would be pulled by the transmission cord 313 to slide toward the driving module 31, i.e., to gradually leave the positioning pin 332. In this way, the lift cord assembly 32 would be driven by the movable seat 331 to be retracted into the headrail 10, and therefore the slats 21 and the bottom rail 22 would be risen by the lift cord assembly 32, whereby the covering assembly 20 of the window blind 1 could be folded. It is worth mentioning that, the above-mentioned movable seat assembly 33 is a mechanism designed to modulate the space for the running of the lift cord assembly 32 and the required drop length of the fully expanded window blind 1. For window blinds which have a shorter drop length or adopt other kinds of mechanisms that are capable of adjusting the space or manners for the running of a lift cord assembly, the movable seat assembly 33 would not be essential. If suitable, the lift cord assembly 32 could be directly connected to and wound around the cord reel 311 of the driving module 31. With such arrangements, the covering assembly 20 of the window blind 1 could still be expanded or folded as required.

Figure 5:
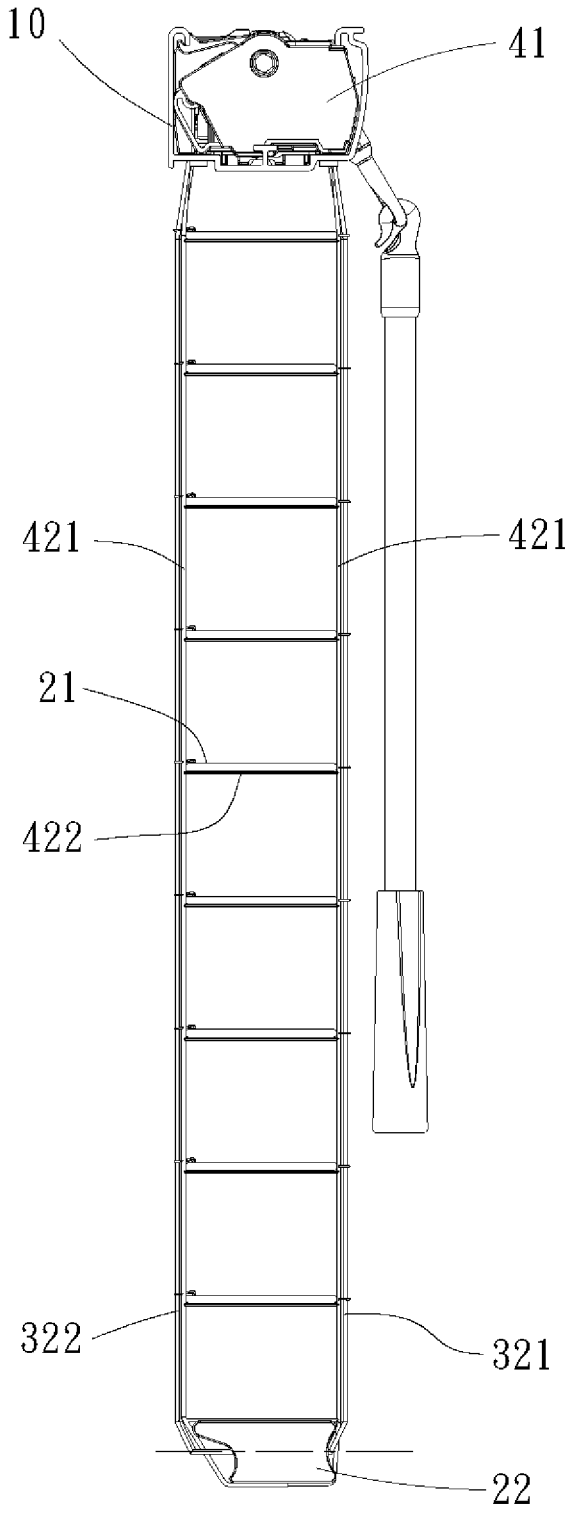
FIG. 5 is a side view of FIG. 1, showing that the covering assembly of the window blind is in the first state, and the bottom rail is at the initial position.
Figure 7:
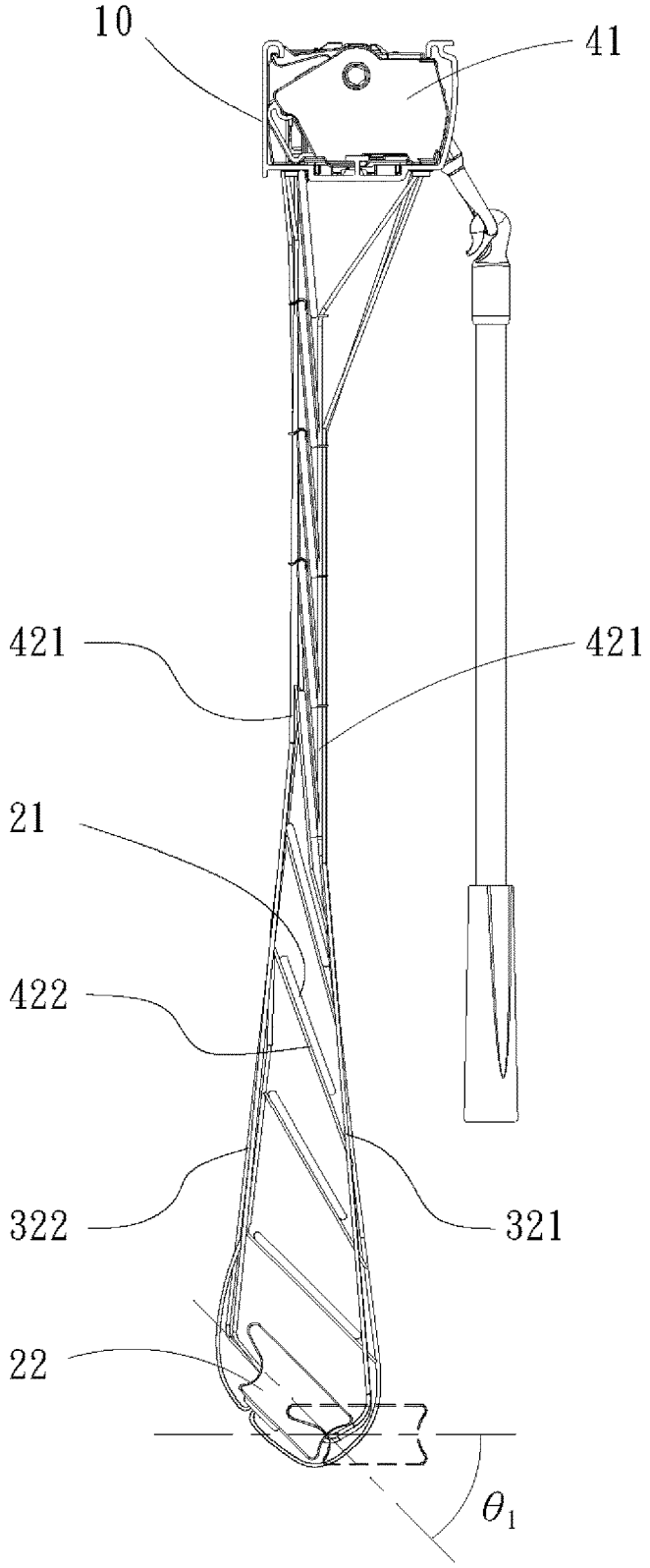
FIG. 7 is a side view of the window blind, showing that the covering assembly of the window blind is in the second state.

The tilt mechanism 40 includes a modulation module 41 and two ladder tapes 42. As shown in FIG. 2, the modulation module 41 includes a modulation shaft 411 provided in the headrail 10 and extending in a longitudinal direction of the headrail 10, two tilt members 412, and an operating unit 413. The tilt members 412 are provided in the headrail 10 at intervals, and the operating unit 413 is provided on a side in the headrail 10. The modulation shaft 411 respectively passes through the tilt members 412 and the operating unit 413, wherein the tilt members 412 move synchronously with the modulation shaft 411. The operating unit 413 can be driven by external forces (manually or electrically) to rotate the modulation shaft 411. The mechanism of the operating unit 413 is conventional, and therefore we are not going to describe it in detail herein. Each of the ladder tapes 42 is composed of two warps 421, which are vertical to the ground and parallel to each other, and a plurality of horizontal wefts 422 connecting the two warps 421. An end of each of the warps 421 is connected to one of the tilt members 412 in the headrail 10, and another end thereof is connected to the bottom rail 22. The slats 21 are disposed on the wefts 422 in a substantially horizontal manner. When the modulation shaft 411 is driven to rotate by the operating unit 413, the modulation shaft 411 synchronously motivates the tilt members 412 to rotate, and therefore the warps 421 connected to the tilt members 412 create a relative vertical movement and approach each other, whereby the horizontal wefts 422 are tilted. As a result, the slats 21 resting on the wefts 422 and the bottom rail 22 connected to the warps 421 rotate correspondingly. In this way, the slats 21 of the covering assembly 20 could be turned between an open state, which allows light to pass therethrough, and a closed state, which blocks light, in response to the operation of the tilt mechanism 40, as shown in FIG. 5 and FIG. 7. Therefore, the effect of adjusting the amount of light allowed to pass through the window blind 1 could be realized.

The auxiliary unit A is provided between the lifting mechanism 30 and the tilt mechanism 40, wherein the auxiliary unit A includes a timing transmission mechanism provided on the modulation module 41, and a driven member provided on the driving module 31. The timing transmission mechanism can be driven by the modulation module 41, and is able to drive the driven member once it reaches a predetermined position. After that, the driven member concurrently motivates the driving module 31 to further release the lift cord assembly 32.

Figure 10A:
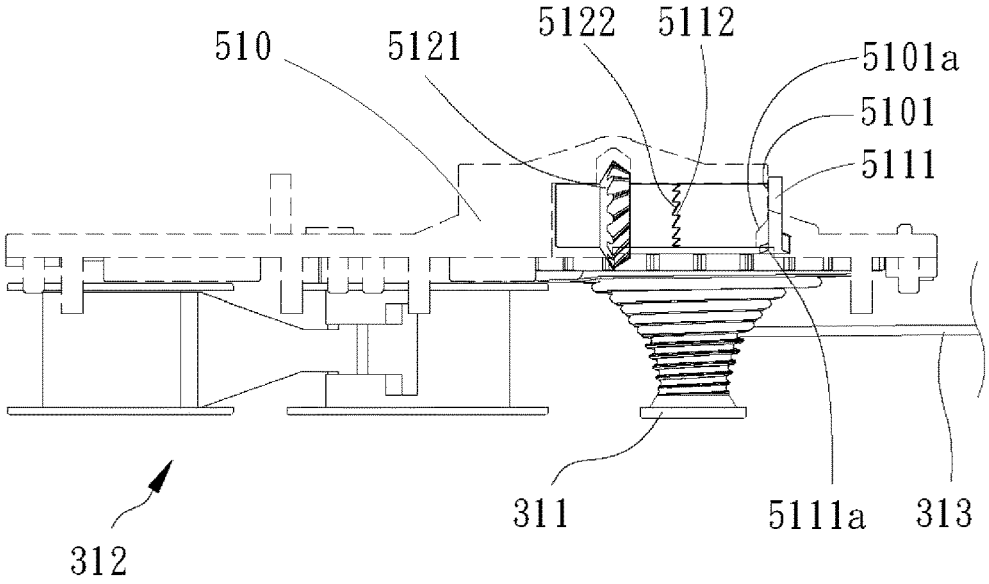
FIG. 10*a* is a side view showing the condition of the auxiliary unit and the driving module when the covering assembly gradually turns from the second state to the first state as shown in FIG. 9, wherein part of the casing is omitted.
Figure 10B:
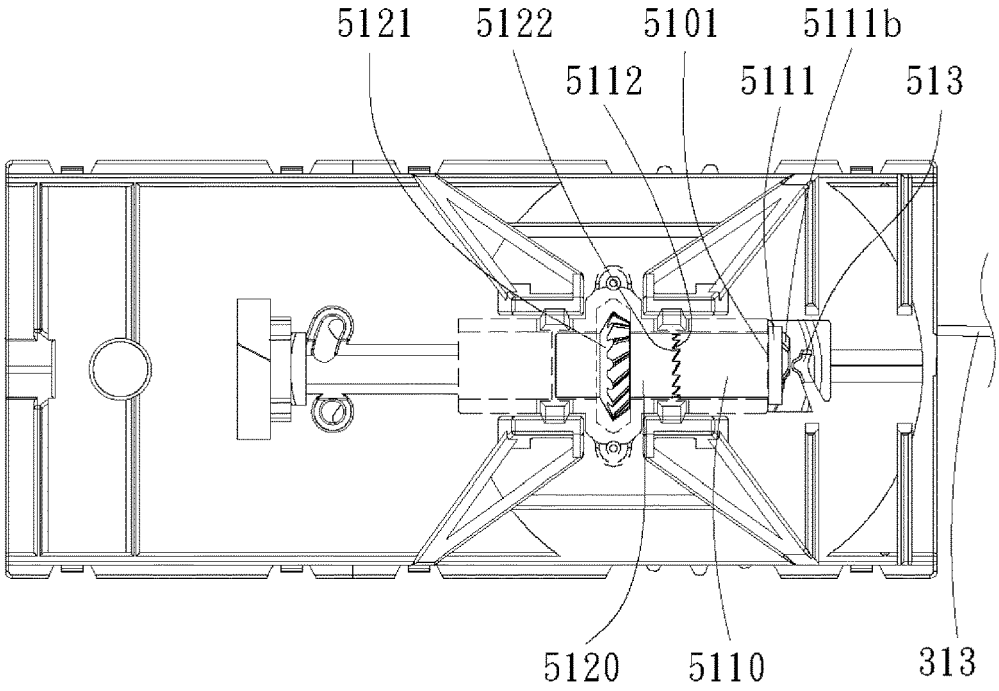
FIG. 10*b* is a top view of the auxiliary unit and the driving module shown in FIG. 10*a;*
Figure 11:
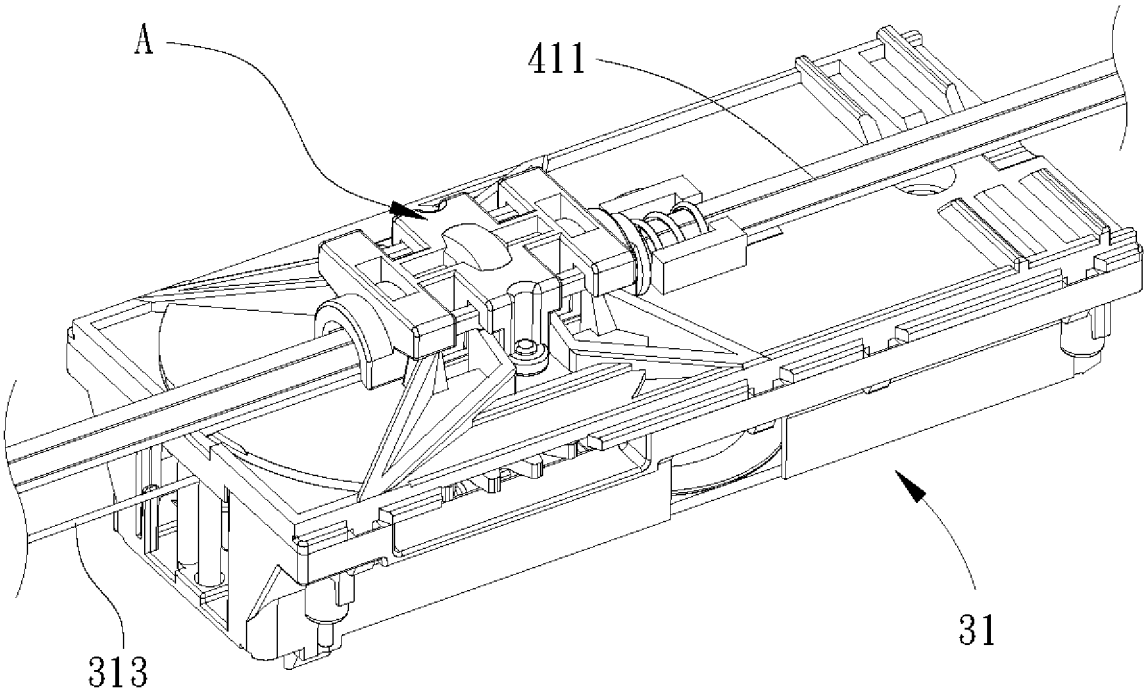
FIG. 11 is a perspective view of the auxiliary unit of a second embodiment provided in the window blind of the present invention; the driving module working with the auxiliary unit is also shown therein.
Figure 12A:
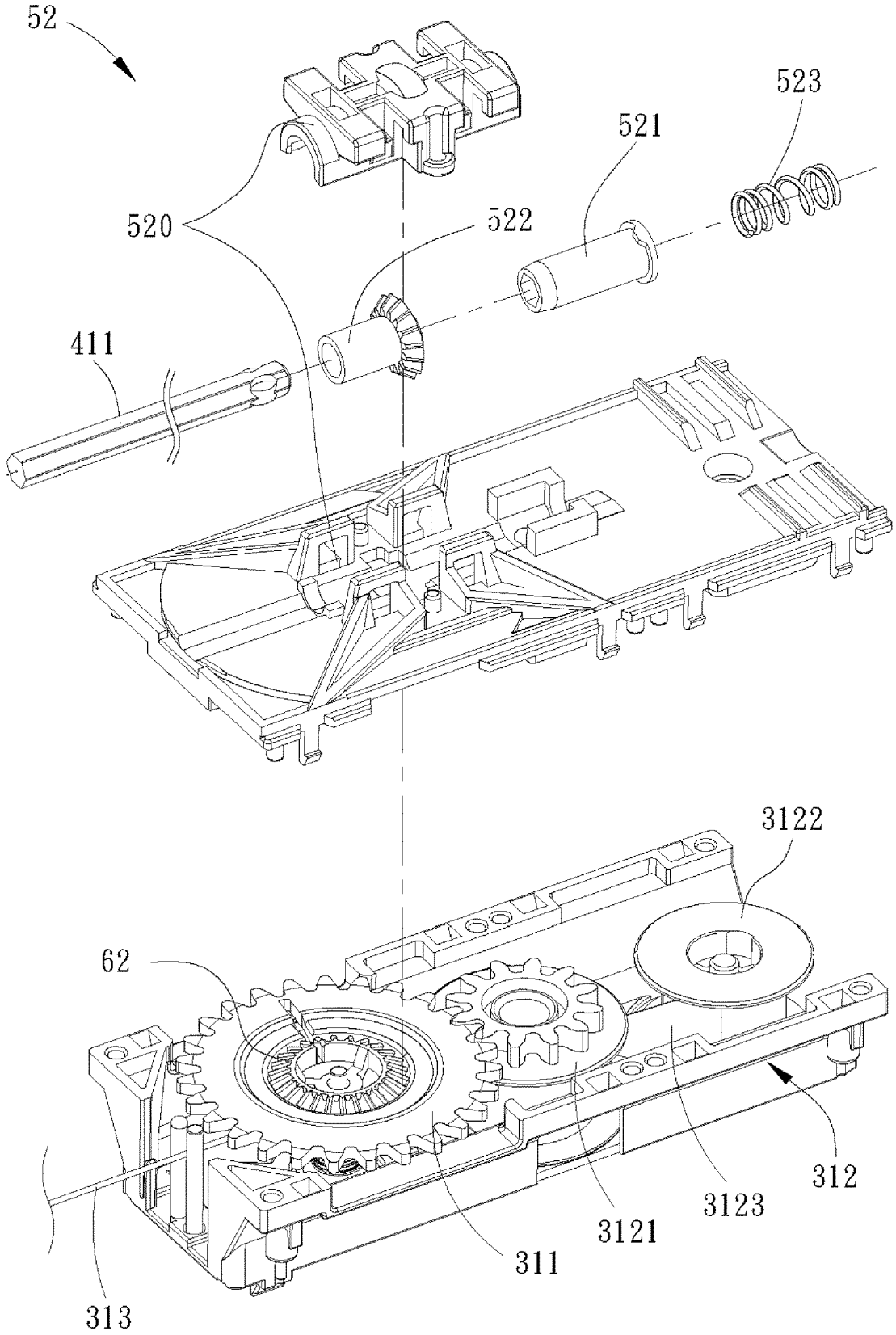
FIG. 12*a* is an exploded view of the auxiliary unit and the driving module shown in FIG. 11.
Figure 12B:
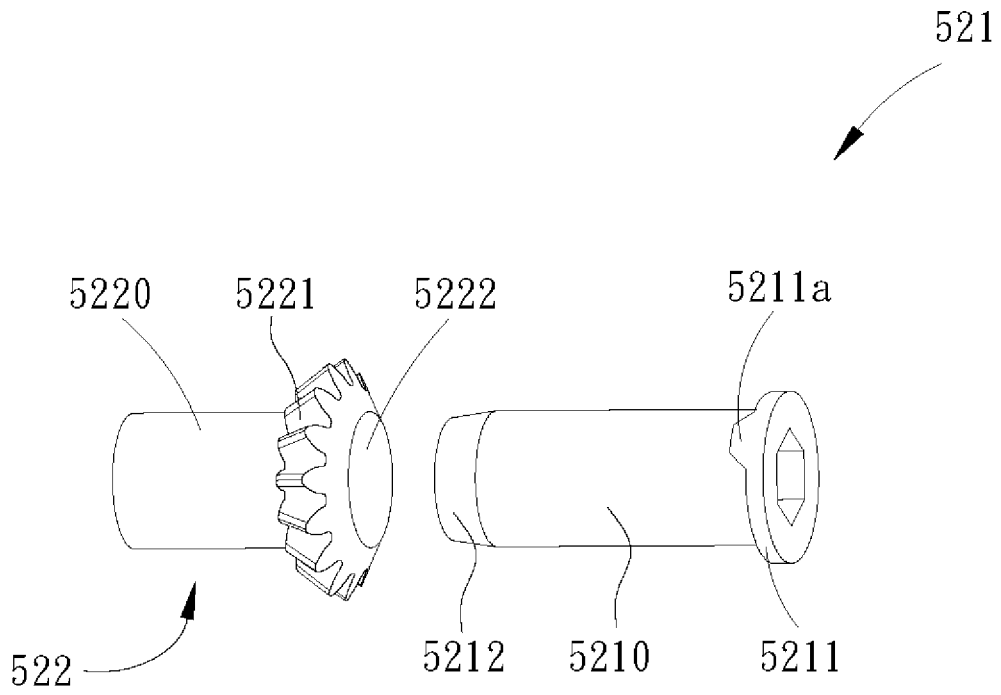
FIG. 12*b* is an enlarged view showing the details of the first sleeve and the second sleeve of FIG. 12*a;*
Figure 13A:
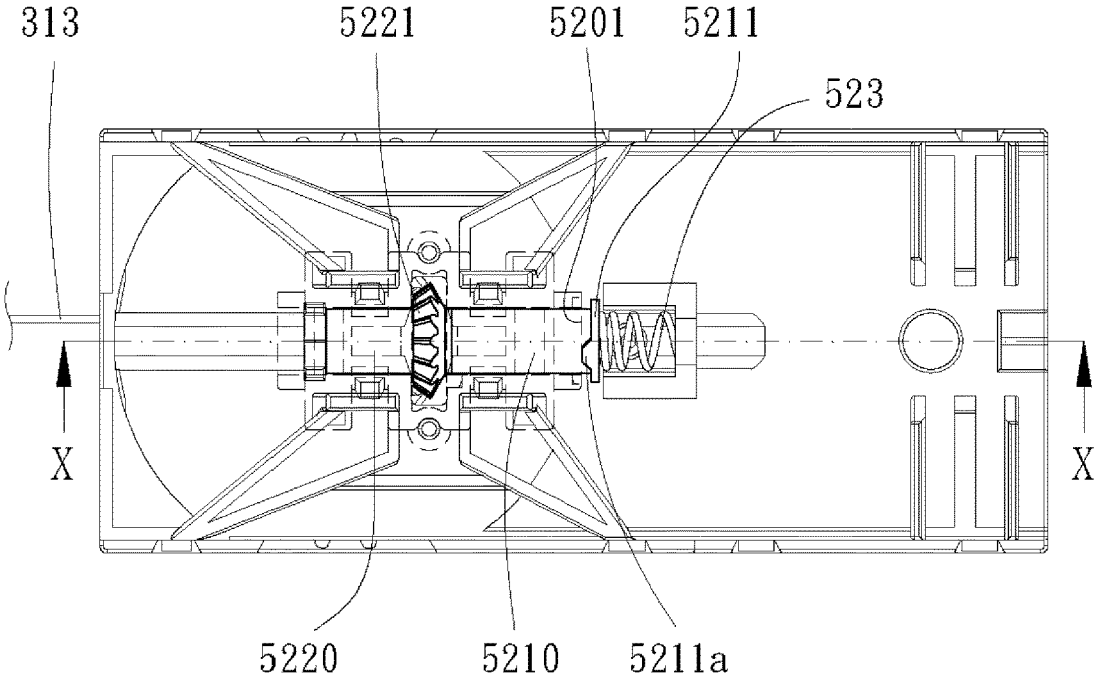
FIG. 13*a* is a top view showing the condition of the auxiliary unit and the driving module in the second embodiment when the covering assembly of the window blind is in the first state as illustrated in FIG. 5.
Figure 13B:
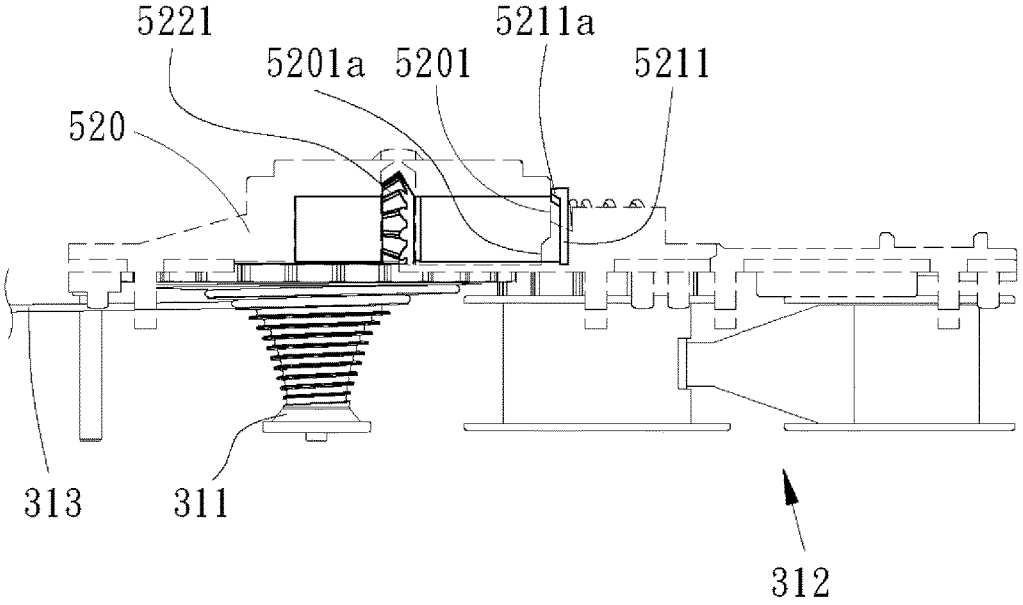
FIG. 13*b* is a side view of the auxiliary unit and the driving module shown in FIG. 13*a*, with part of the casing omitted.
Figure 14A:
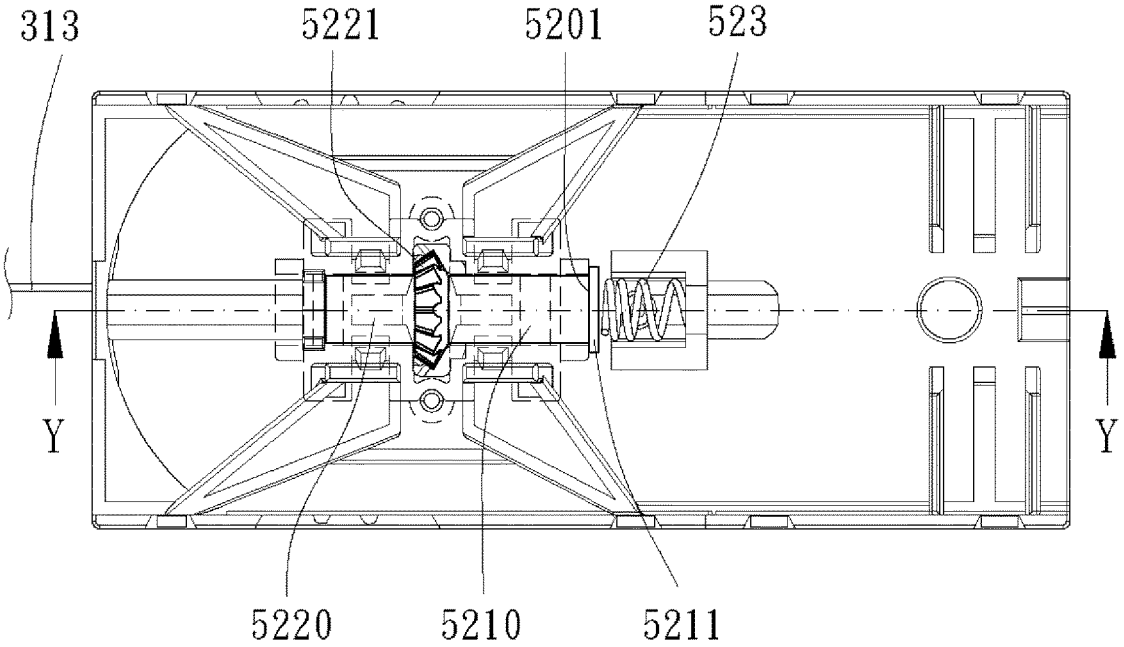
FIG. 14*a* is a top view showing the condition of the auxiliary unit and the driving module in the second embodiment when the covering assembly of the window blind is in the second state as illustrated in FIG. 7.
Figure 14B:
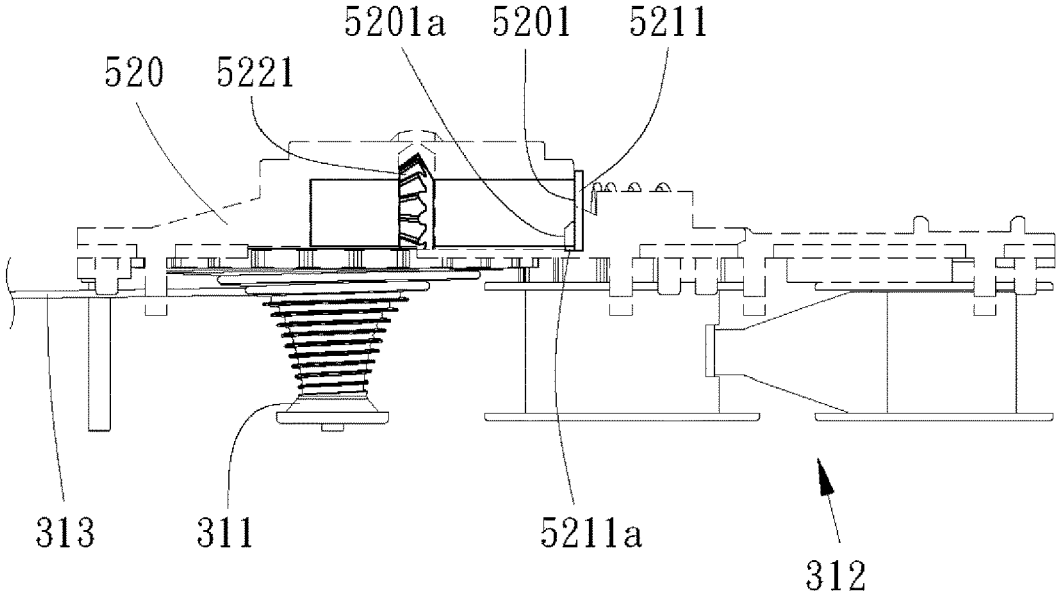
FIG. 14*b* is a side view of the auxiliary unit and the driving module shown in FIG. 14*a*, with part of the casing omitted.
Figure 13C:
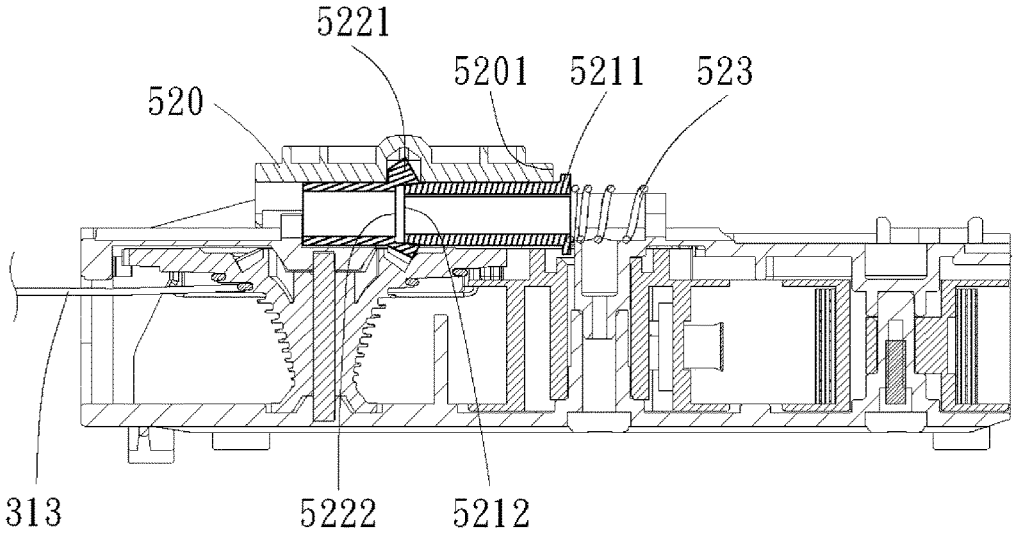
FIG. 13*c* is a sectional view of the auxiliary unit and the driving module viewed along the X-X line in FIG. 13*a;*
Figure 14C:
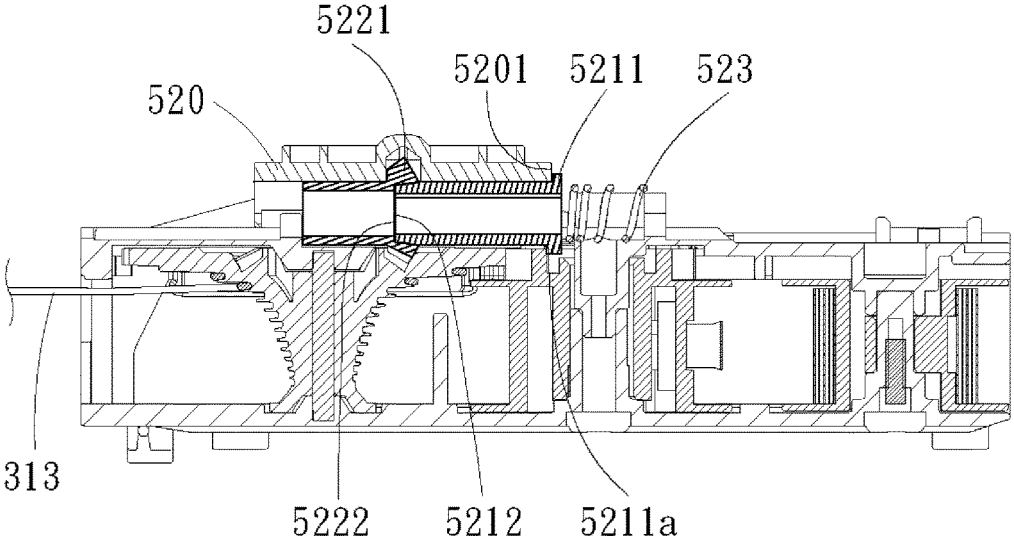
FIG. 14*c* is a sectional view of the auxiliary unit and the driving module viewed along the Y-Y line in FIG. 14*a;*
Figure 15:
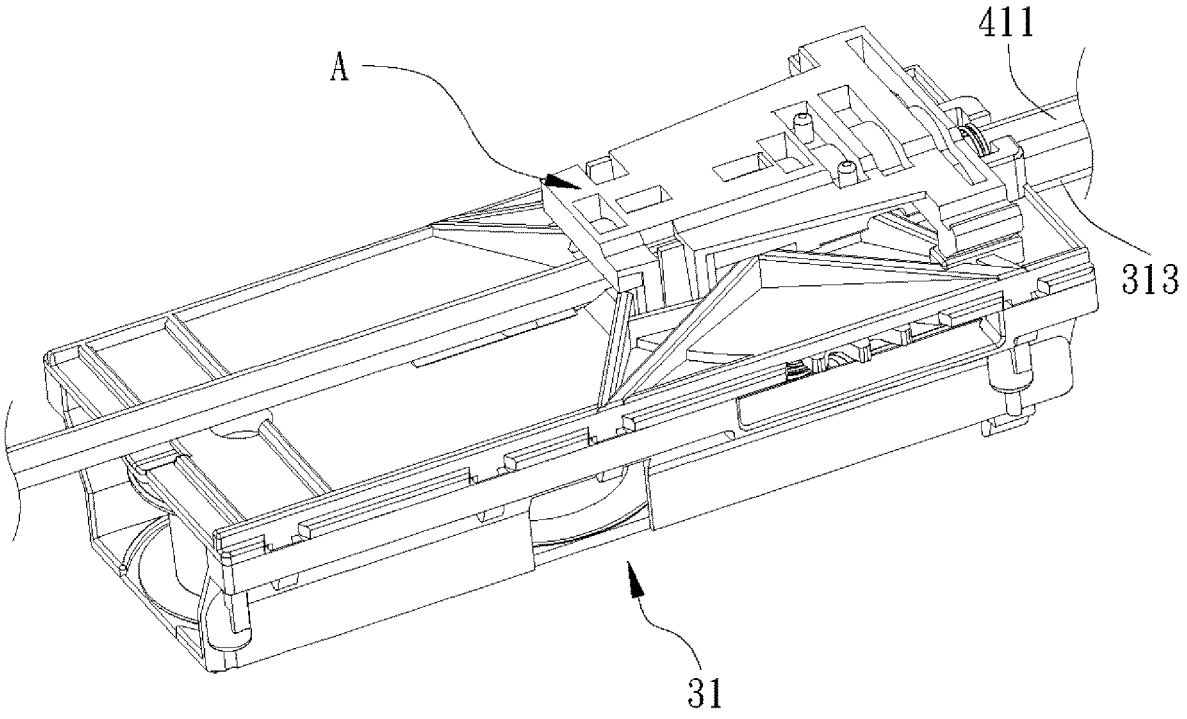
FIG. 15 is a perspective view of the auxiliary unit of a third embodiment provided in the window blind of the present invention; the driving module working with the auxiliary unit is also shown therein.
Figure 16:
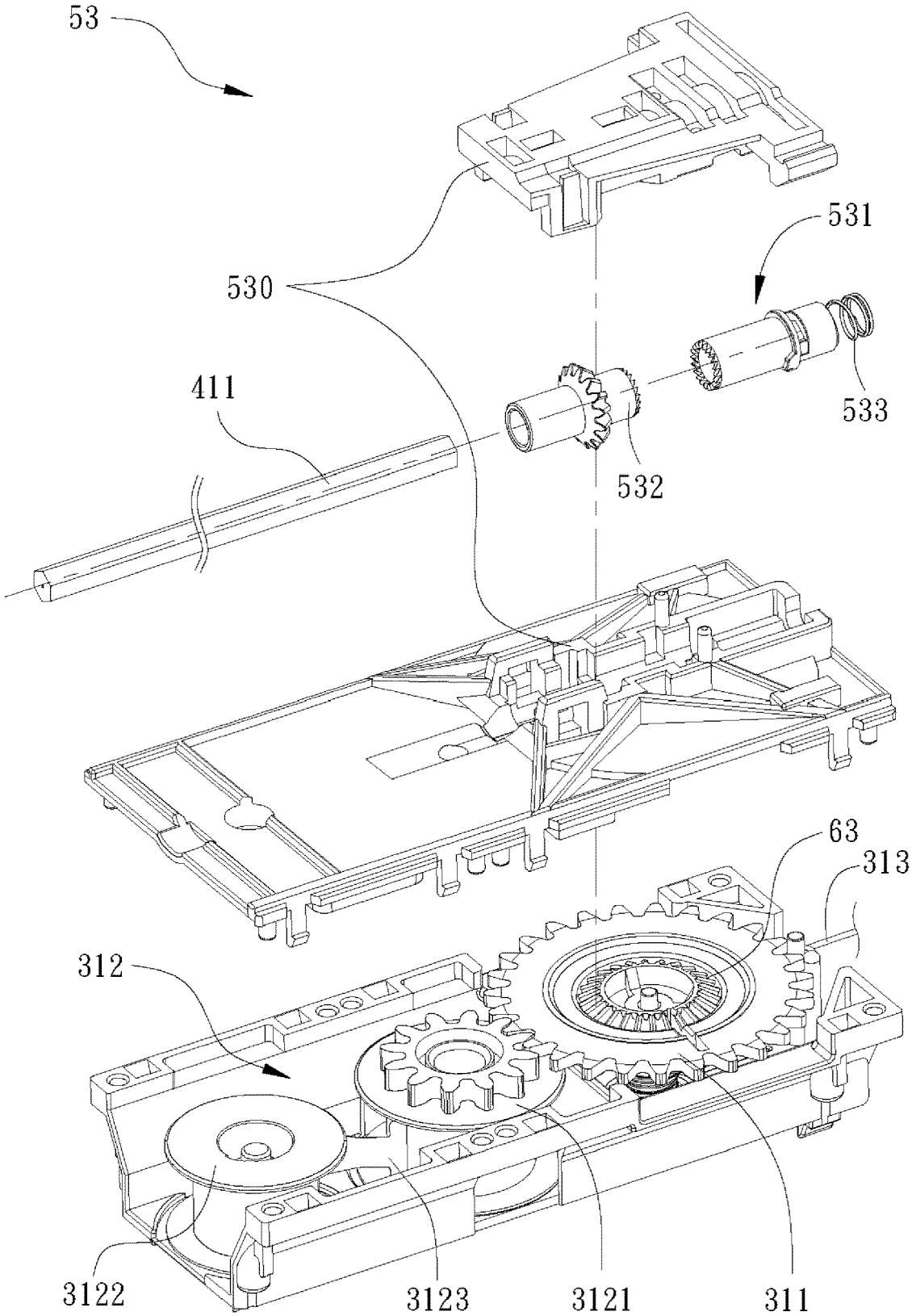
FIG. 16 is an exploded view of the auxiliary unit and the driving module shown in FIG. 15.

An auxiliary unit A of a first embodiment of the present invention is shown in FIG. 3 to FIG. 10*b*. The timing transmission mechanism 51 of the auxiliary unit A is provided on the modulation shaft 411, and the driven member thereof is provided on the cord reel 311. As shown in FIG. 4*a*, timing transmission mechanism 51 of the current embodiment includes a housing 510, a first sleeve 511, a second sleeve 512, and a restoring member. The first sleeve 511 and the second sleeve 512 fit around the modulation shaft 411 at intervals, and at least part of the first sleeve 511 and at least part of the second sleeve 512 are covered by the housing 510. As shown in FIG. 4*b*, the first sleeve 511 includes a hollow first sleeve body 5110, a limiting portion 5111, and a first engaging portion 5112, wherein an outline of an inner surface of the first sleeve body 5110 is a hexagon substantially similar to an outline of the modulation shaft 411. However, the first sleeve body 5110 does not tightly fit around the modulation shaft 411, so that the first sleeve 511 can be synchronously rotated with the modulation shaft 411, and is slidable along the modulation shaft 411. The second sleeve 512 includes a hollow second sleeve body 5120, a toothed ring 5121, and a second engaging portion 5122, wherein an outline of an inner surface of the second sleeve body 5120 is substantially round, and the second sleeve body 5120 does not interfere with the modulation shaft 411, so that the second sleeve 512 can be freely rotated relative to the modulation shaft 411. The first engaging portion 5112 of the first sleeve 511 is located on an end surface of the first sleeve body 5110, and is provided in a direction facing the second sleeve 512. The limiting portion 5111 is located at an opposite end of the first sleeve body 5110, and is formed by surrounding an outer surface of the first sleeve body 5110. Furthermore, the limiting portion 5111 is provided corresponding to an abutting portion 5101 of the housing 510. The limiting portion 5111 has a protrusion 5111*a* protruding in an axial direction of the first sleeve body 5110 and toward the abutting portion 5101, and another protrusion 5111*b* protruding in the axial direction of the first sleeve body 5110 and a direction opposite to the protrusion 5111*a*. The protrusions 5111*a*, 5111*b* are substantially wedge-shaped. The toothed ring 5121 of the second sleeve 512 is formed by surrounding an outer surface of the second sleeve body 5120. The second engaging portion 5122 is located on an end surface of the second sleeve body 5120, wherein the second engaging portion 5122 faces the first engaging portion 5112 of the first sleeve 511, and corresponds to the first engaging portion 5112. An outline of the first engaging portion 5112 is complementary to an outline of the second engaging portion 5122, such as continuous tooth profiles. When the modulation shaft 411 drives the first sleeve 511 to rotate, the first engaging portion 5112 of the first sleeve 511 engages with the second engaging portion 5122 of the second sleeve 512 at a predetermined position (i.e., a predetermined rotation angle). In the current embodiment, the restoring member is a blocker 513 integrally formed on the housing 510, as shown in FIG. 4*a*. Said blocker 513 corresponds to the limiting portion 5111, and the protrusion 5111*b* of the limiting portion 5111 abuts against the blocker 513 when the limiting portion 5111 is rotated to a predetermined position (i.e., a predetermined rotation angle), as shown in FIG. 10*b*. In the current embodiment, the housing 510 is provided by assembling two sub-components, and one of the sub-components is integrally formed with an upper cover of the driving module 31. However, this is not a limitation of the present invention; as long as the housing 510 could be ensured to firmly support the first sleeve 511, the second sleeve 512, and the restoring member which are contained therein, the housing 510 could be a standalone component independent of the upper cover of the driving module 31, or could consist of more than two sub-components.

Figure 4A:
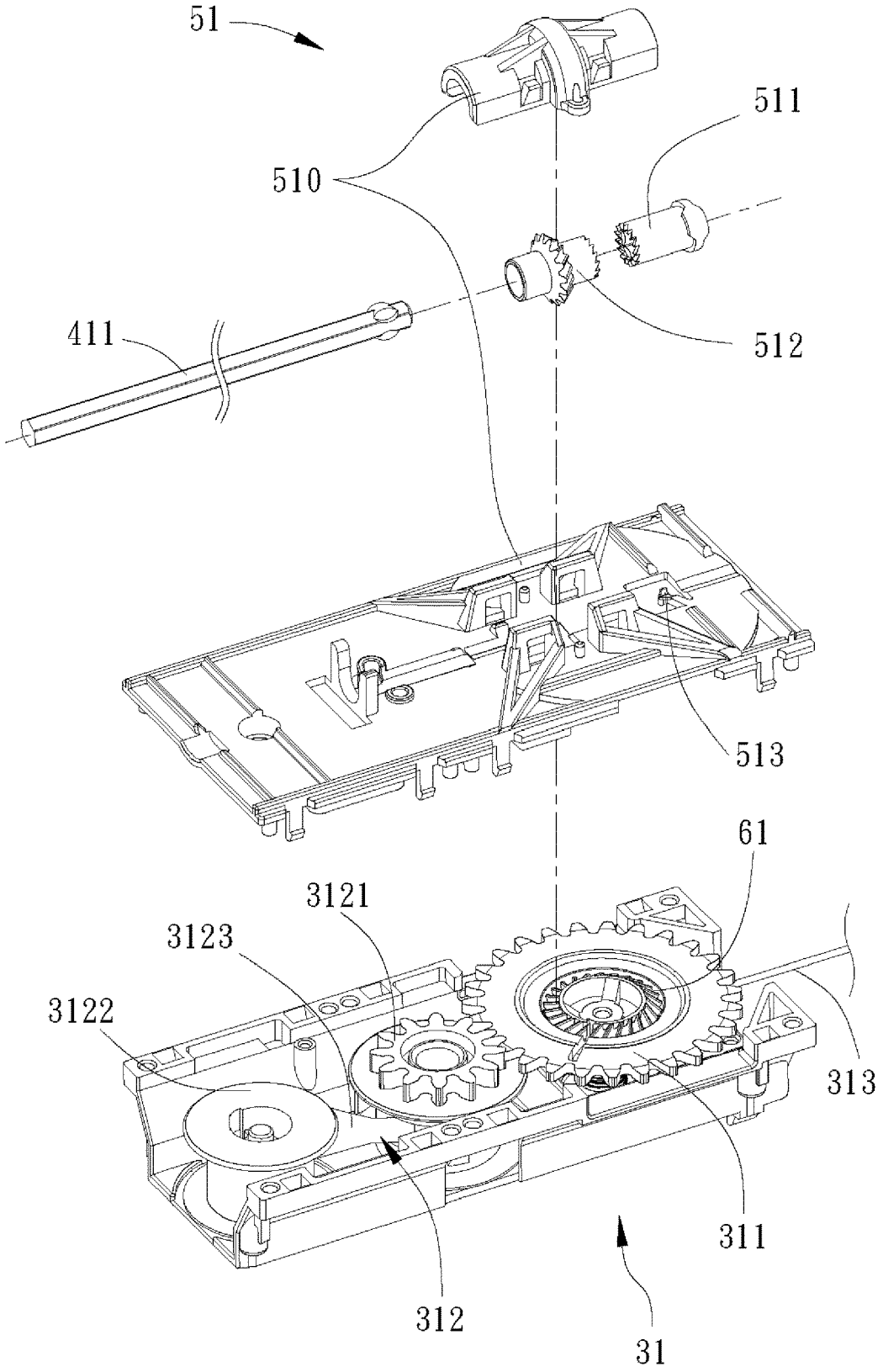
FIG. 4*a* is an exploded view of the auxiliary unit and the driving module shown in FIG. 3.
Figure 4B:
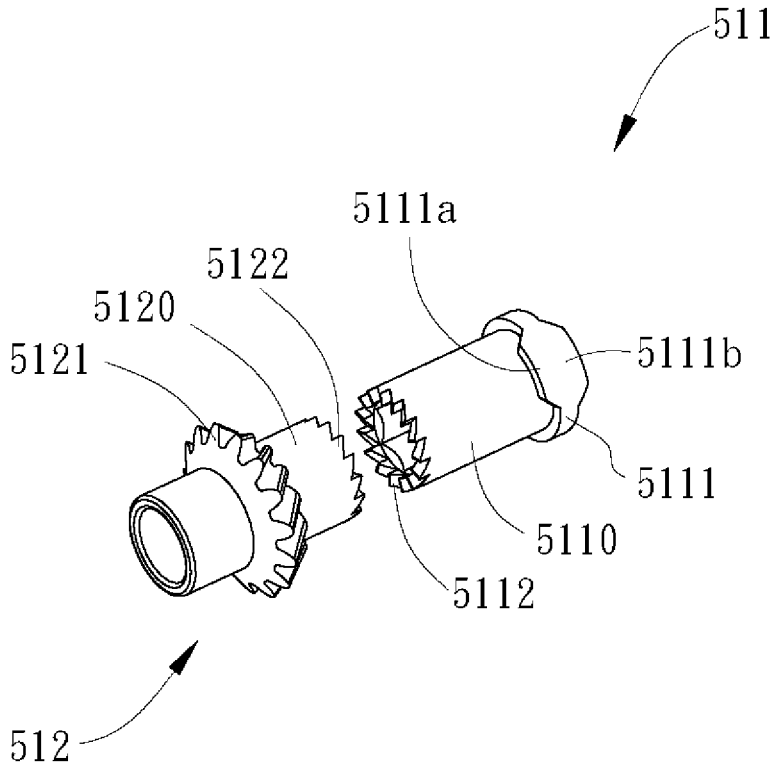
FIG. 4*b* is an enlarged view showing the details of the first sleeve and the second sleeve of FIG. 4*a;*

The driven member in the current embodiment includes a toothed structure 61 provided on the cord reel 311 of the driving module 31, as shown in FIG. 4*a*. The toothed structure 61 is provided in a manner corresponding to the toothed ring 5121 of the second sleeve 512, and always meshes with the toothed ring 5121. The toothed structure 61 and the cord reel 311 are integrally made, so that the toothed structure 61 moves synchronously with the cord reel 311. However, this is not a limitation of the present invention; the toothed structure 61 could be a standalone component independent of the cord reel 311 in other embodiments, as long as the toothed structure 61 can be rotated synchronously with the cord reel 311. Furthermore, the toothed structure 61 of the driven member could be also provided on the actuating device 312 which synchronously moves with the cord reel 311. For example, the toothed structure 61 could be provided on the driving drum 3121 or the spring-receiving drum 3122, integrally made with the driving drum 3121 or with spring-receiving drum 3122, or a standalone component fixedly provided relative to the driving drum 3121 or the spring-receiving drum 3122. Any arrangements exemplified herein would not hinder the effect and objective of the present invention.

Figure 6A:
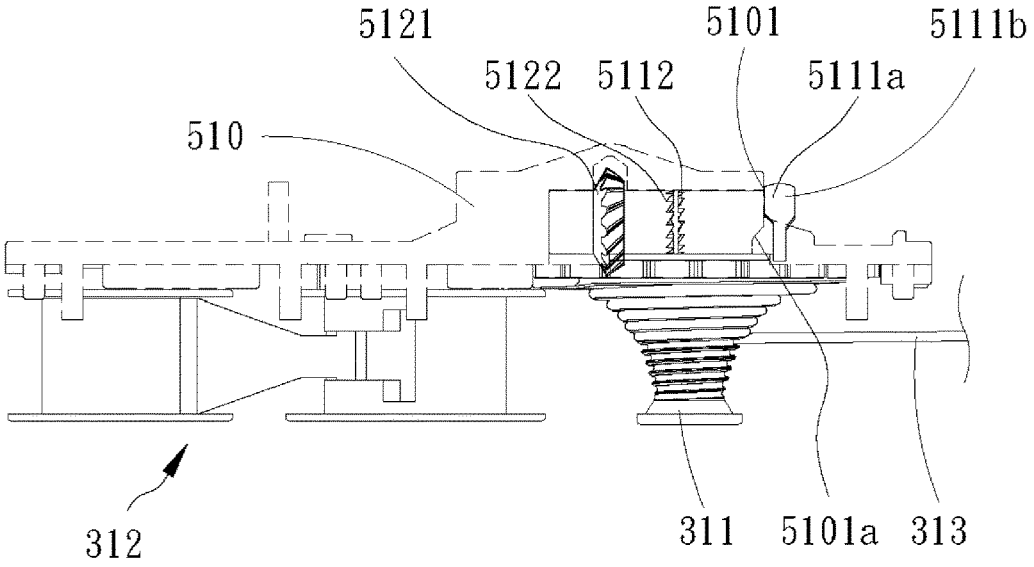
FIG. 6*a* is a side view showing the condition of the auxiliary unit and the driving module, with part of the casing omitted, when the covering assembly is in the first state.
Figure 6B:
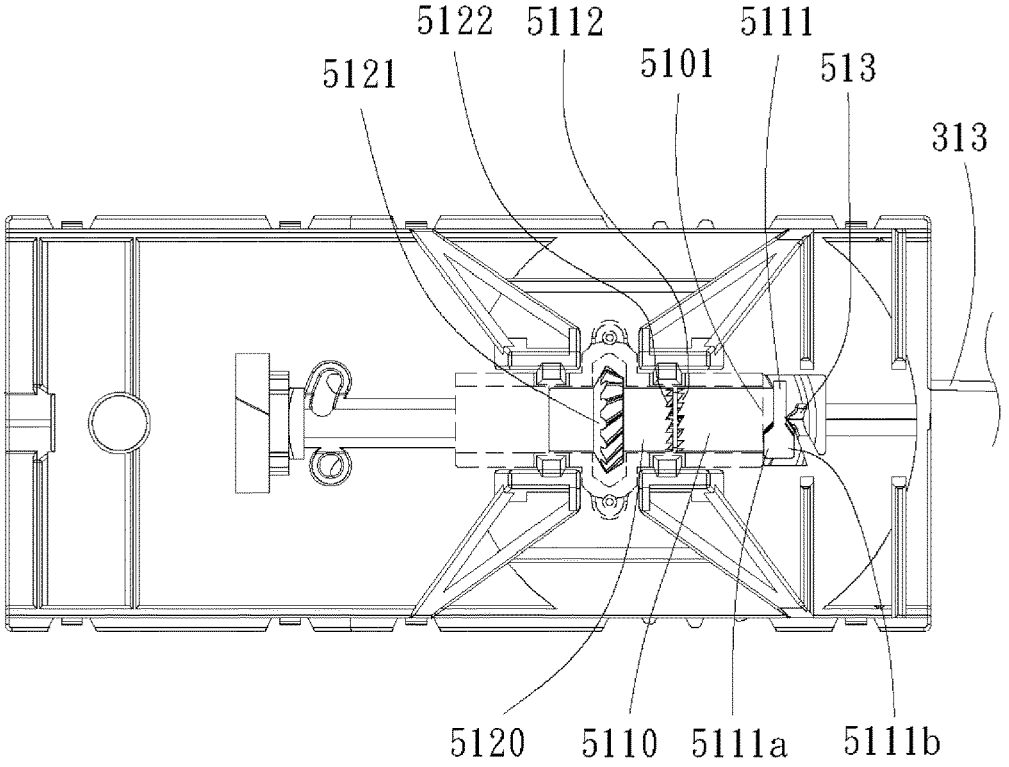
FIG. 6*b* is a top view of the auxiliary unit and the driving module shown in FIG. 6*a;*

The operation and effect of the auxiliary unit A of the window blind 1 at different stages are explained below. As shown in FIG. 5, when the lifting mechanism 30 is maneuvered to fully expand the window blind 1, the bottom rail 22 is moved to the position most distant to the headrail 10, and the slats 21 and the bottom rail 22 of the covering assembly 20 are all substantially horizontal and parallel to each other. The bottom rail 22 is also substantially horizontal in the longitudinal direction, and its current position is defined as an initial position. Meanwhile, the slats 21 are in the open state. The housing 510 in FIG. 6*a* and FIG. 6*b* is shown transparently, and the parts of the housing 510 which are required to be depicted are expressed in dotted lines, whereby the position change and the collaboration of the first sleeve 511 and the second sleeve 512 in the housing 510 can be clearly illustrated. The protrusion 5111*a* of the limiting portion 5111 of the first sleeve 511 tightly abuts against the abutting portion 5101 of the housing 510, so that the first sleeve 511 and the second sleeve 512 are separated by a distance, and the first and the second engaging portions 5112, 5122 are disengaged. At this time, the auxiliary unit A has not operated yet. When the tilt mechanism 40 is operated, the modulation shaft 411 operates to rotate the tilt members 412, and therefore each of the slats 21 of the covering assembly 20 is correspondingly turned along with the relative vertical movement between the warps 421 of each one of the ladder tapes 42. At this stage, the slats 21 and the bottom rail 22 are still substantially parallel to each other. Herein we define that the covering assembly 20 is in the first state if each of its slats 21 and the bottom rail 22 are substantially parallel to each other.

Figure 8A:
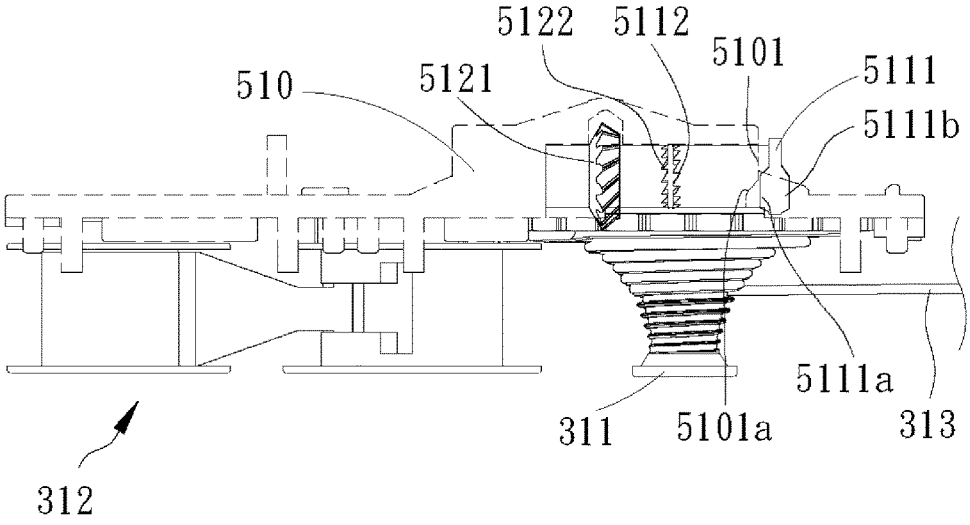
FIG. 8*a* is a side view showing the condition of the auxiliary unit and the driving module, with part of the casing omitted, when the covering assembly is in the second state.
Figure 8B:
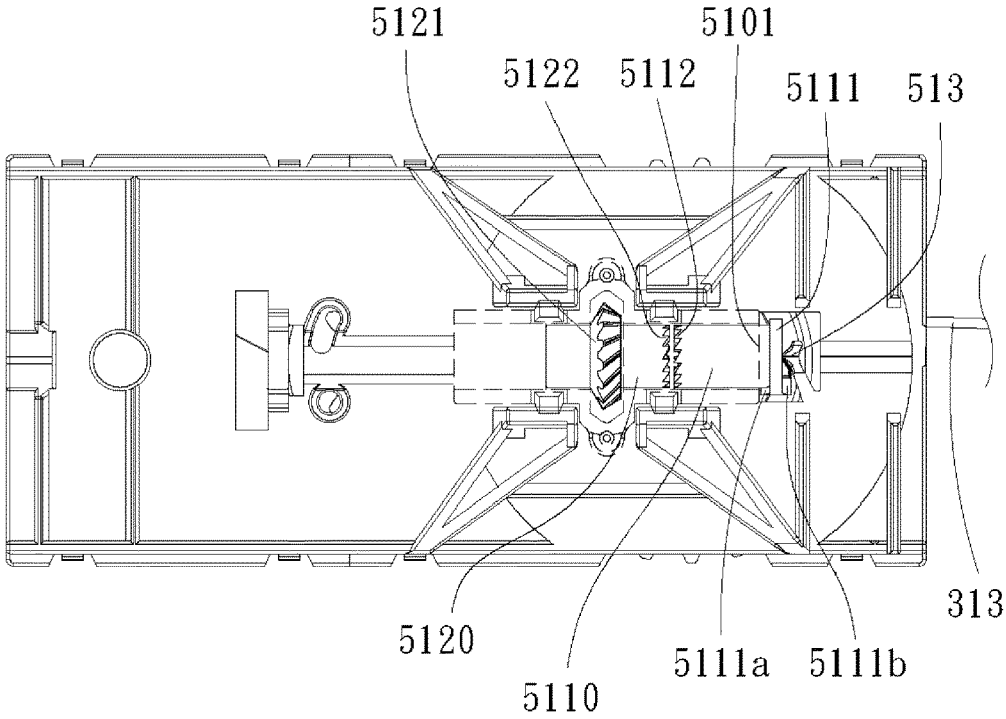
FIG. 8*b* is a top view of the auxiliary unit and the driving module shown in FIG. 8*a;*
Figure 9:
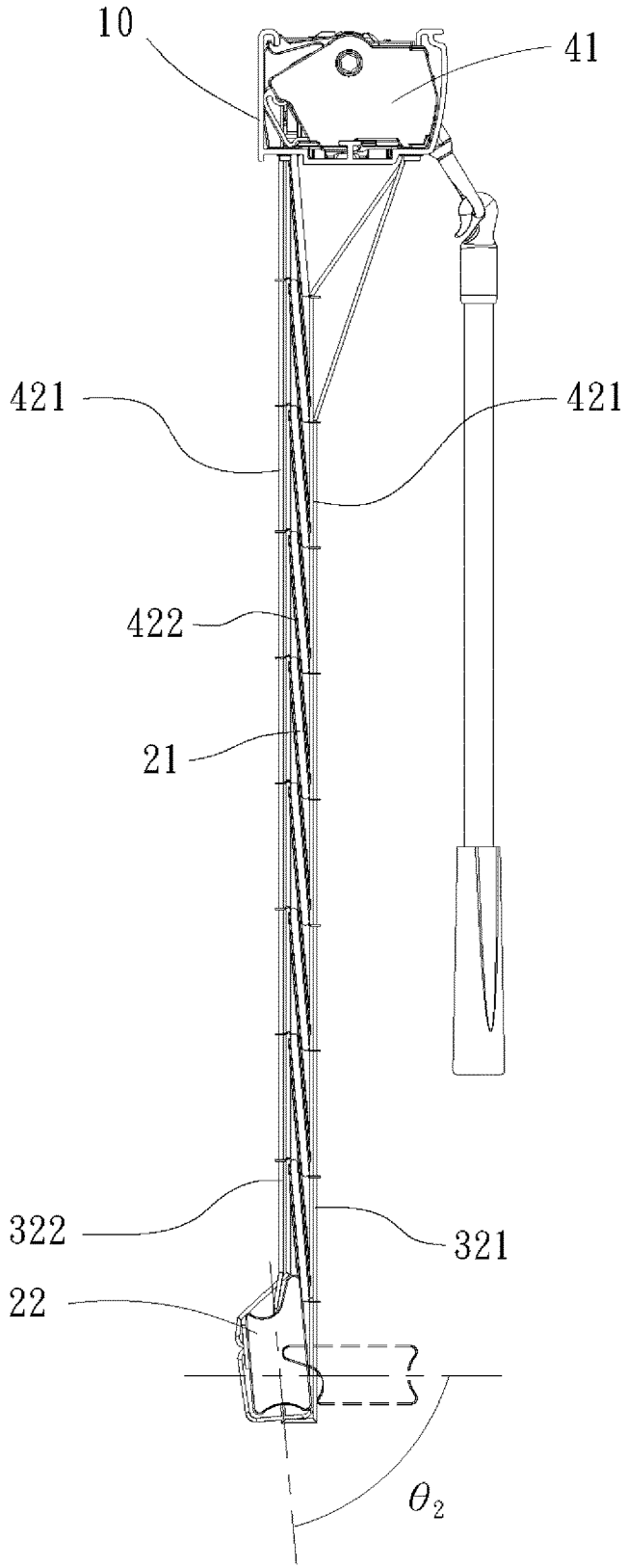
FIG. 9 is a side view of the window blind, showing that the covering assembly of the window blind switches from the second state shown in FIG. 7 into the first state again when maneuvered.

After the angle modulation described above, if the tilt mechanism 40 is kept being maneuvered to make the slats 21 turn toward the closed state, as shown in FIG. 7, the slats 21 of the covering assembly 20 near the headrail 10 will be correspondingly turned in response to the relative vertical movement and the approaching movement created between the warps 421 of each one of the ladder tapes 42. However, since the length of the lift cord assembly 32 cannot be changed from this time point on, the lift cord assembly 32 will restrict the rotation angle of the bottom rail 22. As a result, the bottom rail 22 could only be tilted to a position which has a first angle θ1 relative to the initial position of the bottom rail 22 shown in FIG. 5. A segment of the ladder tapes 42 near the bottom rail 22 would be affected by the bottom rail 22, and therefore the warps 421 would be unable to further approach each other. In addition, the slats 21 near the bottom rail 22 would be also hindered by the bottom rail 22 and the ladder tapes 42, and therefore would not be turned to the extent that the slats 21 away from the bottom rail 22 would. Consequently, some slats 21 of the covering assembly 20 and the bottom rail 22 are no longer parallel to each other. Herein we define the covering assembly 20 is in a second state if some of the slats 21 and the bottom rail 22 are not parallel to each other. The housing 510 in FIG. 8*a* and FIG. 8*b* is also shown transparently, and the parts thereof which are required to be depicted are expressed in dotted lines, whereby the position change and collaboration of the components contained in the housing 510 can be clearly illustrated. When in the second state, the modulation shaft 411 has been rotated, and therefore the first sleeve 511 of the timing transmission mechanism 51 has been rotated synchronously as well. During the process, the protrusion 5111*a* on the limiting portion 5111 is also brought to move along the outline of the abutting portion 5101. At this time, the first sleeve 511 and the second sleeve 512 are still disengaged.

The housing 510 in FIG. 10*a* and FIG. 10*b* is, again, shown transparently, and the parts thereof which are required to be depicted are expressed in dotted lines, whereby the position change and collaboration of the components contained in the housing 510 can be clearly illustrated. When the covering assembly 20 is in the aforementioned second state shown in FIG. 7 and the tilt mechanism 40 is further maneuvered in the direction the same as that described above to close the slats 21, the protrusion 5111*a* on the limiting portion 5111 of the timing transmission mechanism 51 would be moved to a position corresponding to the notch 5101*a* of the abutting portion 5101, and the another protrusion 5111*b* would also be moved to a position corresponding to the blocker 513 of the restoring member to bear the pushing force provided by the blocker 513, wherein the pushing force urges the limiting portion 5111 to move toward the abutting portion 5101, and therefore the protrusion 5111*a* would go into the notch 5101*a*, and would be completely separated from the abutting portion 5101 at where the notch 5101*a* is by further rotating the modulation shaft 411. As a result, the first sleeve 511 slides toward the second sleeve 512, so that the first engaging portion 5112 and the second engaging portion 5122 are engaged with each other. At this time, the second sleeve 512 could be synchronously rotated with the modulation shaft 411 along with the first sleeve 511. Meanwhile, through the meshing between the toothed ring 5121 of the second sleeve 512 and the toothed structure 61 of the driven member, the rotation of the second sleeve 512 could drive the cord reel 311 to rotate. It should be noted that, the rotation direction of the cord reel 311 at this time is the same as its rotation direction while the covering assembly 20 is being expanded, and therefore the cord reel 311 has to overcome the motivating force provided by the torsion spring 3123 of the actuating device 312 to further release the transmission cord 313. Once the transmission cord 313 is released, the movable seat assembly 33 connected thereto would have more room to move, and therefore the first cord 321 and the second cord 322 of the lift cord assembly 32 could be, with the effect of the weight of the covering assembly 20 and through the moving of the movable seat assembly 33, further released synchronously by a same and predetermined length. At this time, since the lift cord assembly 32 has been further released by the predetermined length, the bottom rail 22 is no longer restricted by the length of the lift cord assembly 32, and therefore could be further shifted and tilted from the position shown in FIG. 7 to a position which has a second angle θ2 relative to the initial position of the bottom rail 22 shown in FIG. 5, wherein the second angle θ2 is greater than the first angle θ1. Now, the side of the bottom rail 22 near the first cord 321 is lower than the other side thereof near the second cord 322, and therefore the first cord 321 would be tightly drawn by the weight of the bottom rail, but the second cord 322 would not. Consequently, a tension of the first cord 321 would be slightly greater than a tension of the second cord 322. When the bottom rail 22 is tilted to the second angle θ2, a segment of the warps 421 of each of the ladder tapes 42 near the bottom rail 22 would naturally approach each other, and therefore the slats 21 near the bottom rail 22 would not be restricted by the bottom rail 22 anymore. Thus, these slats 21 could be correspondingly turned again along with the relative vertical movement and the approaching movement between the warps 421 of each one of the ladder tapes 42. Furthermore, the slats 21 and the bottom rail 22 would return to the state shown in FIG. 9, in which they are parallel to each other. In other words, the covering assembly 20 would be changed into the first state from the aforementioned second state. In this way, the window blind 1 could, therefore, provide an excellent light-blocking effect. It has to be noted that the predetermined length could be adjusted as required. However, the predetermined length has to be at least sufficient to allow the bottom rail 22 to further tilt from the first angle θ1 to the second angle θ2, whereby the rotation angles of the slats 21 and the bottom rail 22 of the covering assembly 20 won't be hindered by the length of the lift cord assembly 32, and therefore an excellent light-blocking effect could be achieved.

Also, it is worth mentioning that, in the current embodiment, the first engaging portion 5112 and the second engaging portion 5122 of the timing transmission mechanism 51 are complementary and continuous teeth profiles (i.e., ratchets). In a situation that the bottom rail 22 is positioned at a location that the covering assembly 20 is not fully expanded, and the tilt mechanism 40 is operated to the extent that the auxiliary unit A starts to work (i.e., after the first engaging portion 5112 of the first sleeve 511 and the second engaging portion 5122 of the second sleeve 512 mesh with each other), if the bottom rail 22 is being pulled downward, the complementary ratchet structures between the first engaging portion 5112 and the second engaging portion 5122 would force the first sleeve 511 to withstand the pushing force provided by the restoring member and to slightly move in a direction away from the second sleeve 512, which ensures that the second sleeve 512 would be still rotatable relative to the first sleeve 511, and the lifting mechanism 30 could be not restricted by the timing transmission mechanism 51 of the auxiliary unit A which is already operated, so that the lifting mechanism 30 could still correspondingly release the lift cord assembly 32 as the bottom rail 22 is being pulled downward. In this way, the covering assembly 20 could be still expanded as normal even after the auxiliary unit A has been operated.

An auxiliary unit A of a second embodiment of the present invention is shown in FIG. 11 to FIG. 14*c*. In the current embodiment, the headrail 10, the covering assembly 20, the lifting mechanism 30, and the tilt mechanism 40 of the window blind 1 are basically the same with those in the previous embodiment, and therefore we are not going to describe these components in detail herein. The current embodiment discloses another implementation of the first sleeve and the restoring member of the auxiliary unit A, as shown in FIG. 12*a* and FIG. 12*b*. In the current embodiment, an outline of an inner surface of a first sleeve body 5210 of a first sleeve 521 of a timing transmission mechanism 52 is a hexagon substantially similar to the outline of the modulation shaft 411. However, the first sleeve 521 does not tightly fit around the modulation shaft 411, so that the first sleeve 521 can be synchronously rotated along with the modulation shaft 411 and is able to slide relative the modulation shaft 411. A limiting portion 5211 formed by surrounding an outer surface of the first sleeve body 5210 only has one protrusion 5211*a* protruding in an axial direction, wherein the protrusion 5211*a* is substantially wedge-shaped, and is also provided in a direction facing the abutting portion 5201 of the housing 520. Another surface of the limiting portion 5211 opposite to the protrusion 5211*a* directly abuts against an end of the restoring member. Furthermore, in the current embodiment, the restoring member includes an elastic member 523 fitting around the modulation shaft 411, wherein an end of the elastic member 523 is fixedly provided at the housing 520, while another end thereof abuts against the limiting portion 5211, whereby to keep providing a pushing force, which is in a direction toward a second sleeve 522, to the limiting portion 5211. The second sleeve 522, as in the previous embodiment, includes a hollow second sleeve body 5220, a toothed ring 5221, and a second engaging portion 5222, wherein the second sleeve body 5220 can be freely rotated relative to the modulation shaft 411. In addition, there is a driven member provided corresponding to the second sleeve 522. Said driven member includes a toothed structure 62 provided on the cord reel 311 of the driving module 31. Said toothed structure 62 is provided corresponding to the toothed ring 5221 of the second sleeve 522, and always meshes with the toothed ring 5221.

The operation and effect of the auxiliary unit A of the window blind 1 of the current embodiment at different stages are explained below. The housing 520 in FIG. 13*a* to FIG. 14*c* is shown transparently, and the parts of the housing 520 which are required to be depicted are expressed in dotted lines, whereby the position change and the collaboration of the first sleeve 521 and the second sleeve 522 in the housing 520 can be clearly illustrated. When the covering assembly 20 is in the first state shown in FIG. 5, the protrusion 5211*a* abuts against the abutting portion 5201 of the housing 520. At this time, the first sleeve 521 and the second sleeve 522 are not engaged with each other yet. The slats 21 and the bottom rail 22 of the covering assembly 20 are maintained in a manner that they are substantially parallel to each other due to the support of the ladder tapes 42. By maneuvering the tilt mechanism 40, the modulation shaft 411 would drive the tilt members 412 and the ladder tapes 42 suspended thereon to operate continuously, whereby to make the covering assembly 20 get into the second state shown in FIG. 7.

At this time, the modulation shaft 411 has been rotated, and therefore the first sleeve 521 has been rotated synchronously as well. During the process, the protrusion 5211*a* on the limiting portion 5211 is also brought to move along the outline of the abutting portion 5201 of the housing 520. When the protrusion 5211*a* is moved to a position corresponding to the notch 5201*a*, the limiting portion 5211 would be urged by the pushing force of the elastic member 523 to move toward the notch 5201*a*, and therefore the protrusion 5211*a* would get into the notch 5201*a*. By further rotating the modulation shaft 411, the protrusion 5211*a* would be completely separated from the abutting portion 5201 at where the notch 5201*a* is. As a result, the first sleeve 521 slides toward the second sleeve 522, so that the first engaging portion 5212 and the second engaging portion 5222 are engaged with each other. At this time, by continuously maneuvering the tilt mechanism 40 in the same direction, the second sleeve 522 could be synchronously rotated with the modulation shaft 411 along with the first sleeve 521. Meanwhile, through the meshing between the toothed ring 5221 and the toothed structure 62 of the driven member, the rotation of the second sleeve 522 could drive the cord reel 311 to further rotate. As in the previous embodiment, to further release the transmission cord 313, the cord reel 311 has to overcome the motivating force provided by the torsion spring 3123 of the actuating device 312 while rotating, whereby the transmission cord 313 could be further released. While the transmission cord 313 is being released, the lift cord assembly 32 is released by a predetermined length through the movement of the movable seat assembly 33, whereby the bottom rail 22 would be no longer affected by the lift cord assembly 32, and could be further tilted to the position of the second angle θ2 shown in FIG. 9. The slats 21 near the bottom rail 22 would not be restricted by the bottom rail 22 anymore, either. Thus, these slats 21 could be correspondingly turned again along with the relative vertical movement and the approaching movement between the warps 421 of each one of the ladder tapes 42. The covering assembly 20 would be therefore changed from the aforementioned second state, in which part of the slats 21 and the bottom rail 22 are not parallel to each other, into the first state, in which all slats 21 and the bottom rail 22 are mutually parallel.

An auxiliary unit A of a third embodiment of the present invention is shown in FIG. 15 to FIG. 18. In the current embodiment, the headrail 10, the covering assembly 20, the lifting mechanism 30, and the tilt mechanism 40 of the window blind 1 are basically the same with those in the previous embodiments, and therefore we are not going to describe these components in detail herein. The current embodiment discloses another implementation of the first sleeve of the timing transmission mechanism in the auxiliary unit A. Compared to the timing transmission mechanism of the previous embodiment, the first sleeve 531 of the timing transmission mechanism 53 in the current embodiment is additionally provided with a delay mechanism to further optimize the operation of the timing transmission mechanism 53. Depending on different rotation strokes of the tilt members 412, the timing transmission mechanism 53 may have a problem of early operation; the delay mechanism could be used to precisely modulate the timing for the operation of the timing transmission mechanism 53 in the auxiliary unit A.

Figure 17:
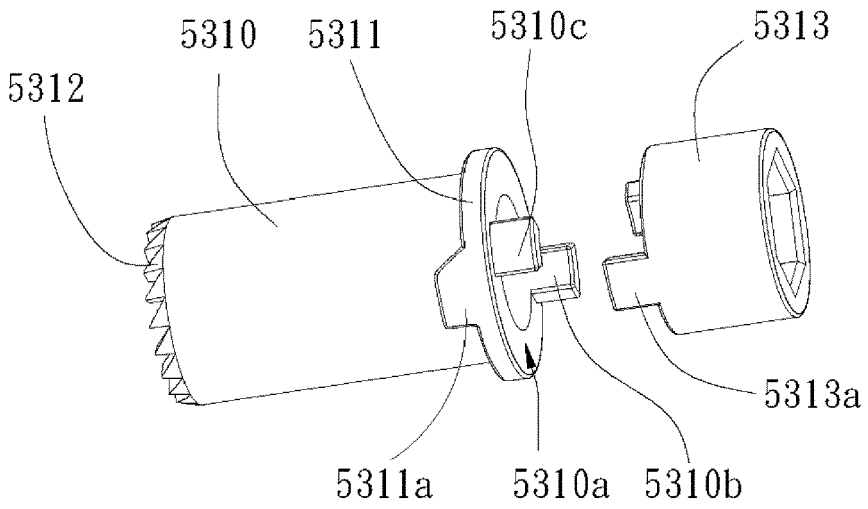
FIG. 17 is an enlarged view of the first sleeve of the auxiliary unit shown in FIG. 16.
Figure 18:
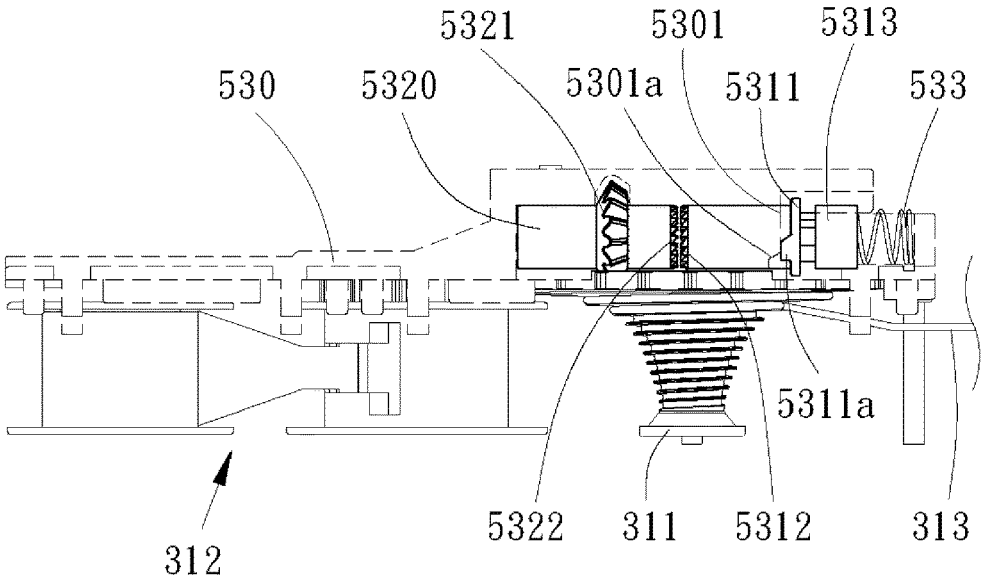
FIG. 18 is a side view of the auxiliary unit and the driving module shown in FIG. 15, with part of the casing omitted.

Herein we further describe the details of the timing transmission mechanism 53. In the current embodiment, the first sleeve 531 of the timing transmission mechanism 53 includes, as shown in FIG. 17, a hollow first sleeve body 5310, a limiting portion 5311, a first engaging portion 5312, and a standalone delay member 5313. An outline of an inner surface of the first sleeve body 5310 is substantially round, and the first sleeve body 5310 does not interfere with the modulation shaft 411, so that the first sleeve body 5310 can be freely rotated relative to the modulation shaft 411 and moved in a reciprocating manner along the modulation shaft 411. Furthermore, the limiting portion 5311 and the first engaging portion 5312 are correspondingly provided at two opposite sides of the first sleeve body 5310. A limiting portion 5311 formed by surrounding an outer surface of the first sleeve body 5310 only has one protrusion 5311*a* protruding in an axial direction, wherein the protrusion 5311*a* is substantially wedge-shaped, and is also provided in a direction facing the abutting portion 5301 of the housing 530. The delay member 5313 is a hollow ring fitting around the modulation shaft 411, wherein an outline of an inner surface of the delay member 5313 is a hexagon substantially similar to the outline of the modulation shaft 411. However, the delay member 5313 does not tightly fit around the modulation shaft 411, so that the delay member 5313 can be synchronously rotated along with the modulation shaft 411, and can reciprocate along the modulation shaft 411. The delay member 5313 has at least a protruding part 5313*a* protruding from a surface thereof facing the first sleeve body 5310, and the first sleeve body 5310 has a path 5310*a* on a surface thereof facing the delay member 5313, wherein the protruding part 5313*a* protrudes into the space between two ends 5310*b*, 5310*c* of the path 5310*a*, and is able to reciprocate between the ends 5310*b*, 5310*c* of the path 5310*a* when the delay member 5313 is driven. The modulation shaft 411 would not be able to drive the first sleeve body 5310 to rotate along with its rotation until the protruding part 5313*a* of the delay member 5313 arrives at and contacts the end 5310*b* or the end 5310*c* of the path 5310*a*. With the above-mentioned collaboration between the path 5310*a* and the protruding part 5313*a*, the first sleeve body 5310 could be belatedly driven, whereby the timing for the operation of the timing transmission mechanism 53 could be precisely modulated. It should be noted that, in the current embodiment, the path 5310*a* is located on a side surface of the first sleeve body 5310, and the ends 5310*b*, 5310*c* of the path 5310*a* are protrusions protruding from the side surface of the first sleeve body 5310. However, this is not a limitation of the present invention; said path could be in the form of a groove or a gap in other embodiments, wherein two opposite ends of a groove or a gap are the ends of the path. Any structures that could provide equivalent effects should be considered as equivalents of the path disclosed in the current embodiment.

In addition, the timing transmission mechanism 53, as in the previous embodiment, further includes a second sleeve 532 and a restoring member. Said second sleeve 532 includes a hollow second sleeve body 5320, a toothed ring 5321, and a second engaging portion 5322, wherein the second sleeve body 5320 can be freely rotated relative to the modulation shaft 411. The restoring member and the delay member 5313 are provided correspondingly. Said restoring member includes an elastic member 533 fitting around the modulation shaft 411, wherein the elastic member 533 could keep providing a pushing force, which is in a direction toward the first sleeve body 5310, to the delay member 5313. A driven member is provided corresponding to the second sleeve 532, wherein said driven member includes a toothed structure 63 provided on the cord reel 311 of the driving module 31. Said toothed structure 63 is provided corresponding to the toothed ring 5321 of the second sleeve 532, and always meshes with the toothed ring 5321.

When the covering assembly 20 is in the first state shown in FIG. 5, the protrusion 5311*a* abuts against the abutting portion 5301 of the housing 530. At this time, the first sleeve 531 and the second sleeve 532 are not engaged with each other yet. The slats 21 and the bottom rail 22 of the covering assembly 20 are maintained in a manner that they are substantially parallel to each other due to the support of the ladder tapes 42. Herein we adjust the slats 21 to a light-blocking angle that the front side is lower than the rear side as an example. By further maneuvering the tilt mechanism 40, the modulation shaft 411 would drive the tilt members 412 and the ladder tapes 42 suspended thereon to operate continuously, whereby to create a relative vertical movement that the warps 421 on the front side go downward and the warps 421 on the rear side go upward, and the warps 421 of each of the ladder tapes 42 would approach each other, so that the slats 21 would be gradually adjusted to an angle that the front side is lower than the rear side. In the end, the covering assembly 20 would be in the second state shown in FIG. 7. At this time, the bottom rail 22 can be only moved and tilted to a position having a first angle θ1 relative to the initial position of the bottom rail 22 shown in FIG. 5. Therefore, the bottom rail 22 and some of the slats 21 near the bottom rail 22 are not parallel to each other, unlike those slats 21 which are farther from the bottom rail 22 and are closed by overlapping each other.

During the process that the covering assembly 20 turns from the first state to the second state, regarding the timing transmission mechanism 53, it is the delay member 5313 that is first driven to rotate by the modulation shaft 411. At this time, the first sleeve body 5310 is not driven by the modulation shaft 411. In other words, the delay member 5313 would rotate independently of the first sleeve body 5310. The rotation of the delay member 5313 would move its protruding part 5313*a* along the path 5310*a*. After the delay member 5313 individually rotates by a certain angle, its protruding part 5313*a* would abut against the end 5310*b*. At this time, the continuous driving of the modulation shaft 411 which rotates the delay member 5313 would start to indirectly drive the first sleeve body 5310 to rotate.

After that, as in the previous embodiment, the first sleeve 531 could be synchronously rotated by rotating the modulation shaft 411 in the same direction. The protrusion 5311*a* of the limiting portion 5311 would be also brought to move along the outline of the abutting portion 5301 of the housing 530. When the protrusion 5311*a* is moved to where the notch 5301*a* is, the limiting portion 5311 would be moved toward the notch 5301*a* by the pushing force of the elastic member 533, and therefore the protrusion 5311*a* would go into the notch 5301*a*. By further rotating the modulation shaft 411, the protrusion 5311*a* would be completely separated from the abutting portion 5301 at where the notch 5301*a* is. As a result, the first sleeve 531 slides toward the second sleeve 532, so that the first engaging portion 5312 and the second engaging portion 5322 are engaged with each other, whereby the second sleeve 532 could be synchronously rotated with the modulation shaft 411 along with the first sleeve 531. Through the meshing between the toothed ring 5321 and the toothed structure 63 of the driven member, the rotation of the second sleeve 532 could drive the cord reel 311 to further rotate. Meanwhile, the cord reel 311 has to overcome the motivating force provided by the torsion spring 3123 of the actuating device 312 while rotating, whereby the transmission cord 313 could be further released. While the transmission cord 313 is being released, the lift cord assembly 32 is released by a predetermined length through the movement of the movable seat assembly 33, whereby the bottom rail 22 would be no longer affected by the lift cord assembly 32, and could be further tilted from the initial position shown in FIG. 5 to the position of the second angle θ2 shown in FIG. 9. The slats 21 near the bottom rail 22 would not be restricted by the bottom rail 22 anymore, either. Thus, these slats 21 could be correspondingly turned again along with the relative vertical movement and the approaching movement between the warps 421 of each one of the ladder tapes 42. The covering assembly 20 would be therefore changed from the aforementioned second state, in which part of the slats 21 and the bottom rail 22 are not parallel to each other, into the first state, in which all slats 21 and the bottom rail 22 are mutually parallel.

Figure 19:
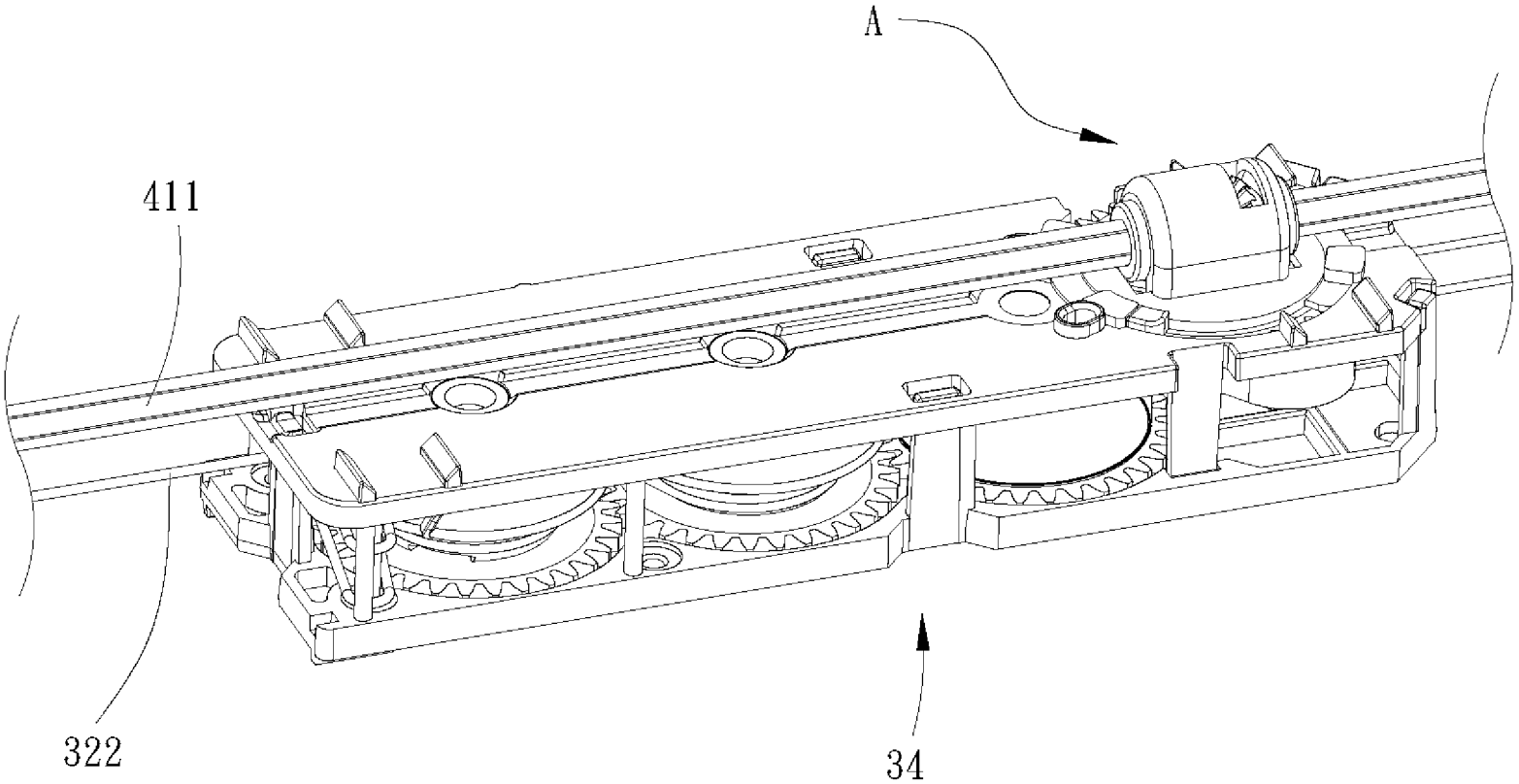
FIG. 19 is a perspective view of the auxiliary unit of a fourth embodiment provided in the window blind of the present invention; the driving module working with the auxiliary unit is also shown therein.
Figure 20:
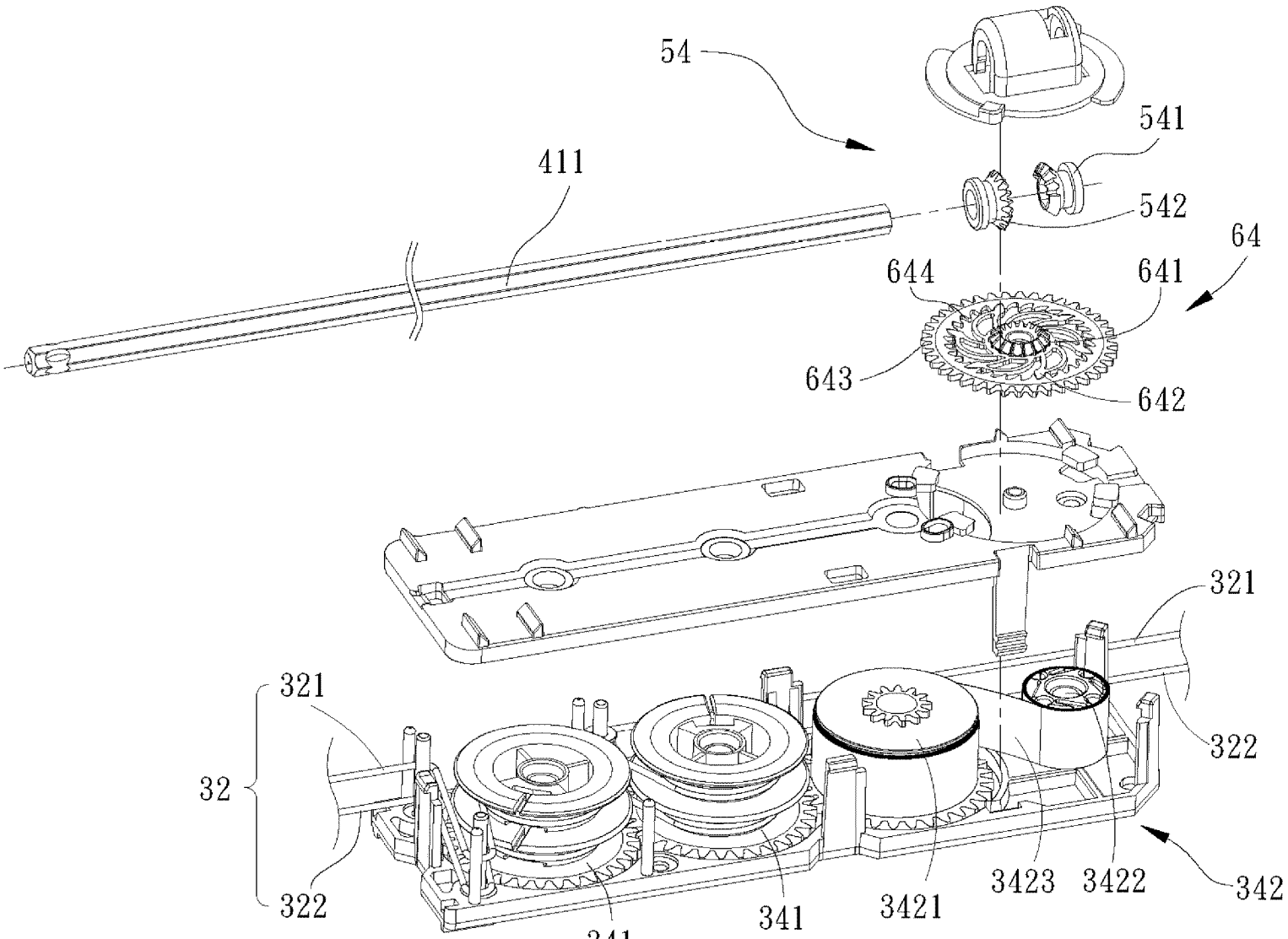
FIG. 20 is an exploded view of the auxiliary unit and the driving module shown in FIG. 19.

An auxiliary unit A of a fourth embodiment of the present invention is shown in FIG. 19 to FIG. 21*c*. In the current embodiment, the headrail 10, the covering assembly 20, and the tilt mechanism 40 of the window blind 1 are basically the same with those in the previous embodiment, and therefore we are not going to describe these components in detail herein. It has to be noted that, in the current embodiment, the lifting mechanism 30 is not the same as the lifting mechanisms described in the previous embodiments. As shown in FIG. 19, 20, the lifting mechanism 30 includes a lift cord assembly 32 and a driving module 34, wherein the driving module 34 includes two cord reels 341 and an actuating device 342, wherein each of the cord reels 341 is divided into two segments in a vertical direction. The actuating device 342 includes a driving drum 3421, a spring-receiving drum 3422, and a torsion spring 3423. As in the previous embodiments, two free ends of the torsion spring 3423 are respectively connected to the driving drum 3421 and the spring-receiving drum 3422. Furthermore, in an initial state, the torsion spring 3423 winds around the spring-receiving drum 3422. Each of the cord reels 341 respectively has a gear, and the driving drum 3421 also has a gear meshing with the gear of one of the cord reels 341, whereby to transmit the elastic force provided by the torsion spring 3423 to the cord reels 341, providing a driving effect. The lift cord assembly 32 has two pairs of a first and a second cords 321, 322. An end of each pair of the first and second cords 321, 322 is respectively connected to one of the cord reels 341, whereby the first and second cords 321, 322 are respectively wound around the corresponding cord reel 341; another end of each pair of the first and second cords 321, 322 is connected to the bottom rail 22. In other words, the actuating device 342 drives each of the pairs of the first and second cords 321, 322 through one of the cord reels 341 respectively, whereby to control the rising and lowering of the bottom rail 22. However, understandably, the lift cord assembly 32 of the lifting mechanism 30 could be driven either directly by the cord reels 341, as disclosed in the current embodiment, or indirectly through the cord reel 311, the transmission cord 313, and the movable seat assembly 33 of the driving module 31, as described in the previous embodiments. The different implementations of the lifting mechanism described in the present invention are merely for example purposes and do not affect the effect and working principles of the auxiliary unit A provided in the present invention.

The current embodiment further discloses alternative implementations of the timing transmission mechanism and the driven member of the auxiliary unit A. In the current embodiment, the timing transmission mechanism 54 includes an incomplete gear 541 fitting around the modulation shaft 411, wherein an outline of an inner surface of the incomplete gear 541 is a hexagon substantially similar to the outline of the modulation shaft 411, and the incomplete gear 541 tightly fits around the modulation shaft 411, so that the incomplete gear 541 could be synchronously rotated along with the modulation shaft 411. Understandably, the incomplete gear 541 is a gear having a toothed segment 541*a* and a non-toothed segment. The driven member includes a toothed structure 64 provided on a top of the actuating device 342, and said toothed structure 64 includes a bevel teeth portion 641 in the center thereof, a slightly elastic ratchet teeth portion 642 spread outward from the bevel teeth portion 641, an outer toothed ring 643 concentric with the bevel teeth portion 641, and an inner toothed ring 644 which is concentric with the bevel teeth portion 641, surrounded by the outer toothed ring 643, and meshes with the ratchet teeth portion 642. The bevel teeth portion 641 and the ratchet teeth portion 642 are integrally made, and the outer toothed ring 643 and the inner toothed ring 644 are also integrally made. Furthermore, the component made up of the bevel teeth portion 641 and the ratchet teeth portion 642 is surrounded by the component made up of the outer toothed ring 643 and the inner toothed ring 644. The outer toothed ring 643 always meshes with the gear of the driving drum 3421, and therefore moves synchronously with the driving drum 3421. The ratchet teeth portion 642 meshes with the inner toothed ring 644, so that the component made up of the bevel teeth portion 641 and the ratchet teeth portion 642 could rotate relative to the component made up of the outer toothed ring 643 and the inner toothed ring 644 in only one direction, and could synchronously rotate in an opposite direction. In the current embodiment, these components could be arranged in advance in a manner that the toothed segment 541*a* of the incomplete gear 541 could mesh with the bevel teeth portion 641 of the toothed structure 64 of the driven member when the incomplete gear 541 is rotated by a predetermined angle along with the rotation of the modulation shaft 411, whereby the toothed structure 64 could be driven by the modulation shaft 411.

It is worth mentioning that, in the current embodiment, the reason that the toothed structure 64 is divided into two components, one of which is made up of the bevel teeth portion 641 and the ratchet teeth portion 642, and the other one is made up of the outer toothed ring 643 and the inner toothed ring 644, is the same as that of the complementary ratchet structure between the first engaging portion and the second engaging portion disclosed in the previous embodiments. Specifically, the objective of such design is to ensure that, in the situation that the covering assembly 20 has not been fully expanded, but the user has forced the timing transmission mechanism 54 and the driven member to interact with each other by maneuvering the tilt mechanism, and he/she continues to pull down the bottom rail 22, the lifting mechanism 30 could continue releasing the lift cord assembly 32 without being restricted by the timing transmission mechanism 54. In addition, in the current embodiment, the driven member is provided in a manner that meshes with the driving drum 3421; however, this is not a limitation of the present invention. Any gear that could be synchronously moved with each of the components of the lifting mechanism 30 could be the component correspondingly meshing with the driven member, which could also produce the same effect.

The timing transmission mechanism 54 of the current embodiment could further include an auxiliary gear 542 provided corresponding to the incomplete gear 541. Said auxiliary gear 542 also fits around the modulation shaft 411, and always meshes with the bevel teeth portion 641 of the toothed structure 64. An outline of the inner surface of the auxiliary gear 542 is substantially round, and the auxiliary gear 542 does not interfere with the modulation shaft 411, so that the auxiliary gear 542 can be freely rotated relative to the modulation shaft 411, and always provides a pressing force to the toothed structure 64 through the modulation shaft 411. The effect of said auxiliary gear 542 is to prevent a side of the toothed structure 64 away from the incomplete gear 541 from tilting up while the toothed structure 64 of the driven member is rotating, particularly when the toothed segment 541*a* of the incomplete gear 541 meshes with the toothed structure 64, whereby the ratchet teeth portion 642 could be ensured to always mesh with the inner toothed ring 644.

Figure 21A:
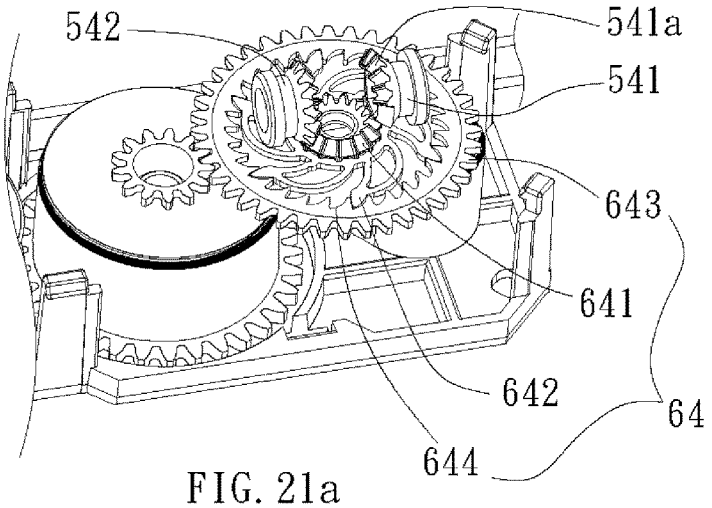
FIG. 21*a* is a perspective view showing the condition of the auxiliary unit and the driving module in the fourth embodiment, with part of the casing omitted, when the covering assembly of the window blind is in the first state as illustrated in FIG. 5.
Figure 21B:
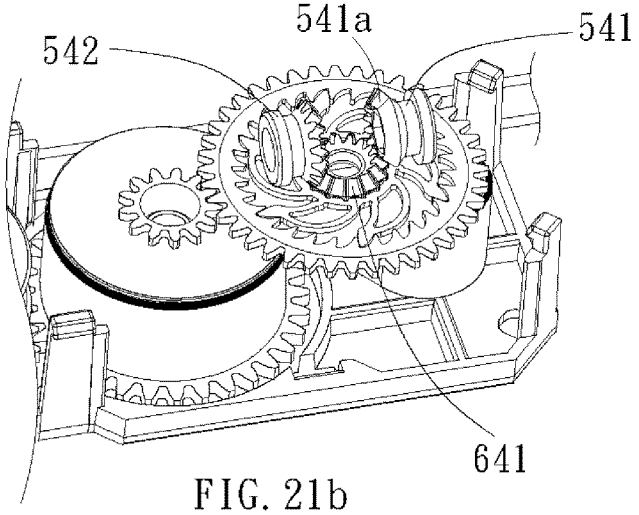
FIG. 21*b* is a perspective view showing the condition of the auxiliary unit and the driving module in the fourth embodiment, with part of the casing omitted, when the covering assembly of the window blind is in the second state as illustrated in FIG. 7.
Figure 21C:
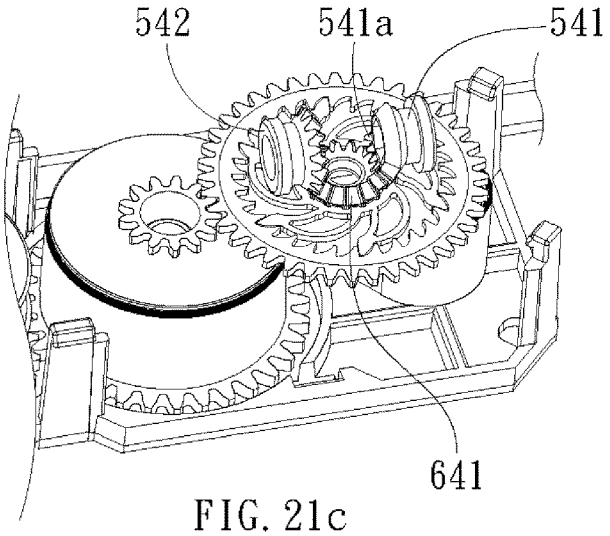
FIG. 21*c* is a perspective view showing the condition of the auxiliary unit and the driving module in the fourth embodiment when the covering assembly of the window blind gradually turns from the second state to the first state as illustrated in FIG. 9, wherein part of the casing is omitted.

The operation and effect of the auxiliary unit A at different stages are explained below. As shown in FIG. 21*a* to FIG. 21*c*, when the covering assembly 20 is in the first state shown in FIG. 5, the toothed segment 541*a* of the incomplete gear 541 does not mesh with the toothed structure 64 yet. If the tilt mechanism 40 is maneuvered to the extent that the covering assembly 20 is in the second state shown in FIG. 7, the bottom rail 22 would be moved and tilted to a position having a first angle θ1 relative to the initial position of the bottom rail 22 shown in FIG. 5. At this time, the toothed segment 541*a* of the incomplete gear 541 would also approach the bevel teeth portion 641 of the toothed structure 64. After that, if the tilt mechanism 40 is further rotated in the same direction when the covering assembly 20 is in the aforementioned second state, the toothed segment 541*a* of the incomplete gear 541 would start to mesh with the bevel teeth portion 641 of the toothed structure 64, whereby the bevel teeth portion 641 could be driven to synchronously rotate the component made up of the outer toothed ring 643 and the inner toothed ring 644. The overall rotation of said toothed structure 64 would overcome the elastic force of the torsion spring 3423 to synchronously drive the actuating device 342 to operate. Meanwhile, the cord reels 341 would be synchronously driven through the gear meshing with the actuating device 342, whereby the first and second cords 321, 322 of the lift cord assembly 32 could be further released correspondingly. As a result, the bottom rail 22 and the slats 21 near the bottom rail 22 would be no longer restricted by the length of the lift cord assembly 32, and the bottom rail 22 could be further shifted and tilted from the position shown in FIG. 7 to a position which has a second angle θ2 relative to the initial position of the bottom rail 22 shown in FIG. 5, wherein the second angle θ2 is greater than the aforementioned first angle θ1. The whole covering assembly 20 would be therefore changed from the aforementioned second state shown in FIG. 7, in which part of the slats 21 and the bottom rail 22 are not mutually parallel, into the first state shown in FIG. 9, in which all slats 21 and the bottom rail 22 are substantially parallel to each other.

Figure 22:
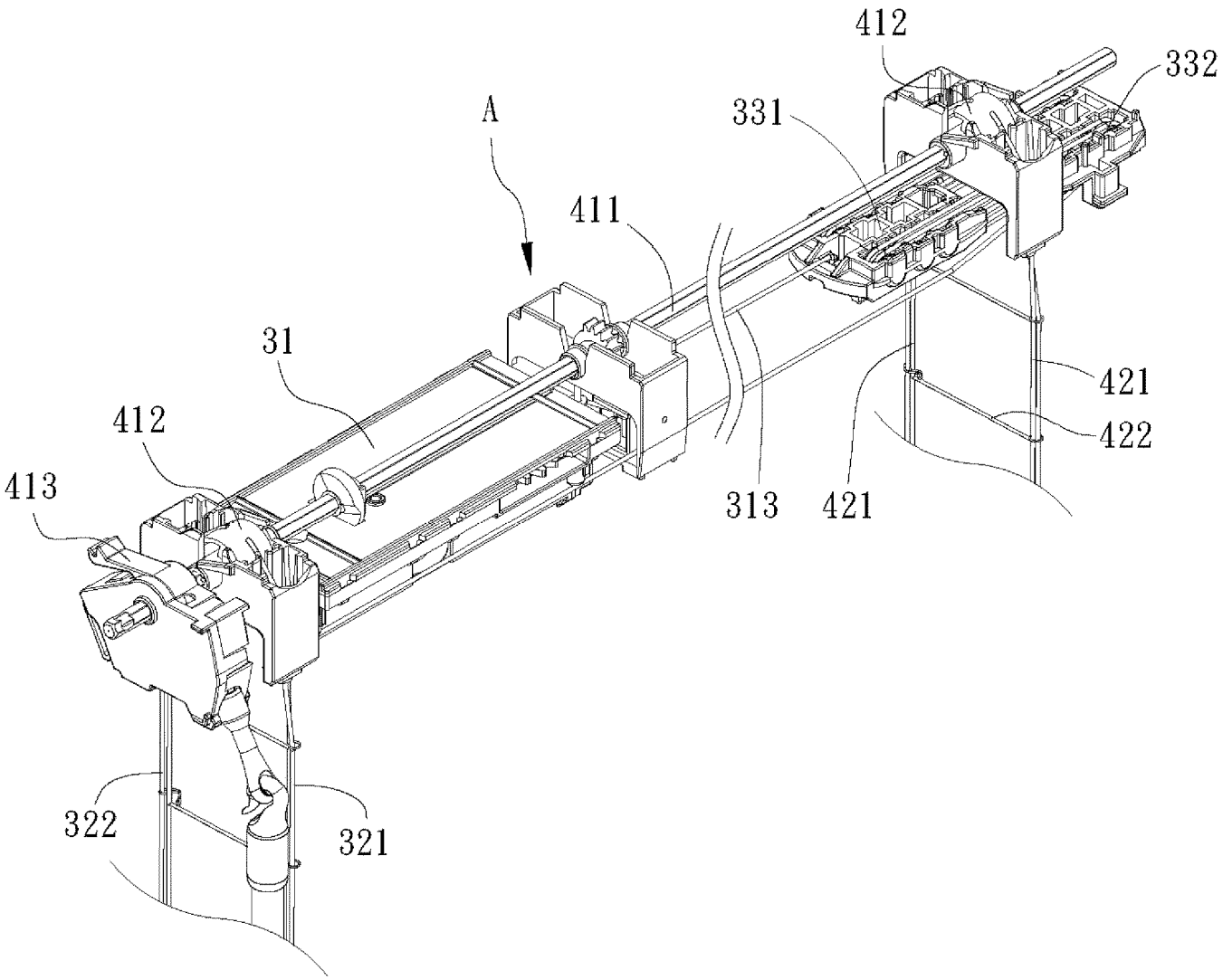
FIG. 22 is a perspective view of the auxiliary unit of a fifth embodiment provided in the window blind of the present invention; other mechanisms in the headrail are also shown therein.
Figure 23A:
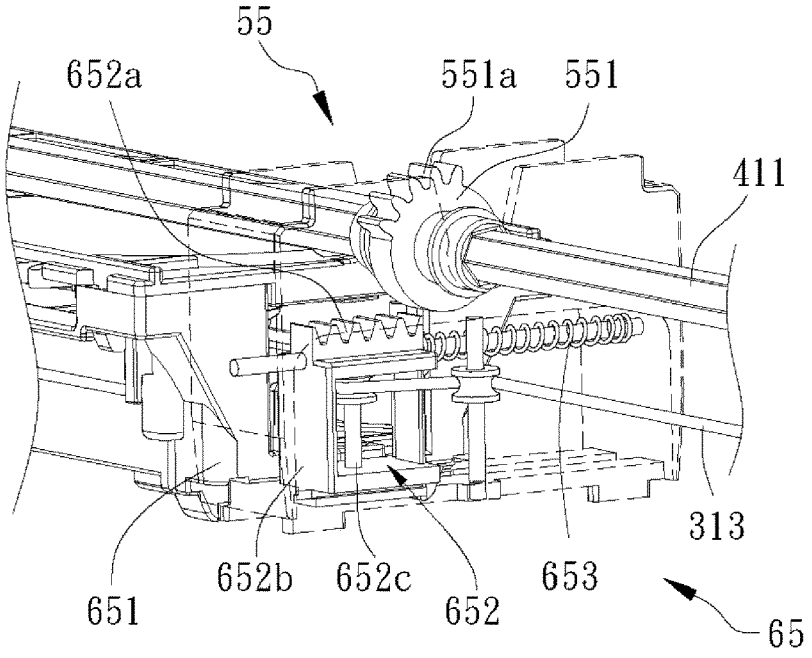
FIG. 23*a* is a perspective view of the auxiliary unit in the fifth embodiment when the covering assembly of the window blind is in the first state as illustrated in FIG. 5.
Figure 23B:
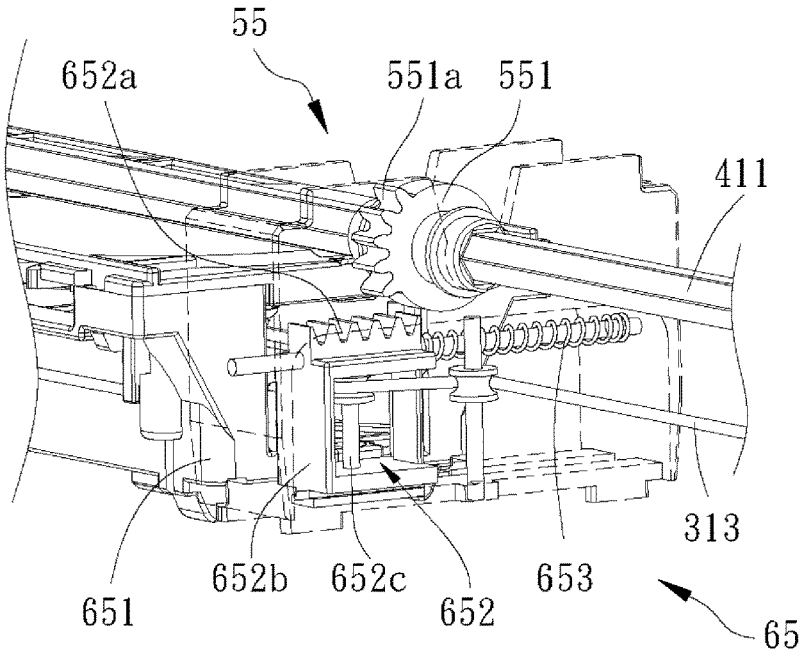
FIG. 23*b* is a perspective view of the auxiliary unit in the fifth embodiment when the covering assembly of the window blind is in the second state as illustrated in FIG. 7.
Figure 23C:
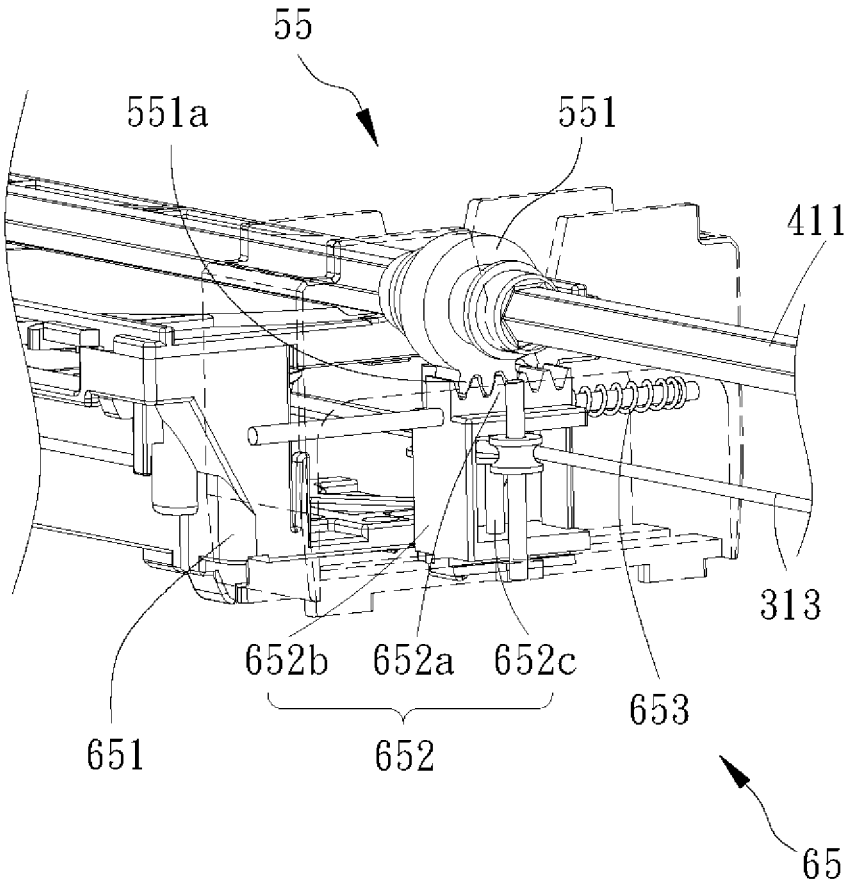
FIG. 23*c* is a perspective view showing the condition of the auxiliary unit in the fifth embodiment when the covering assembly of the window blind gradually turns from the second state to the first state as illustrated in FIG. 9.

An auxiliary unit A of a fifth embodiment of the present invention is shown in FIG. 22 to FIG. 23*c*. In the current embodiment, the headrail 10, the covering assembly 20, the lifting mechanism 30, and the tilt mechanism 40 of the window blind 1 are basically the same with those in the first to the third embodiments, and therefore we are not going to describe these components in detail herein. The current embodiment discloses alternative implementations of the timing transmission mechanism and the driven member in the auxiliary unit A. In the current embodiment, the timing transmission mechanism 55 includes an incomplete gear 551 fitting around the modulation shaft 411, wherein the incomplete gear 551 can be synchronously rotated along with the modulation shaft 411, and has a toothed segment 551*a* and a non-toothed segment. The driven member includes an interference device 65 provided between the driving module 31 and the movable seat assembly 33. Specifically, the interference device 65 is located on a side out of the driving module 31 and near the cord reel 311. The interference device 65 includes a base 651, an interference member 652, and an elastic member 653, wherein the base 651 is a hollow frame fixedly provided in the headrail 10, and the interference member 652 is provided on the base 651 in a manner that it is able to slide relative to the base 651. Furthermore, the interference member 652 includes a toothed structure 652*a*, a main body 652*b*, and a cord-winding shaft 652*c*, wherein the main body 652*b* is a frame having openings on two ends thereof. At least part of the main body 652*b* is lower than the modulation shaft 411. The cord-winding shaft 652*c* is provided in the hollow main body 652*b*. The toothed structure 652*a* is located at an upper end of the main body 652*b*, and corresponds to the incomplete gear 551. The transmission cord 313 winds around the cord reel 311, passes through the hollow main body 652*b*, bypasses the cord-winding shaft 652*c*, and is connected to the movable seat 331 of the movable seat assembly 33. Two ends of the elastic member 653 respectively abut against the base 651 and the interference member 652, wherein the elastic member 653 presses the interference member 652 in an initial state, so that the interference member 652 is urged to be placed on a side of the base 651. It has to be noted that, the base 651 is provided in the purpose of installing the driven member in a modularized manner; however, this is not a limitation of the present invention. The same effect could be also achieved in the circumstance that the base is in the form of a main body of the headrail 10, and directly providing each component of the interference member 652 in the headrail 10.

The operation and effect of the auxiliary unit A in the current embodiment at different stages are explained below. As shown in FIG. 5 and FIG. 23*a*, when the covering assembly 20 is in the first state, the toothed segment 551*a* of the incomplete gear 551 does not mesh with the toothed structure 652*a* of the interference member 652 yet. At this time, the interference member 652 is still placed on the side of the base 651, and the transmission cord 313 bypasses the cord-winding shaft 652*c* and therefore is interfered and twisted. In other words, an actual cord length of a segment of the transmission cord 313 from the cord reel 311 to the movable seat 331 is greater than a direct length from the cord reel 311 to the movable seat 311. When the tilt mechanism 40 is maneuvered to the closed state, the bottom rail 22 would be moved and tilted to a position having a first angle θ1 relative to the initial position shown in FIG. 5 due to the restriction imposed on the bottom rail 22 by the fixed length of the lift cord assembly 32. Some slats 21 near the bottom rail 22 are also hindered by the bottom rail 22 from turning correspondingly along with the relative vertical movement between the warps 421 of each one of the ladder tapes 42, so the bottom rail 22 and part of the slats 21 of covering assembly 20 would not be mutually parallel, i.e., the covering assembly 20 would be in the second state shown in FIG. 7 and FIG. 23*b*. At this time, the toothed segment 551*a* of the incomplete gear 551 approaches the toothed structure 652*a* of the interference member 652, but they do not mesh with each other yet. If the tilt mechanism 40 is further rotated in the same direction when the covering assembly 20 is in the aforementioned second state, the toothed segment 551*a* of the incomplete gear 551 would start to mesh with the toothed structure 652*a* on the upper end of the main body 652*b*, and would drive the interference member 652 to resist the elastic force of the elastic member 653 and to start sliding on the base 651. As a result, the interference member 652 would slide from the position on the side of the base 651 toward a center of the base 651, so that the position of the cord-winding shaft 652*c*, the position where the transmission cord 313 leaves the driving module 31, and the position where the transmission cord 313 connected to the movable seat assembly 33 would gradually line up. At this time, the transmission cord 313 bypassing the cord-winding shaft 652*c* would no longer be interfered and twisted, and therefore could further release the originally interfered and twisted segment in the situation that the cord reel 311 no longer rotates. In other words, the actual cord length of the segment of the transmission cord 313 from the cord reel 311 to the movable seat 331 would be substantially equal to the direct length from the cord reel 311 to the movable seat 311. By releasing the transmission cord 313 to further move the movable seat 331, the lift cord assembly 32 could be therefore released by a predetermined length at the same time. In this way, the lift cord assembly 32 would no longer restrict the bottom rail 22, and therefore the bottom rail 22 could be further moved and tilted from the position of the first angle θ1 to another position having a second angle θ2 relative to the initial position of the bottom rail 22 shown in FIG. 5. The slats 21 near the bottom rail 22 would, therefore, be able to correspondingly turn along with the relative vertical movement and the approaching movement of the warps 421, whereby the covering assembly 20 could be changed from the aforementioned second state shown in FIG. 7 to the first state shown in FIG. 9 again. The window blind 1 could, therefore, provide an excellent light-blocking effect.

Figure 24:
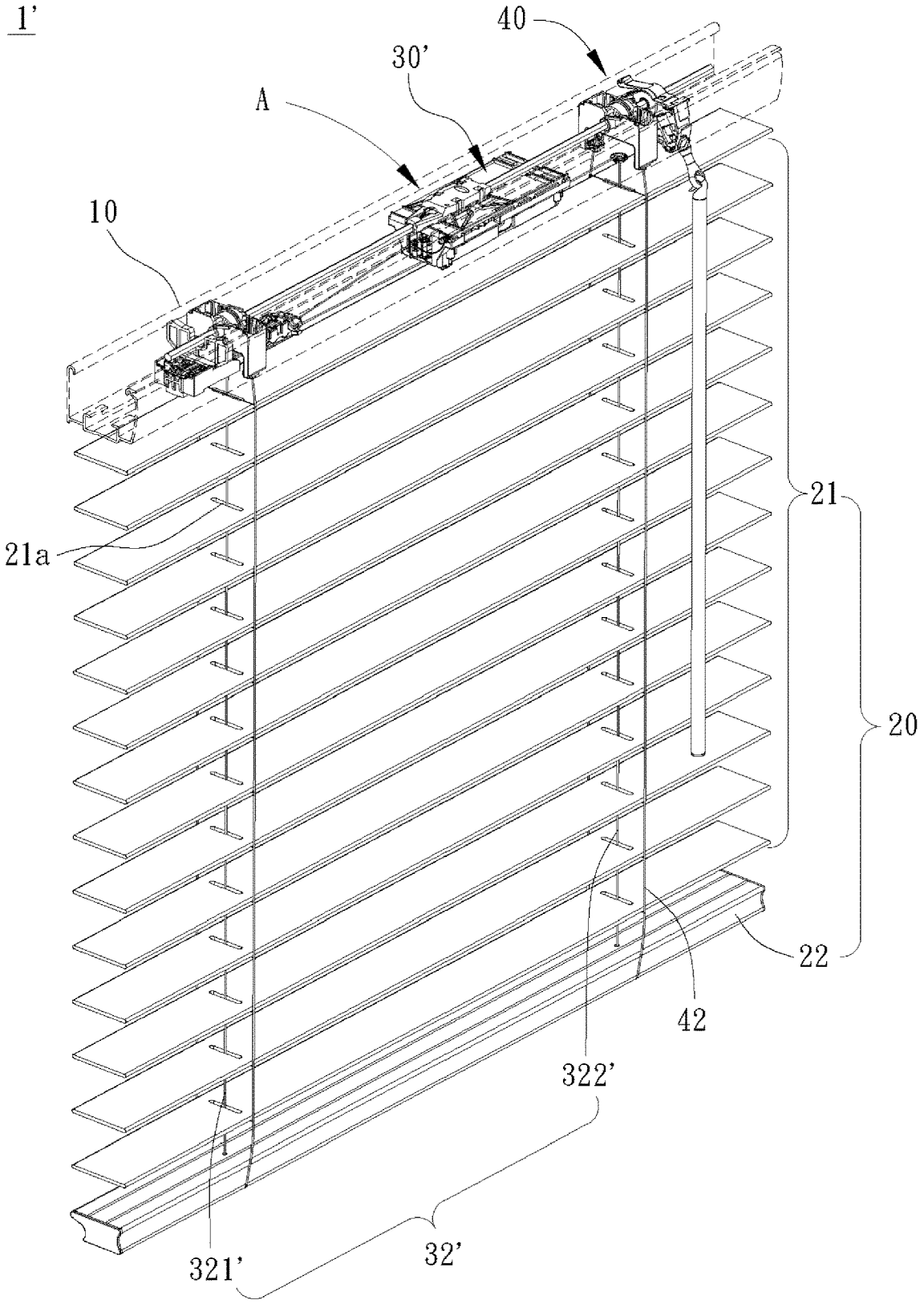
FIG. 24 is a perspective view of an alternative implementation of the window blind provided in the present invention.
Figure 25:
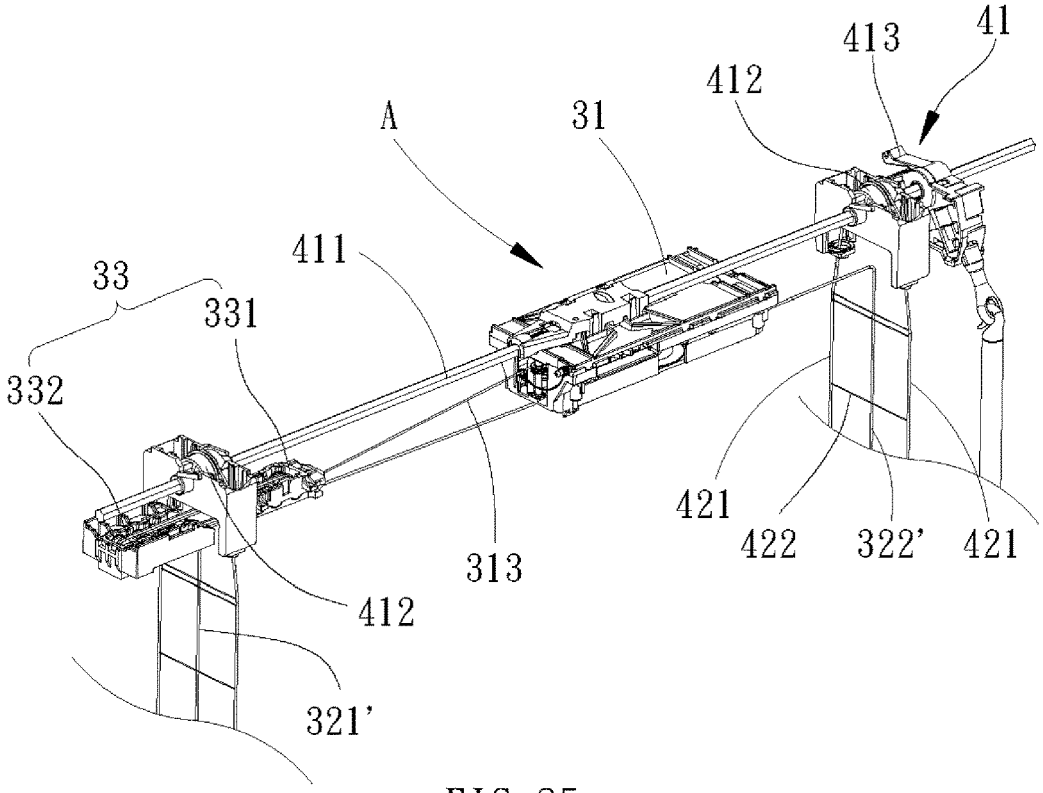
FIG. 25 is a perspective view of the mechanisms in the headrail of FIG. 24.
Figure 26:
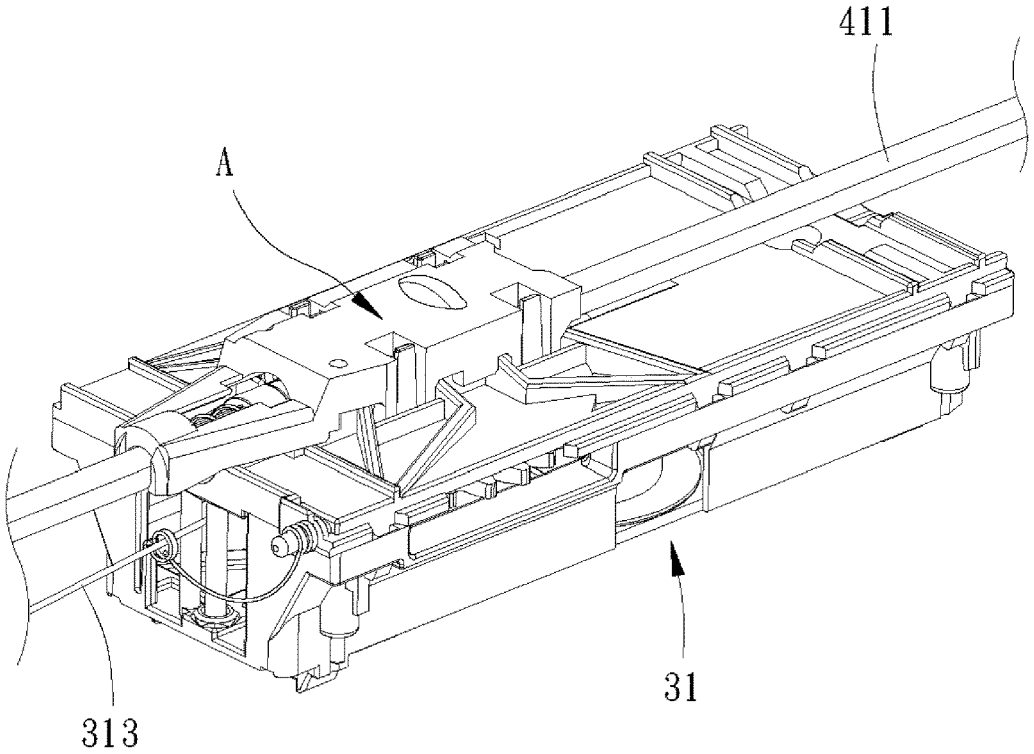
FIG. 26 is a perspective view of the auxiliary unit of a sixth embodiment provided in the alternative implementation of the window blind of the present invention; the driving module working with the auxiliary unit is also shown therein.
Figure 27:
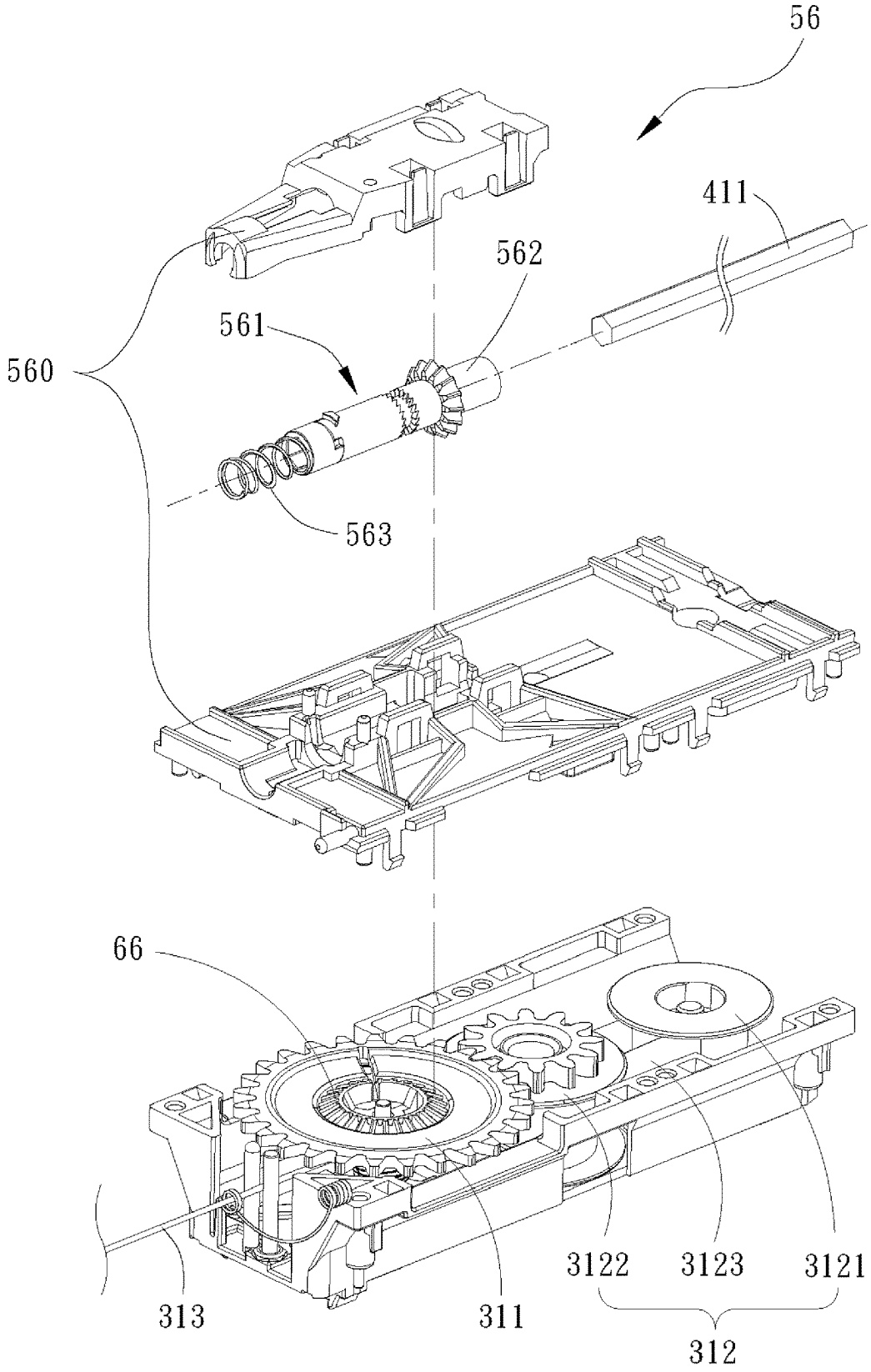
FIG. 27 is an exploded view of the auxiliary unit and the driving module shown in FIG. 26.

In addition to the window blind disclosed in the previous embodiments, which has the first and second cords 321, 322 in the lift cord assembly 32 respectively located on the front and rear side of the slats, an alternative implementation of the window blind provided in the present invention is shown in FIG. 24 to FIG. 34*b*. As shown in FIG. 24, the window blind 1' of the current embodiment includes a headrail 10, a covering assembly 20, a lifting mechanism 30', a tilt mechanism 40, and an auxiliary unit A. With an exception of the lifting mechanism 30', other components are roughly the same with those disclosed in the previous embodiments, and therefore we are not going to describe their details again herein. The lifting mechanism 30' is mainly different from the lifting mechanisms disclosed in the previous embodiments in that, in the lifting mechanism 30', the first and the second cords 321', 322' of the lift cord assembly 32' are arranged at intervals in the longitudinal direction of the headrail 10, and, instead of passing by the front and rear sides of the slats 21, pass through perforations 21*a* located at the center of the slats 21.

Figure 28:
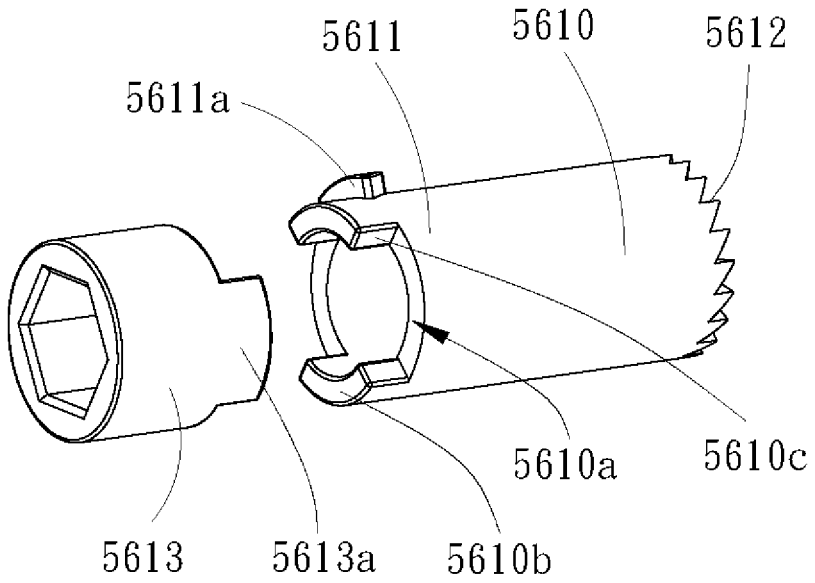
FIG. 28 is an enlarged view of the first sleeve of the auxiliary unit shown in FIG. 27.

An auxiliary unit A in a sixth embodiment of the present invention is explained below. A timing transmission mechanism 56 of the auxiliary unit A includes a housing 560, a first sleeve 561, a second sleeve 562, and a restoring member, wherein the first sleeve 561 includes a hollow first sleeve body 5610, a limiting portion 5611, a first engaging portion 5612, and a standalone delay member 5613, as shown in FIG. 28. An outline of an inner surface of the first sleeve body 5610 is substantially round, and the first sleeve body 5310 does not interfere with the modulation shaft 411, so that the first sleeve body 5610 can be freely rotated relative to the modulation shaft 411 and moved in a reciprocating manner along the modulation shaft 411. The first engaging portion 5612 is located at an end of the first sleeve body 5610, and the limiting portion 5611 has a protrusion 5611*a* protruding in a radial direction of the first sleeve body 5610, wherein the protrusion 5611*a* is substantially wedge-shaped, and the limiting portion 5611 and the first engaging portion 5612 are correspondingly provided at two opposite ends of the first sleeve body 5610. The second sleeve 562 includes a hollow second sleeve body 5620, a toothed ring 5621 fitting around an outer wall of the second sleeve body 5620, and a second engaging portion 5622, which is provided at an end of the second sleeve body 5620 and corresponds to the first engaging portion 5612. Furthermore, the second sleeve body 5620, like the first sleeve body 5610, can be freely rotated relative to the modulation shaft 411 as well.

The delay member 5613 is also a hollow ring fitting around the modulation shaft 411, and corresponds to the first sleeve body 5610. An outline of an inner surface of said delay member 5613 is a hexagon substantially similar to the outline of the modulation shaft 411. However, the delay member 5613 does not tightly fit around the modulation shaft 411, so that the delay member 5613 can be synchronously rotated along with the modulation shaft 411, and can reciprocate along the modulation shaft 411. The restoring member and the delay member 5613 are correspondingly provided, wherein the restoring member includes an elastic member 563 fitting around the modulation shaft 411. An end of said elastic member 563 is fixedly provided at the housing 560, while another end thereof abuts against the delay member 5613, so that the elastic member 563 constantly provides a pushing force in a direction toward the first sleeve body 5610 to the delay member 5613.

At least a protruding part 5613*a* protrudes from an end surface of the delay member 5613 facing the first sleeve body 5610, while the first sleeve body 5610 has a path 5610*a* provided on a side surface thereof facing the delay member 5613. Said path 5610*a* is defined by two ends 5610*b*, 5610*c*. The protruding part 5613*a* protrudes into the space between the ends 5610*b*, 5610*c* of the path 5610*a*, and is able to reciprocate between the ends 5610*b*, 5610*c* of the path 5610*a* when the delay member 5613 is driven. When the protruding part 5613*a* of the delay member 5613 does not contact the end 5610*b* or the end 5610*c* of the path 5610*a*, the delay member 5613 could rotate independently relative to the first sleeve body 5610. Therefore, the rotation of the modulation shaft 411 could only drive the delay member 5613 to rotate at this time, but could not drive the first sleeve body 5610 to rotate. By continuously rotating the modulation shaft 411, the delay member 5613 could be further driven, but the first sleeve body 5610 would not be driven to rotate along with the modulation shaft 411, unless the delay member 5613 is finally rotated to a position that its protruding part 5613*a* contacts the end 5610*b* or the end 5610*c* of the path 5610*a*. With the above-mentioned collaboration between the path 5610*a* and the protruding part 5613*a*, the first sleeve body 5610 could be belatedly driven, whereby the timing for the operation of the timing transmission mechanism 56 could be precisely modulated. It should be noted that, in the current embodiment, the path 5610*a* is located on a side surface of the first sleeve body 5610, and the ends 5610*b*, 5610*c* of the path 5610*a* are protrusions protruding from the side surface of the first sleeve body 5610. However, this is not a limitation of the present invention; said path could be in the form of a groove or a gap in other embodiments, wherein two opposite ends of a groove or a gap are the ends of the path. Any structures that could provide equivalent effects should be considered as equivalents of the path disclosed in the current embodiment.

The driven member of the auxiliary unit A includes a toothed structure 66 provided on the cord reel 311 of the driving module 31. Said toothed structure 66 corresponds to and always meshes with the toothed ring 5621 of the second sleeve 562.

Figure 29:
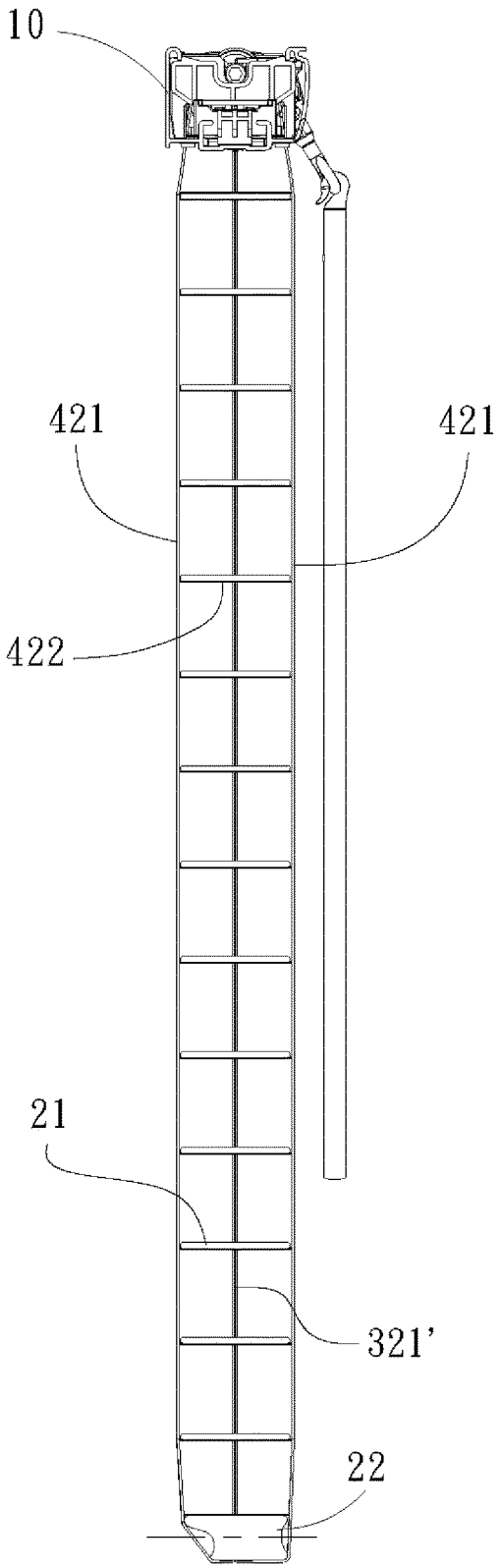
FIG. 29 is a side view of FIG. 24, showing that the covering assembly of the window blind is in the first state, and the bottom rail is located at the initial position.
Figure 30A:
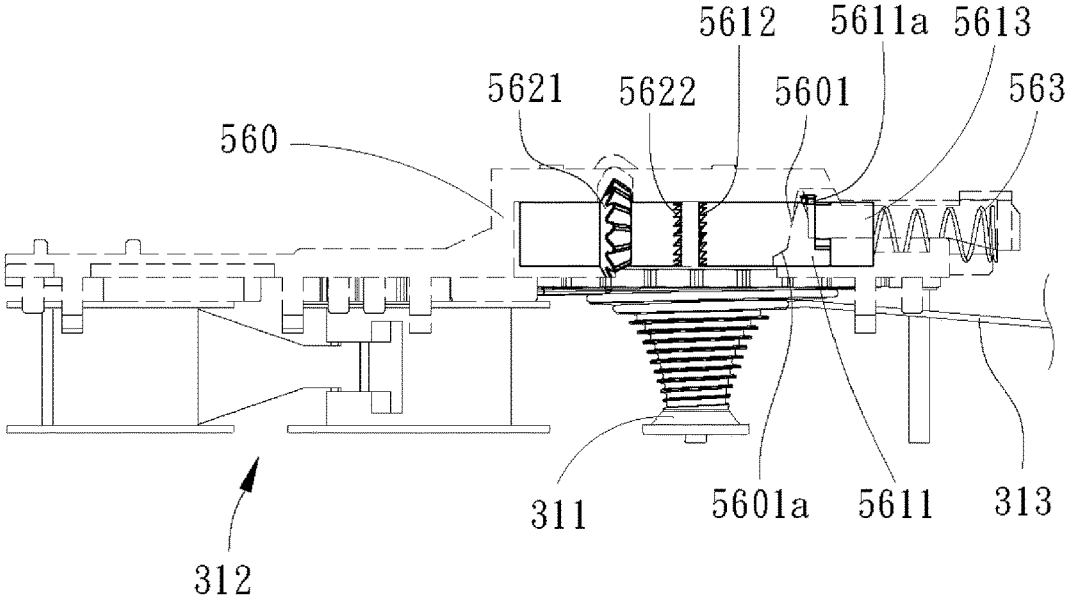
FIG. 30*a* is a side view showing the condition of the auxiliary unit and the driving module in FIG. 29, i.e., when the covering assembly of the window blind is in the first state, with part of the casing omitted.
Figure 30B:
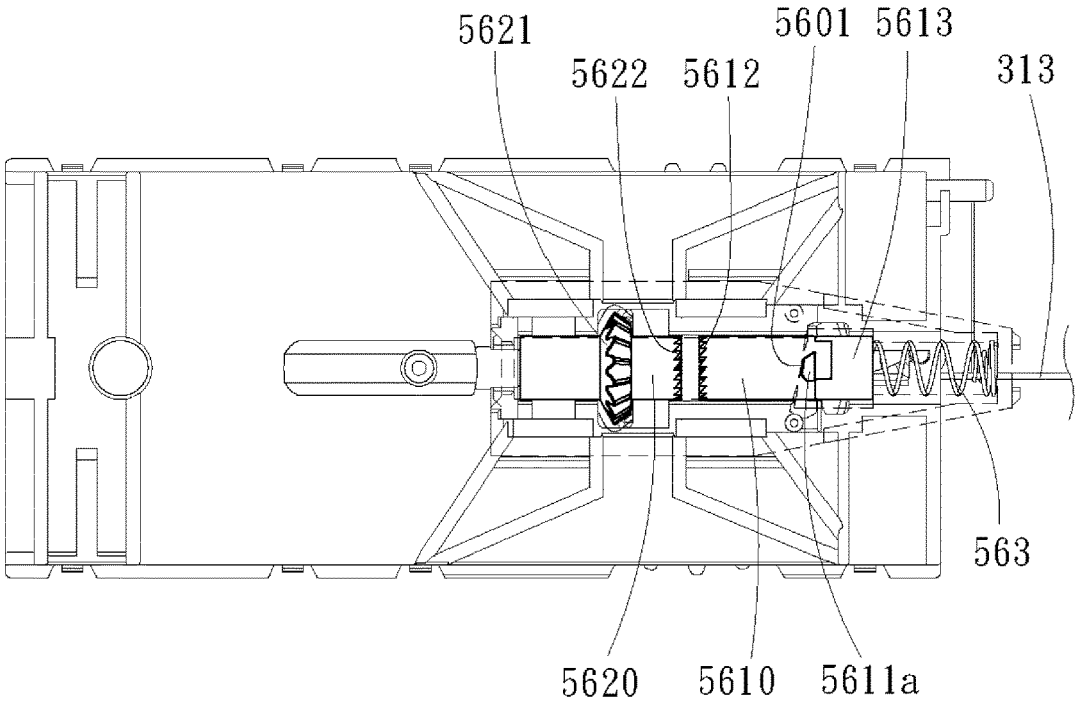
FIG. 30*b* is a top view of the auxiliary unit and the driving module in FIG. 30*a;*

The operation and effect of the auxiliary unit A, which is applied in another implementation of a window blind 1' provided in the present invention, are explained below. As shown in FIG. 29, when the lifting mechanism 30' is maneuvered to fully expand the window blind 1', the bottom rail 22 is moved to the position most distant to the headrail 10, and the slats 21 and the bottom rail 22 of the covering assembly 20 are all substantially horizontal and parallel to each other. The bottom rail 22 is also substantially horizontal in the longitudinal direction, and its current position is defined as an initial position. Meanwhile, the slats 21 are in the open state. In this state, the housing 560 in FIG. 30*a* and FIG. 30*b* is shown transparently, and the parts of the housing 560 which are required to be depicted are expressed in dotted lines, whereby the position change and the collaboration of the first sleeve 561 and the second sleeve 562 in the housing 560 can be clearly illustrated. The protrusion 5611*a* on the limiting portion 5611 of the first sleeve 561 abuts against the abutting portion 5601 of the housing 560, so that the first sleeve 561 and the second sleeve 562 are separated by a distance. At this time, the auxiliary unit A has not operated yet. When the tilt mechanism 40 is operated, the modulation shaft 411 operates to rotate the tilt members 412, and therefore the slats 21 and the bottom rail 22 of the covering assembly 20 are correspondingly turned along with the relative vertical movement and the approaching between the warps 421 of each one of the ladder tapes 42. At this stage, the slats 21 and the bottom rail 22 are still substantially parallel to each other. Herein we define that the covering assembly 20 is in the first state.

After the angle modulation described above, if the tilt mechanism 40 is kept being maneuvered to make the slats 21 turn toward the closed state, the slats 21 of the covering assembly 20 near the headrail 10 will be correspondingly turned in response to the relative vertical movement and the approaching movement created between the warps 421 of each one of the ladder tapes 42, whereby the slats 21 are turned to a nearly vertical position, and overlap each other. However, the slats 21 of the covering assembly 20 near the bottom rail 22 and the bottom rail 22 are restricted by the fixed length of the lift cord assembly 32' from turning to a corresponding angle. This is mainly because the rotation axis of the bottom rail 22 is not equally distanced to where the first and the second cords 321', 322' are connected to the bottom rail 22. When the bottom rail 22 is going to rotate around its rotation axis, the fixed lengths of the first and the second cords 321', 322' will limit the rotation of the section near the connecting points, so that the bottom rail 22 can only be moved and tilted to a position having a first angle θ1 relative to the initial position of the bottom rail 22 shown in FIG. 29. As a result, the warps 421 could not further approach each other, and therefore the slats 21 near the bottom rail 22 are restricted by the angle of the bottom rail 22 from turning like those slats 21 near the headrail 10, which are capable of correspondingly rotating along with the relative vertical movement and the approaching movement between the warps 421 of each one of the ladder tapes 42.

Figure 31:
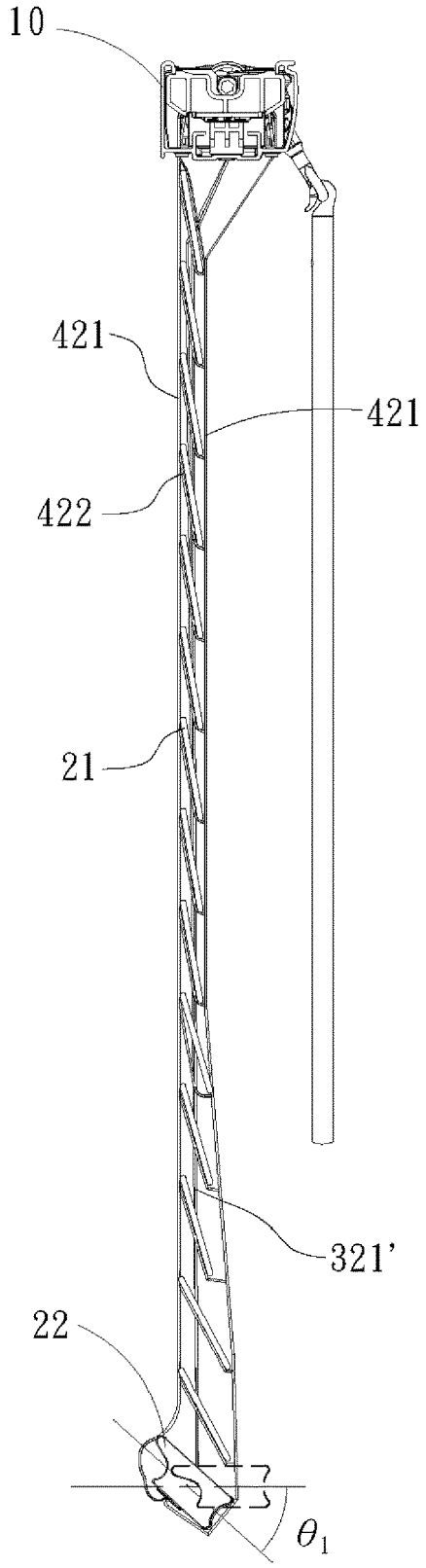
FIG. 31 is a side view of the window blind, showing that the covering assembly of the window blind is in the second state.
Figure 32A:
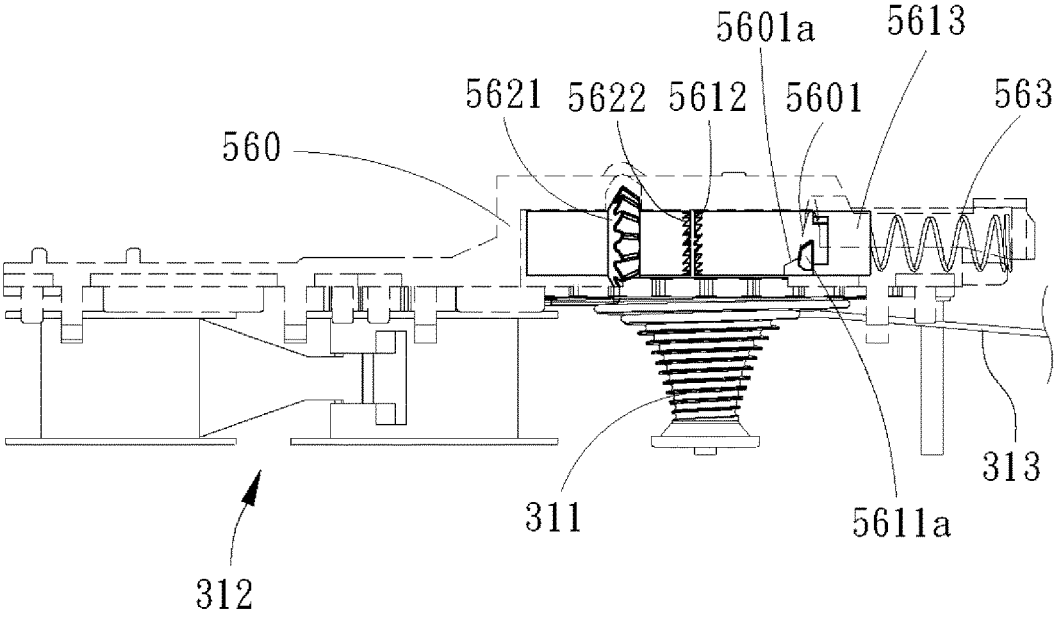
FIG. 32*a* is a side view showing the condition of the auxiliary unit and the driving module when the covering assembly of the window blind is in the second state shown in FIG. 31, with part of the casing omitted.
Figure 32B:
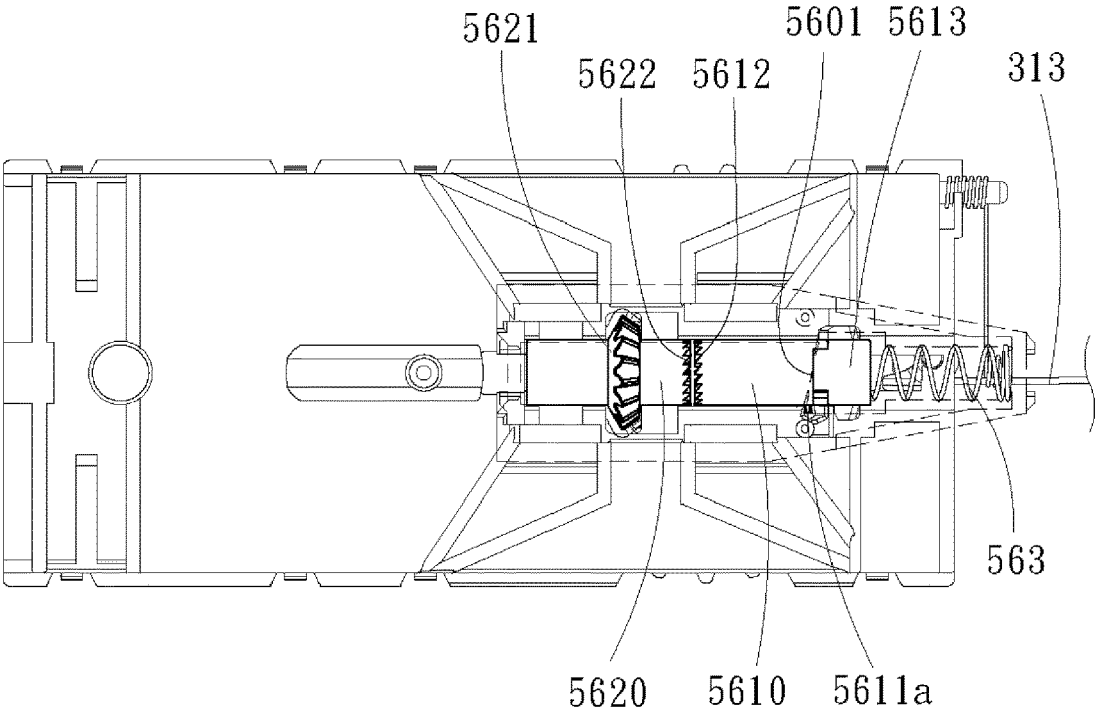
FIG. 32*b* is a top view of the auxiliary unit and the driving module in FIG. 32*a;*

At this time, not all of the slats 21 and the bottom rail 22 of the covering assembly 20 are arranged parallel to each other, as shown in FIG. 31. Herein we define that the covering assembly 20 is in the second state. The housing 560 in FIG. 32*a* and FIG. 32*b* is shown transparently, and the parts of the housing 560 which are required to be depicted are expressed in dotted lines, whereby the position change and the collaboration of the components in the housing 560 can be clearly illustrated. When in the second state, the modulation shaft 411 has been rotated, and therefore the delay member 5613 of the first sleeve 561 has been rotated synchronously as well. The protruding part 5613*a* of the delay member 5613 would move on the path 5610*a* of the first sleeve body 5610 to a certain position abutting against the end 5610*b* of the path 5610*a*. By further driving the modulation shaft 411 to rotate at this time, the first sleeve body 5610 would be synchronously rotated along with the delay member 5613, and the protrusion 5611*a* on the limiting portion 5611 of the first sleeve 561 would be also moved to gradually slide along the slope of the abutting portion 5601 to a position near the notch 5601*a*. Meanwhile, the first sleeve 561 and the second sleeve 562 are still disengaged from each other.

Figure 33:
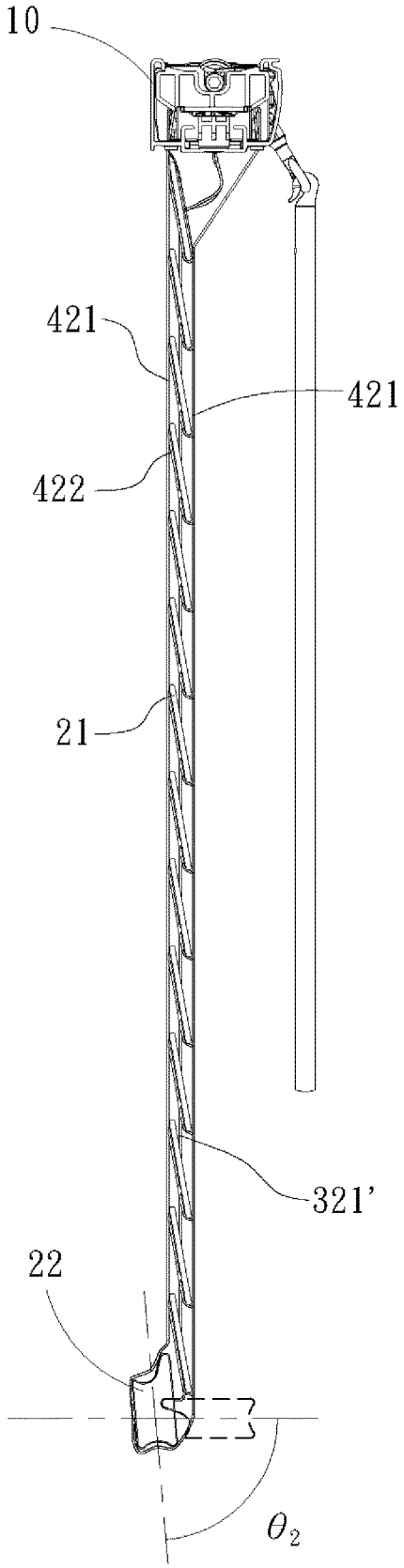
FIG. 33 is a side view of the window blind, showing that the covering assembly of the window blind switches from the second state shown in FIG. 31 into the first state again when maneuvered.
Figure 34A:
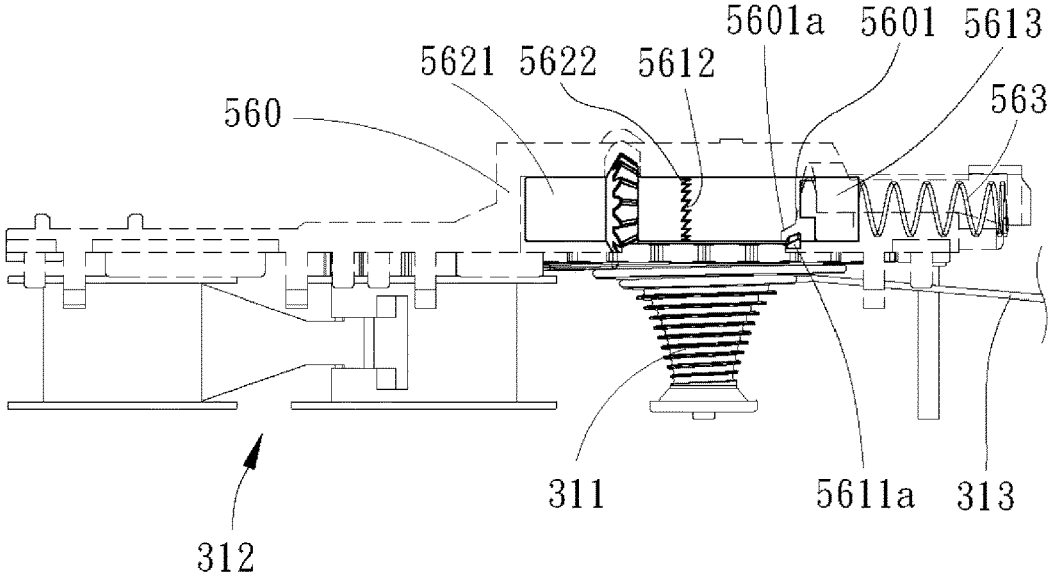
FIG. 34*a* is a side view showing the condition of the auxiliary unit and the driving module when the covering assembly gradually turns from the second state to the first state as shown in FIG. 33, wherein part of the casing is omitted.
Figure 34B:
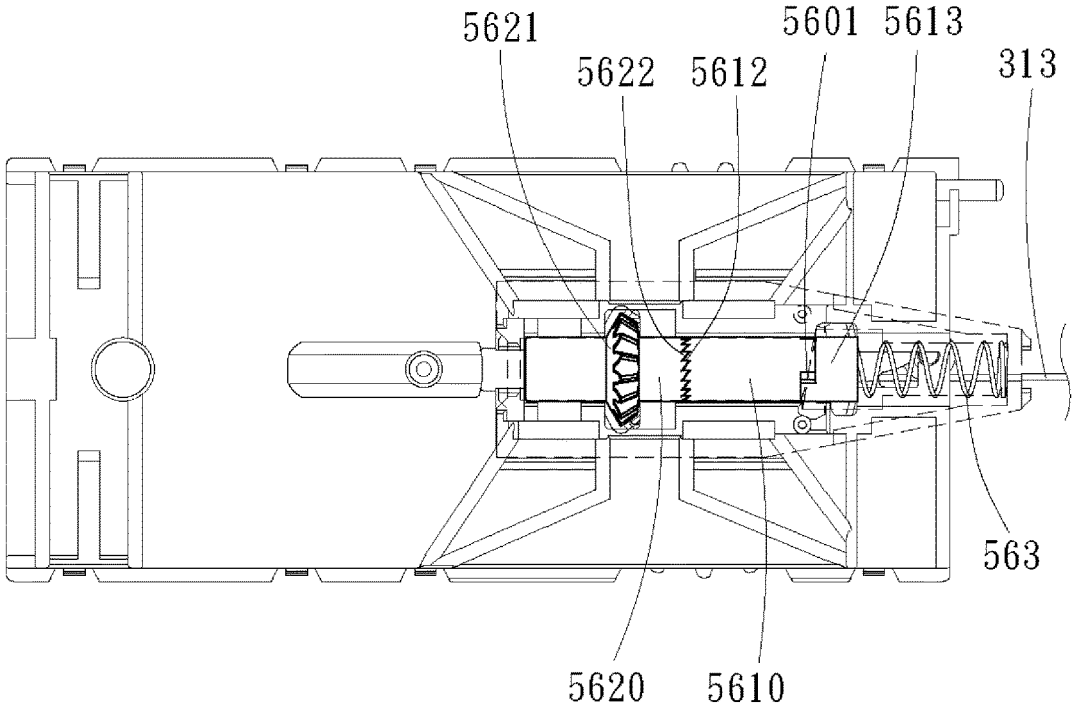
FIG. 34*b* is a top view of the auxiliary unit and the driving module shown in FIG. 34*a;*
Figure 35:
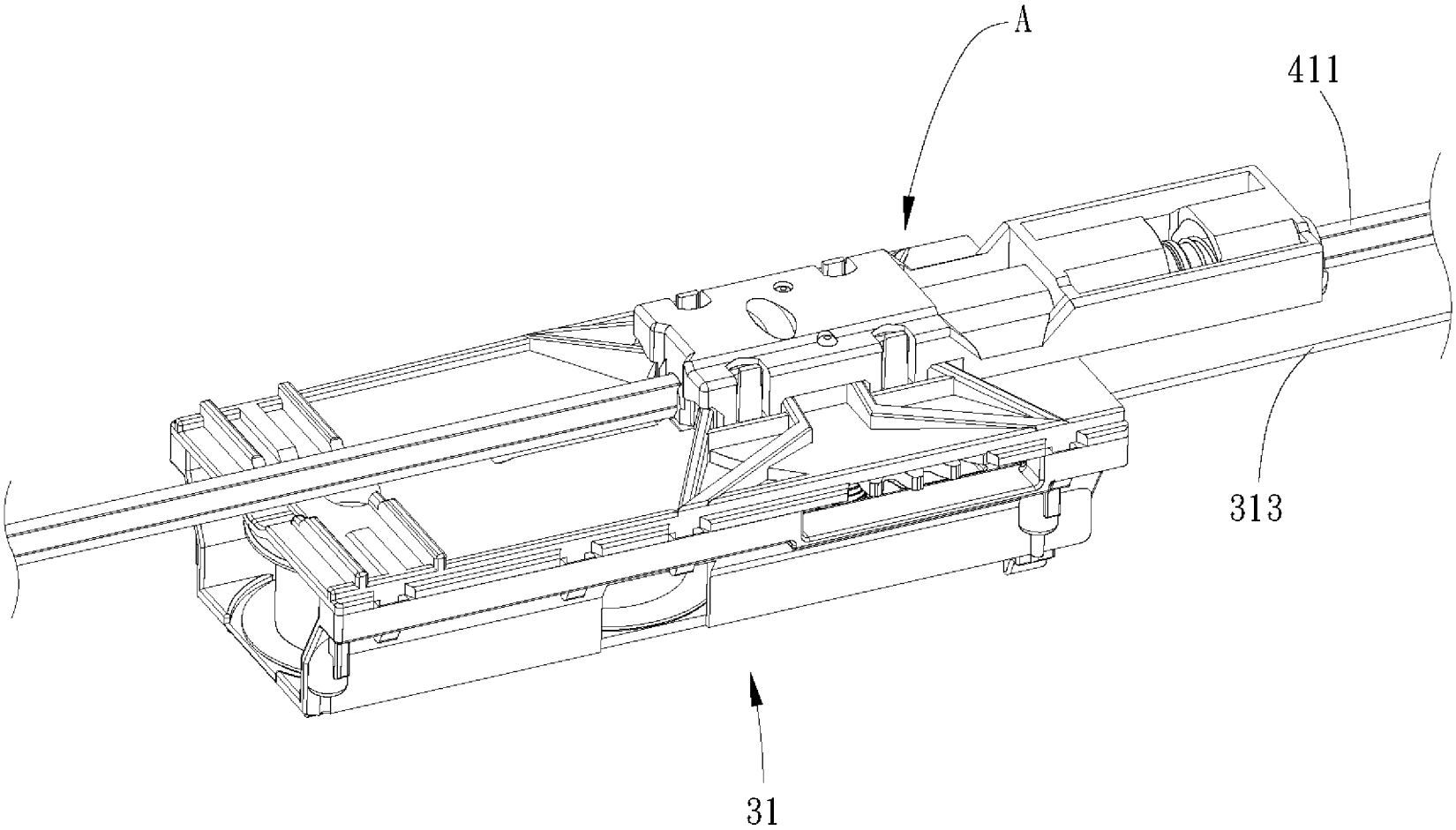
FIG. 35 is a perspective view of the auxiliary unit of a seventh embodiment provided in the alternative implementation of the window blind of the present invention; the driving module working with the auxiliary unit is also shown therein.
Figure 36:
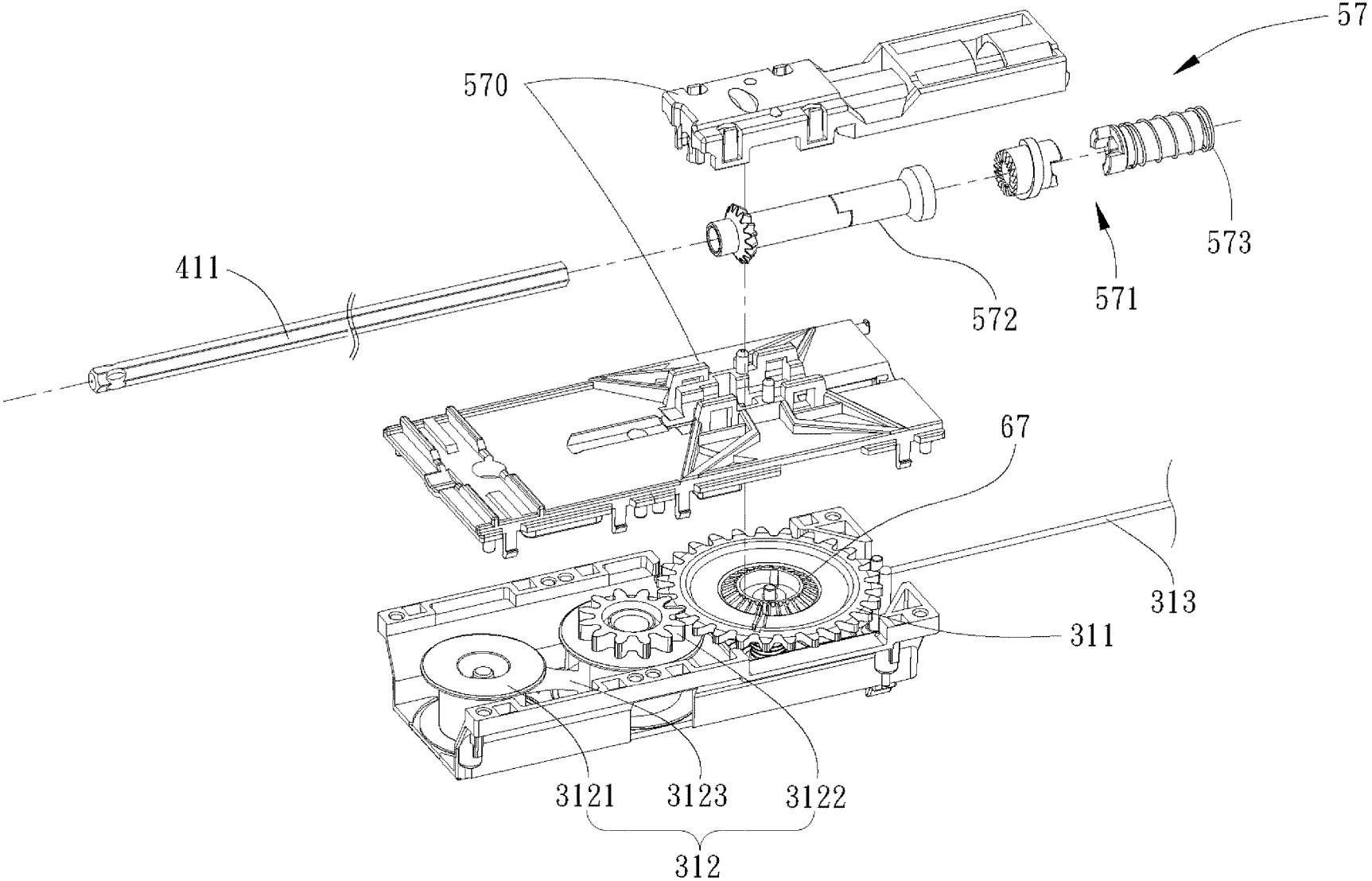
FIG. 36 is an exploded view of the auxiliary unit and the driving module shown in FIG. 35.

The housing 560 in FIG. 34*a* and FIG. 34*b* is shown transparently and is expressed by dotted lines, whereby the position change and the collaboration of the components in the housing 560 can be clearly illustrated. If the tilt mechanism 40 is further rotated in the same direction when the covering assembly 20 is in the aforementioned second state, the protrusion 5611*a* on the limiting portion 5611 would be moved to a position corresponding to the notch 5601*a* of the abutting portion 5601. At this time, the limiting portion 5611 would be urged to move toward the abutting portion 5601 by the pushing force which the elastic member 563 provides thereon. At the same time, the protrusion 5611*a* would, therefore, go into the notch 5601*a*. Furthermore, by further rotating the modulation shaft 411, the protrusion 5611*a* would leave the abutting portion 5601 at where the notch 5601*a* is. As a result, the first sleeve 561 would slide in a direction toward the second sleeve 562, so that the first engaging portion 5612 and the second engaging portion 5622 would be engaged with each other. At this time, the second sleeve 562 could be synchronously rotated with the modulation shaft 411 along with the first sleeve 561. Through the meshing between the toothed ring 5621 and the toothed structure 66, the rotation of the second sleeve 562 could drive the cord reel 311 to further rotate. At this time, to further release the transmission cord 313, the cord reel 311 has to overcome the motivating force provided by the torsion spring 3123 of the actuating device 312 while rotating, whereby the transmission cord 313 could further release the first cord 321' and the second cord 322' of the lift cord assembly 32' by a predetermined length through the movement of the movable seat assembly 33. The further released predetermined length of the lift cord assembly 32' would make the bottom rail 22 to no longer be affected by the length of the lift cord assembly 32', and therefore the bottom rail 22 could be further moved and tilted to the position having a second angle θ2 relative to the initial position of the bottom rail 22 shown in FIG. 29, wherein the second angle θ2 is greater than the first angle θ1 (as shown in FIG. 33). The slats 21 near the bottom rail 22 would not be restricted by the bottom rail 22 anymore, either. Thus, these slats 21 could be correspondingly turned again along with the relative vertical movement and the approaching movement between the warps 421 of each one of the ladder tapes 42. Furthermore, the slats 21 near the bottom rail 22 and the bottom rail 22 would also return to the state of being mutually parallel. The covering assembly 20 would be therefore changed from the aforementioned second state into the first state shown in FIG. 33, whereby the window blind 1' could provide an excellent light-blocking effect.

An auxiliary unit A of a seventh embodiment of the present invention is shown in FIG. 35 to FIG. 40*b*. In the current embodiment, the headrail 10, the covering assembly 20', the lifting mechanism 30', and the tilt mechanism 40 of the window blind 1' are all roughly the same with those disclosed in the previous embodiment, and therefore we are not going to describe their details herein. The current embodiment discloses another implementation of the first sleeve of the timing transmission mechanism in the auxiliary unit A, more particularly to different shapes of the protrusion of the limiting portion of the first sleeve. In the previous embodiment, the protrusion 5611*a* is wedge-shaped; in the current embodiment, the protrusion 5711*a* is helical. A length of the helix is determined by the rotation stroke of the tilt members 412, and therefore may vary in different embodiments. For example, in the current embodiment, it is about a full round. With different lengths, the timing for the timing transmission mechanism 57 to drive the driven member could be further modulated.

Figure 37A:
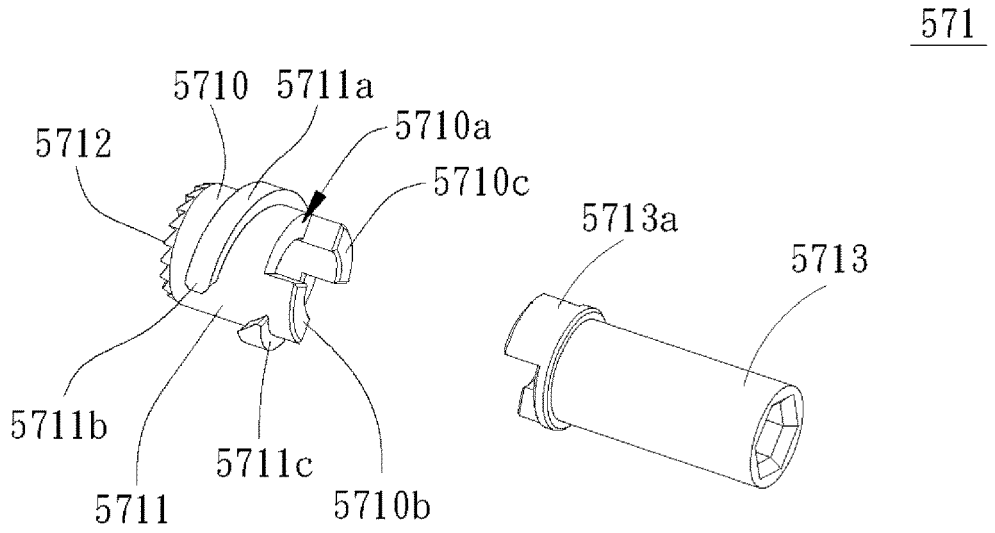
FIG. 37*a* is an enlarged view of the first sleeve of the auxiliary unit shown in FIG. 36.
Figure 37B:
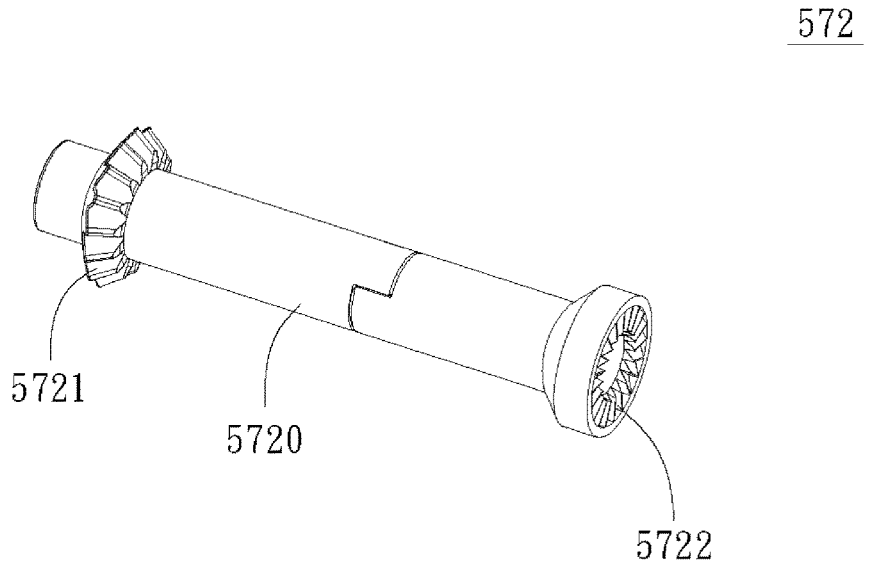
FIG. 37*b* is an enlarged view of the second sleeve of the auxiliary unit shown in FIG. 36.

Herein we are going to describe the details of the timing transmission mechanism 57 in the auxiliary unit A. In the current embodiment, the timing transmission mechanism 57 also includes a housing 570, a first sleeve 571, a second sleeve 572, and a restoring member. The second sleeve 572, the first sleeve 571, and the restoring member sequentially fit around the modulation shaft 411 at intervals, and are covered by the housing 570. As shown in FIG. 37*b*, the second sleeve 572 includes a hollow second sleeve body 5720, a toothed ring 5721, and a second engaging portion 5722, wherein the second sleeve body 5720 can be freely rotated relative to the modulation shaft 411. The toothed ring 5721 fits around an outer surface of the second sleeve body 5720. The second engaging portion 5722 is provided on an end portion of the second sleeve 572 facing the first sleeve 571. As shown in FIG. 37*a*, the first sleeve 571 includes a hollow first sleeve body 5710, a limiting portion 5711, a first engaging portion 5712, and a standalone delay member 5713. The first sleeve body 5710 can be freely rotated and shifted along the modulation shaft 411. The first engaging portion 5712 is provided on an end portion of the first sleeve body 5710 facing the second sleeve 572, and corresponds to the second engaging portion 5722. The limiting portion 5711 is located on a side of the first engaging portion 5712, and has a protrusion 5711*a* radially protruding thereon, wherein the protrusion 5711*a* is helical, and includes a starting point 5711*b* and an ending point 5711*c*. The starting point 5711*b* is near the first engaging portion 5712. The delay member 5713 is also a hollow ring fitting around the modulation shaft 411, wherein an inner surface thereof is a hexagon substantially similar to the outline of the modulation shaft 411. However, the delay member 5713 does not tightly fit around the modulation shaft 411, so that the delay member 5713 can be synchronously rotated along with the modulation shaft 411, and can be shifted in an axial direction of the modulation shaft 411. The delay member 5713 has at least a protruding part 5713*a* protruding from a surface thereof facing the first sleeve body 5710, and the first sleeve body 5710 is also correspondingly provided with a path 5710*a* on a surface thereof facing the delay member 5713. The protruding part 5713*a* protrudes into the space between the ends 5710*b*, 5710*c* of the path 5710*a*, and is able to reciprocate between the ends 5710*b*, 5710*c* of the path 5710*a* when the delay member 5713 is driven. The collaboration between the protruding part 5713*a* and the path 5710*a* and the effect they provide are the same as described in the previous embodiment, and therefore we are not going to explain in detail herein. The restoring member and the delay member 5713 are provided correspondingly. Said restoring member includes an elastic member 573 fitting around the modulation shaft 411, and is able to constantly provide the delay member 5713 a pushing force in a direction toward the first sleeve body 5710.

The driven member and the second sleeve 572 in the auxiliary unit A are provided correspondingly. Said driven member includes a toothed structure 67 provided on the cord reel 311 of the driving module 31. Said toothed structure 67 is provided corresponding to the toothed ring 5721 of the second sleeve 572, and always meshes with the toothed ring 5721.

Figure 38A:
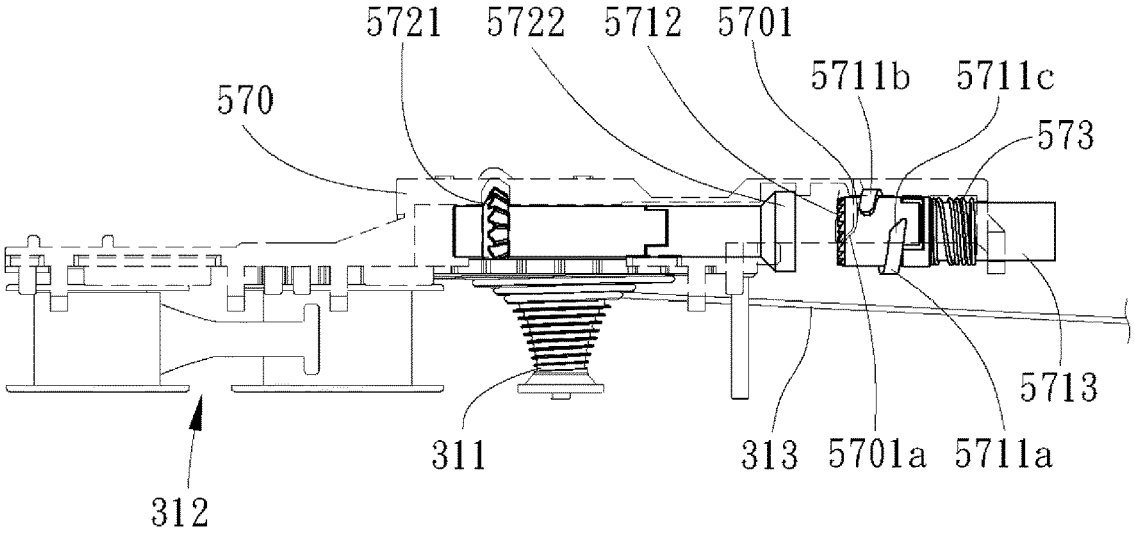
FIG. 38*a* is a side view showing the condition of the auxiliary unit and the driving module in the seventh embodiment when the covering assembly of the window blind is in the first state shown in FIG. 29, with part of the casing omitted.
Figure 38B:
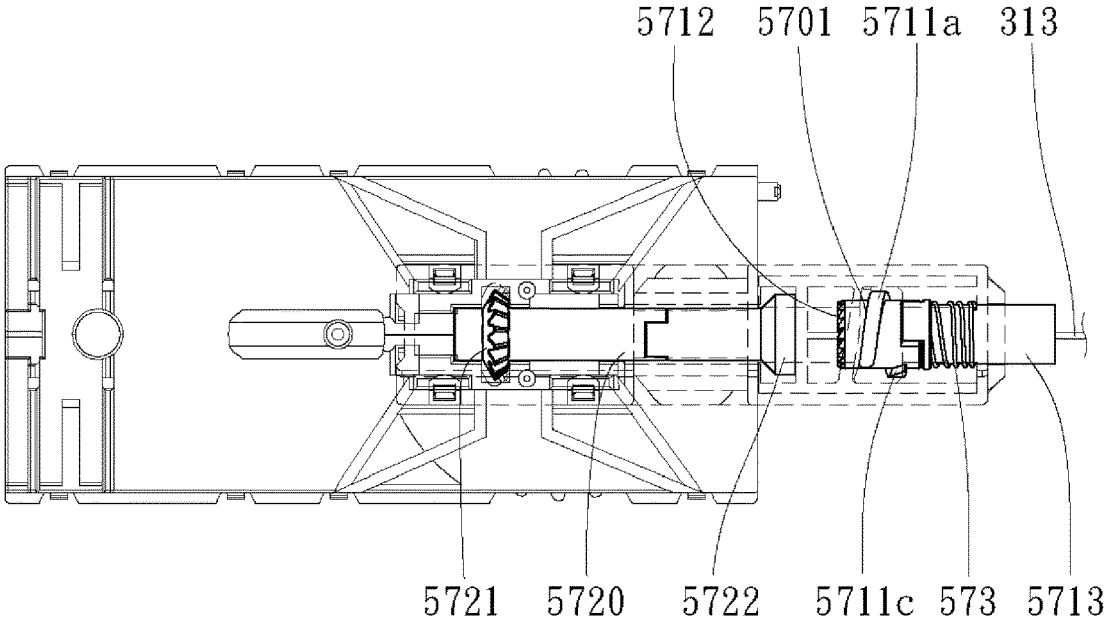
FIG. 38*b* is a top view of the auxiliary unit and the driving module of FIG. 38*a;*

The operation and effect of the auxiliary unit A of the seventh embodiment applied in another window blind 1' provided in the present invention are explained below. As shown in FIG. 29, when the window blind 1' is fully expanded, the covering assembly 20 is in the first state that the multiple slats 21 and the bottom rail 22 thereof are horizontally arranged and parallel to each other, the bottom rail 22 is located at an initial position, and the slats 21 are in the open state. The housing 570 in FIG. 38*a* and FIG. 38*b* is shown transparently, and the parts of the housing 570 which are required to be depicted are expressed in dotted lines, whereby the position change and the collaboration of the first sleeve 571 and the second sleeve 572 in the housing 570 can be clearly illustrated. Since starting point 5711*b* of the protrusion 5711*a* on the limiting portion 5711 of the first sleeve 571 abuts against the abutting portion 5701 of the housing 570, the first sleeve 571 and the second sleeve 572 are separated. At this time, the auxiliary unit A has not operated yet. When the tilt mechanism 40 is operated, the modulation shaft 411 is driven to rotate, and the tilt members 412 are rotated as well, whereby the slats 21 and the bottom rail 22 of the covering assembly 20 are correspondingly turned along with the relative vertical movement and the approaching between the warps 421 of each one of the ladder tapes 42. During said process, the slats 21 and the bottom rail 22 are still substantially parallel to each other, i.e., the covering assembly 20 is still in the first state.

Figure 39A:
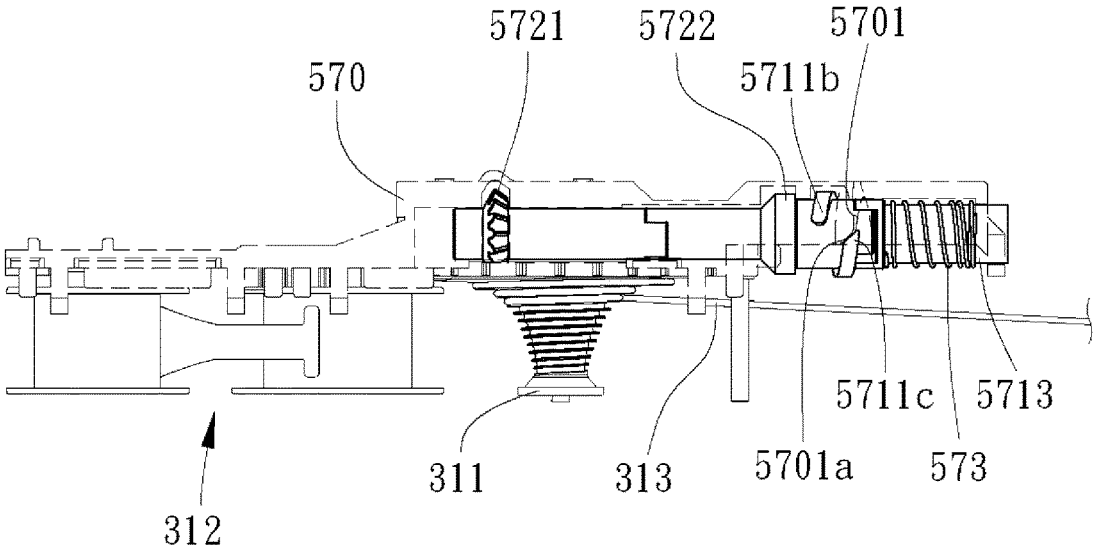
FIG. 39*a* is a side view showing the condition of the auxiliary unit and the driving module in the seventh embodiment when the covering assembly of the window blind is in the second state shown in FIG. 31, with part of the casing omitted.
Figure 39B:
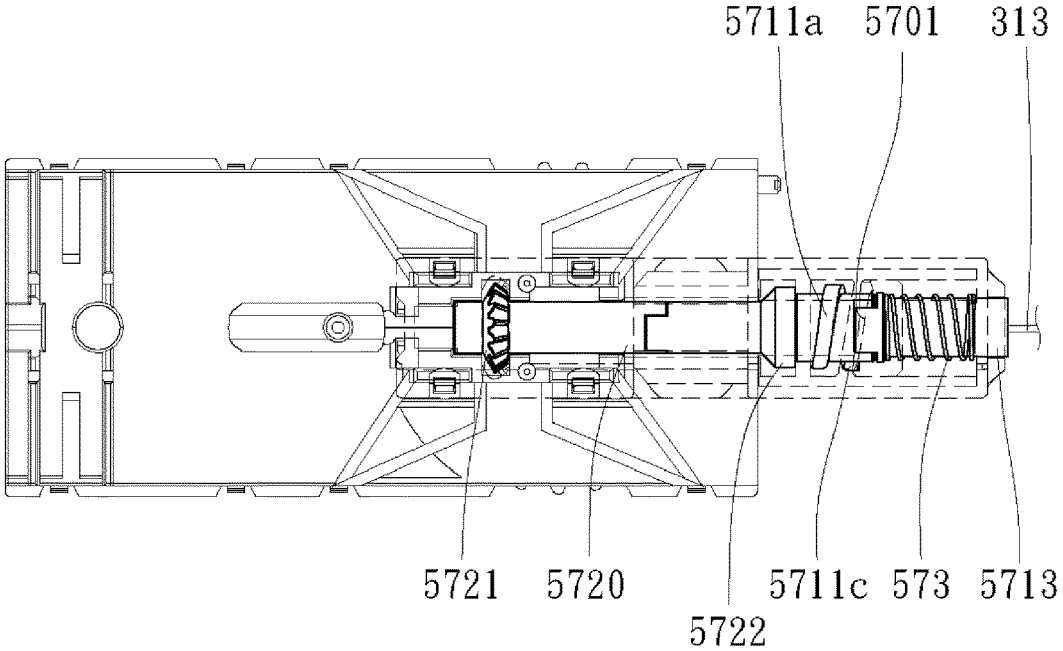
FIG. 39*b* is a top view of the auxiliary unit and the driving module of FIG. 39*a;*

After the angle modulation described above, if the tilt mechanism 40 is kept being maneuvered to make the slats 21 turn toward the closed state, the slats 21 of the covering assembly 20 near the headrail 10 will be correspondingly turned in response to the relative vertical movement and the approaching movement created between the warps 421 of each one of the ladder tapes 42. However the slats 21 of the covering assembly 20 near the bottom rail 22 are restricted by the fixed length of the lift cord assembly 32' from turning to a corresponding angle, so that the bottom rail 22 can only be moved and tilted to a position (as shown in FIG. 31) having a first angle θ1 relative to the initial position of the bottom rail 22 shown in FIG. 29. The covering assembly 20 at this time is in the second state that some of the slats 21 are not parallel to others. The housing 570 in FIG. 39*a* and FIG. 39*b* is shown transparently, and the parts of the housing 570 which are required to be depicted are expressed in dotted lines, whereby the position change and the collaboration of the components in the housing 570 can be clearly illustrated. Since the modulation shaft 411 has been rotated, the delay member 5713 of the first sleeve 571 has been rotated synchronously as well. The protruding part 5713*a* of the delay member 5713 would move on the path 5710*a* of the first sleeve body 5710 to a certain position abutting against the end 5710*b* of the path 5710*a*. By further driving the modulation shaft 411 to rotate in the same direction at this time, the first sleeve body 5710 would be synchronously rotated along with the delay member 5713, and the protrusion 5711*a* on the limiting portion 5711 of the first sleeve 571 would be also moved to gradually slide along the slope of the abutting portion 5701 as shown in the drawings. In such a situation, the starting point 5711*b* of the protrusion 5711*a* has passed by the abutting portion 5701 and moved across the notch 5701*a*. Through the pushing force of the elastic member 573, the starting point 5711*b* is further moved to a left side of the abutting portion 5701. However, since the ending point 5711*c* of the protrusion 5711*a* has not yet passed by the location of the notch 5701*a*, the protrusion 5711*a* is still restricted by the abutting portion 5701, so that the first sleeve 571 and the second sleeve 572 are still disengaged.

Figure 40A:
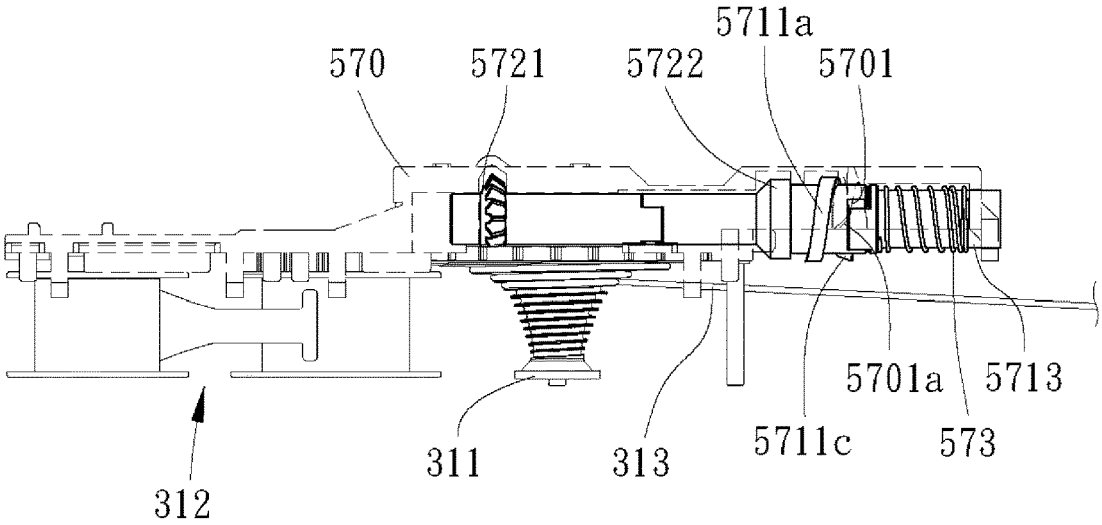
FIG. 40*a* is a side view showing the condition of the auxiliary unit and the driving module in the seventh embodiment when the covering assembly gradually turns from the second state to the first state as shown in FIG. 33, wherein part of the casing is omitted.
Figure 40B:
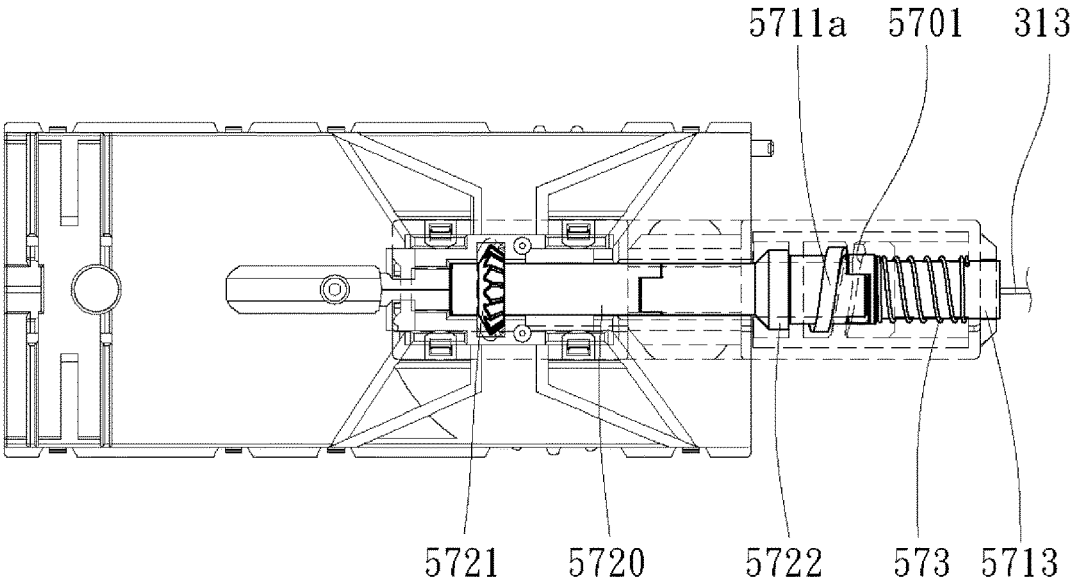
FIG. 40*b* is a top view of the auxiliary unit and the driving module of FIG. 40*a.*

The housing 570 in FIGS. 40*a* and 40*b* is also shown transparently and expressed in dotted lines, whereby the position change and the collaboration of the components in the housing 570 can be clearly illustrated. When the covering assembly 20 is in the aforementioned second state and the tilt mechanism 40 is further maneuvered in the same direction, the protrusion 5711*a* on the limiting portion 5711 would go on rotating along with the modulation shaft 411, so that the ending point 5711*c* of the protrusion 5711*a* would completely pass by the location of the notch 5701*a*. As a result, the protrusion 5711*a* would completely leave the surface of the abutting portion 5701. At this time, the limiting portion 5711 would be moved in a direction toward the second sleeve 572 by the pushing force which the elastic member 573 provides thereon, and the first sleeve 571 would, therefore, slide toward the second sleeve 572, so that the first engaging portion 5712 and the second engaging portion 5722 would be engaged with each other. After that, the second sleeve 572 could be synchronously rotated with the modulation shaft 411 along with the first sleeve 571. With the meshing between the toothed ring 5721 and the toothed structure 67, the rotation of the second sleeve 572 could drive the cord reel 311 to further rotate. At this time, the cord reel 311 would resist the motivating force provided by the torsion spring 3123 of the actuating device 312 to further release the transmission cord 313. Through the movement of the movable seat assembly 33, the transmission cord 313 could further synchronously release the first cord 321' and the second cord 322 of the lift cord assembly 32' by a predetermined length. The further released predetermined length of the lift cord assembly 32' would make the bottom rail 22 to no longer be hindered by the length of the lift cord assembly 32', and therefore the bottom rail 22 could be further moved and tilted to a position (as shown in FIG. 33) having a second angle θ2 relative to the initial position of the bottom rail 22 shown in FIG. 29, wherein the second angle θ2 is greater than the first angle θ1. The slats 21 near the bottom rail 22 would not be restricted by the bottom rail 22 anymore, either. Thus, these slats 21 could be correspondingly turned again along with the relative vertical movement and the approaching movement between the warps 421 of each one of the ladder tapes 42. Furthermore, the slats 21 near the bottom rail 22 and the bottom rail 22 would also return to the state of being mutually parallel. The covering assembly 20 would be therefore changed from the aforementioned second state into the first state shown in FIG. 33, whereby the window blind 1' could provide an excellent light-blocking effect.

It must be pointed out that the embodiments described above are only some preferred embodiments of the present invention. All equivalent structures which employ the concepts disclosed in this specification and the appended claims should fall within the scope of the present invention.

Those skilled in the art will readily observe that numerous modifications and alterations of the device and method may be made while retaining the teachings of the invention.

Accordingly, the above disclosure should be construed as limited only by the metes and bounds of the appended claims.

What is claimed is:

1. A window blind, comprising:

a headrail;

a covering assembly provided below the headrail, wherein the covering assembly sequentially comprises a plurality of slats and a bottom rail in a direction away from the headrail;

a lifting mechanism comprising a driving module and a lift cord assembly, wherein the driving module is provided in the headrail; the lift cord assembly comprises a first cord and a second cord; an end of the lift cord assembly is operably connected to the driving module, while another end thereof is connected to the bottom rail; the lift cord assembly is adapted to be driven by the driving module to be released or retracted, whereby to expand or fold the covering assembly;

a tilt mechanism comprising a modulation module and a ladder tape, wherein the modulation module is provided in the headrail; the ladder tape comprises two warps, and the slats are positioned between the warps; the modulation module is adapted to drive the warps of the ladder tape to create a relative vertical movement below the headrail, whereby to drive the slats of the covering assembly to rotate so as to block light or to allow light to pass therethrough; wherein the covering assembly is defined to be in a first state when the slats and the bottom rail are substantially parallel to each other, and are able to be correspondingly rotated along with the relative vertical movement of the warps; the covering assembly is defined to be in a second state when at least one of the slats or the bottom rail is not correspondingly rotatable along with the relative vertical movement of the warps; and an auxiliary unit provided between the lifting mechanism and the tilt mechanism, wherein, when the covering assembly is in the second state, the auxiliary unit is adapted to be driven by the tilt mechanism, and the lifting mechanism is concurrently motivated by the auxiliary unit which is being driven, whereby to further release the lift cord assembly and therefore to change the covering assembly into the first state that the slats and the bottom rail are substantially parallel to each other again.

2. The window blind of claim 1, wherein, when the lifting mechanism is concurrently motivated by the auxiliary unit to further release the lift cord assembly, the first cord and the second cord are synchronously released by a same length.

3. The window blind of claim 2, wherein the slats are positioned between the first cord and the second cord, and the first cord has a tension different from that of the second cord.

4. The window blind of claim 2, wherein the auxiliary unit comprises a timing transmission mechanism and a driven member; the timing transmission mechanism is connected to the modulation module to be driven by the modulation module; the driven member connects the driving module and the timing transmission mechanism, and the timing transmission mechanism operably drives the driven member.

5. The window blind of claim 4, wherein the modulation module comprises a modulation shaft, around which the timing transmission mechanism is provided, and the timing transmission mechanism is rotatable along with the modulation shaft; when the covering assembly is in the second state, the driven member is adapted to be driven by the timing transmission mechanism, and the driving module is concurrently motivated by the driven member which is being driven, whereby to release the lift cord assembly.

6. The window blind of claim 5, wherein the driving module comprises a cord reel and an actuating device which is concurrently motivated when the cord reel is driven; the lift cord assembly is adapted to be concurrently motivated by the cord reel; the actuating device is adapted to provide a motivating force to the lift cord assembly, wherein the motivating force is for retracting the lift cord assembly back into the headrail.

7. The window blind of claim 6, wherein the actuating device comprises a driving drum, a spring-receiving drum, and a torsion spring; the torsion spring connects the driving drum and the spring-receiving drum; the driving drum and the cord reel are connected in a manner that they are adapted to be concurrently motivated by each other, whereby to provide the motivating force to the cord reel.

8. The window blind of claim 6, wherein the driven member comprises a toothed structure provided on the driving module, and the toothed structure concurrently moves with the cord reel; while the toothed structure is being driven by the timing transmission mechanism to concurrently motivate the cord reel to release the lift cord assembly, the motivating force has to be overcome.

9. The window blind of claim 8, wherein the timing transmission mechanism comprises an incomplete gear, which is provided corresponding to the toothed structure; the incomplete gear concurrently rotates with the modulation shaft; when the covering assembly is in the first state, a toothed segment of the incomplete gear does not mesh with the toothed structure, so that the incomplete gear is adapted to independently rotate along with the modulation shaft relative to the toothed structure; when the covering assembly is in the second state, the toothed segment of the incomplete gear meshes with the toothed structure, so that the incomplete gear is adapted to be rotated along with a rotation of the modulation shaft, whereby to drive the toothed structure, which makes the cord reel rotate to further release the lift cord assembly.

10. The window blind of claim 9, wherein the timing transmission mechanism further comprises an auxiliary gear, which is freely rotatable relative to the modulation shaft, and always meshes with the toothed structure.

11. The window blind of claim 8, wherein the timing transmission mechanism comprises a first sleeve, a second sleeve, and a housing; the first sleeve and the second sleeve are provided on the modulation shaft and in the housing at intervals, wherein the first sleeve rotates synchronously with the modulation shaft, and is slidable relative to the modulation shaft; the second sleeve is freely rotatable relative to the modulation shaft, and always meshes with the toothed structure; when the covering assembly is in the first state, the first sleeve is driven by the modulation shaft to rotate, and is spaced out from the second sleeve; when the covering assembly is in the second state, the first sleeve is driven by the modulation shaft to rotate, and slides toward the second sleeve to become engaged with the second sleeve.

12. The window blind of claim 11, wherein the first sleeve has a first engaging portion, a first sleeve body, and a limiting portion; the first engaging portion is located at an end of the first sleeve body, and faces the second sleeve; the limiting portion is located at another end of the first sleeve body; the second sleeve has a second engaging portion, a second sleeve body, and a toothed ring; the second engaging portion is located at an end of the second sleeve body, and corresponds to the first engaging portion; the toothed ring fits around the second sleeve body and meshes with the toothed structure; when the covering assembly is in the second state, the first engaging portion engages with the second engaging portion, so that the second sleeve is adapted to rotate synchronously along with the first sleeve and the modulation shaft.

13. The window blind of claim 12, wherein the timing transmission mechanism further comprises a restoring member; the housing covers the first engaging portion of the first sleeve and the second engaging portion of the second sleeve, and also covers at least a part of the first sleeve body and at least a part of the second sleeve body; the restoring member is provided near a side of the housing that corresponds to the limiting portion; the limiting portion is located between an abutting portion of the housing and the restoring member, and the restoring member provides the first sleeve a pushing force toward the second sleeve.

14. The window blind of claim 13, wherein the limiting portion of the first sleeve has a protrusion protruding toward the abutting portion of the housing, and an outline of the abutting portion has a notch formed in an axial direction of the housing; when the covering assembly is in the first state, the first sleeve is adapted to rotate along with a rotation of the modulation shaft, and is, due to the pushing force, adapted to make the protrusion abut against the abutting portion and move along the outline of the abutting portion; when the covering assembly is in the second state, the protrusion completely passes by the abutting portion and no longer contacts the abutting portion as the protrusion reaches where the notch is, and the first sleeve is moved by the pushing force in an axial direction of the modulation shaft, whereby the first engaging portion engages with the second engaging portion.

15. The window blind of claim 14, wherein the restoring member comprises a blocker, which pushes against the limiting portion of the first sleeve to generate the pushing force; the limiting portion has another protrusion protruding in a direction opposite to the protrusion; when the covering assembly is in the second state, the first sleeve is adapted to rotate along with the rotation of the modulation shaft to make the another protrusion face the blocker, and the protrusion no longer contacts the abutting portion as the protrusion reaches where the notch is, whereby the first sleeve is moved toward the second sleeve by the pushing force.

16. The window blind of claim 14, wherein the restoring member comprises an elastic member, which pushes against the first sleeve to generate the pushing force; when the covering assembly is in the second state, the first sleeve is adapted to rotate along with the modulation shaft, so that the protrusion no longer contacts the abutting portion as the protrusion reaches where the notch is, whereby the first sleeve is moved toward the second sleeve by the pushing force.

17. The window blind of claim 14, wherein the protrusion is helical, and comprises a starting point and an ending point; when the covering assembly is in the second state, the ending point of the protrusion no longer contacts the abutting portion as the ending point reaches where the notch is, so that the first sleeve is moved toward the second sleeve by the pushing force, whereby the first engaging portion engages with the second engaging portion.

18. The window blind of claim 13, wherein the first sleeve further comprises a delay member, which fits around the modulation shaft, and respectively corresponds to the first sleeve body and the restoring member; the restoring member exerts the pushing force on the delay member, and the delay member has a protruding part on a side thereof facing the first sleeve body; the first sleeve body has a path on a side thereof facing the delay member, and the protruding part is adapted to be driven by the modulation shaft to reciprocate along the path; once the protruding part contacts an end of the path, the protruding part is able to drive the first sleeve body to rotate synchronously.

19. The window blind of claim 6, wherein the driving module further comprises a transmission cord, which connects the cord reel and the lift cord assembly; the cord reel is adapted to be concurrently motivated by the actuating device to wind up or release the transmission cord, whereby to retract or release the lift cord assembly.

20. The window blind of claim 19, wherein the lifting mechanism further comprises a movable seat assembly, which comprises a movable seat and a positioning pin; the movable seat is movable in a longitudinal direction of the headrail, and the positioning pin is fixedly provided in the headrail; a segment of the lift cord assembly located in the headrail is arranged in a manner that runs back and forth between the movable seat and the positioning pin; an end of the transmission cord is connected to the movable seat, and another end thereof is connected to the cord reel; the cord reel is adapted to be concurrently motivated by the actuating device to retract or release the transmission cord, so that the lift cord assembly is, through the movable seat, concurrently motivated when the transmission cord is driven; when the driven member is driven by the timing transmission mechanism to concurrently motivate the cord reel to release the lift cord assembly, the motivating force provided by the actuating device has to be overcome.

21. The window blind of claim 19, wherein the driven member comprises an interference device located between the cord reel and the lift cord assembly; the lifting mechanism further comprises a movable seat assembly, which comprises a movable seat and a positioning pin, wherein the movable seat is movable in a longitudinal direction of the headrail, and the positioning pin is fixedly provided in the headrail; a segment of the lift cord assembly located in the headrail is arranged in a manner that runs back and forth between the movable seat and the positioning pin; the transmission cord passes through the interference device, and has an end connected to the cord reel and another end connected to the movable seat; the cord reel is adapted to be concurrently motivated by the actuating device to retract or release the transmission cord, so that the lift cord assembly is, through the movable seat, concurrently motivated when the transmission cord is driven.

22. The window blind of claim 21, wherein the interference device comprises a base, an interference member, and an elastic member; the interference member is movable relative to the base; two end portions of the elastic member respectively abut against the interference member and the base; when the covering assembly is in the first state, the interference member twists the transmission cord, so that an actual cord length of the transmission cord from the cord reel to the movable seat is longer than a direct length from the cord reel to the movable seat; when the covering assembly is in the second state, the timing transmission mechanism is adapted to drive the interference member to move relative to the base, whereby to release the transmission cord twisted by the interference member, so that the movable seat is further moved in a direction away from the cord reel.

23. The window blind of claim 22, wherein the timing transmission mechanism comprises an incomplete gear, and the interference member has a toothed structure provided corresponding to the incomplete gear; the incomplete gear and the modulation shaft rotate synchronously; when a toothed segment of the incomplete gear meshes with the toothed structure of the interference member, the interference member is adapted to be driven by the incomplete gear to move relative to the base.

24. A window blind, comprising:

a headrail;

a covering assembly provided below the headrail, wherein the covering assembly sequentially comprises a plurality of slats and a bottom rail in a direction away from the headrail;

a lifting mechanism comprising a driving module and a lift cord assembly, wherein the driving module is provided in the headrail; the lift cord assembly comprises a first cord and a second cord, wherein an end of the lift cord assembly is operably connected to the driving module, while another end thereof is connected to the bottom rail; the lift cord assembly is adapted to be driven by the driving module to be released or retracted, whereby to expand or fold the covering assembly;

a tilt mechanism comprising a modulation module and a ladder tape, wherein the modulation module is provided in the headrail; the ladder tape comprises two warps; an end of each of the warps is operably connected to the modulation module, and another end thereof is connected to the bottom rail; the slats are positioned between the warps; the modulation module is adapted to drive the warps of the ladder tape to create a relative vertical movement below the headrail, whereby to drive the slats and the bottom rail to rotate, switching the slats between an open state, which allows light to pass therethrough, and a closed state, which blocks light; when the slats are in the open state, the slats and the bottom rail are parallel to each other, and the bottom rail in such state is defined to be at an initial position; when the slats are driven by the modulation module to be switched from the open state to the closed state, the bottom rail is tilted by a first angle relative to the initial position; and an auxiliary unit provided between the lifting mechanism and the tilt mechanism; wherein, when the bottom rail is tilted at the first angle, the auxiliary unit is adapted to be driven by the tilt mechanism, by which the lifting mechanism is concurrently motivated to further release the lift cord assembly, whereby the bottom rail is further tilted at a second angle relative to the initial position, wherein the second angle is greater than the first angle.

25. The window blind of claim 24, wherein, when the lifting mechanism is concurrently motivated by the auxiliary unit to further release the lift cord assembly, the first cord and the second cord are synchronously released by a same length.

26. The window blind of claim 25, wherein the slats are positioned between the first cord and the second cord, and the first cord has a tension different from that of the second cord.

27. The window blind of claim 24, wherein, when the bottom rail is tilted at the second angle, the bottom rail and the slats are parallel to each other.

28. The window blind of claim 25, wherein the auxiliary unit comprises a timing transmission mechanism and a driven member; the timing transmission mechanism is connected to the modulation module to be driven by the modulation module; the driven member connects the driving module and the timing transmission mechanism, and the timing transmission mechanism operably drives the driven member.

29. The window blind of claim 28, wherein the modulation module comprises a modulation shaft, around which the timing transmission mechanism is provided, and the timing transmission mechanism is rotatable along with the modulation shaft; when the bottom rail is tilted to the first angle, the driven member is adapted to be driven by the timing transmission mechanism, and the driving module is concurrently motivated by the driven member which is being driven, whereby to release the lift cord assembly.

30. The window blind of claim 29, wherein the driving module comprises a cord reel and an actuating device which is concurrently motivated when the cord reel is driven; the lift cord assembly is adapted to be concurrently motivated by the cord reel; the actuating device is adapted to provide a motivating force to the lift cord assembly, wherein the motivating force is for retracting the lift cord assembly back into the headrail.

31. The window blind of claim 30, wherein the actuating device comprises a driving drum, a spring-receiving drum, and a torsion spring; the torsion spring connects the driving drum and the spring-receiving drum; the driving drum and the cord reel are connected in a manner that they are adapted to be concurrently motivated by each other, whereby to provide the motivating force to the cord reel.

32. The window blind of claim 30, wherein the driven member comprises a toothed structure provided on the driving module, and the toothed structure concurrently moves with the cord reel; while the toothed structure is being driven by the timing transmission mechanism to concurrently motivate the cord reel to release the lift cord assembly, the motivating force has to be overcome.

33. The window blind of claim 32, wherein the timing transmission mechanism comprises an incomplete gear, which is provided corresponding to the toothed structure; the incomplete gear concurrently rotates with the modulation shaft; when the bottom rail is not tilted to the first angle yet, a toothed segment of the incomplete gear does not mesh with the toothed structure, so that the incomplete gear is adapted to independently rotate along with the modulation shaft relative to the toothed structure; when the bottom rail is tilted to the first angle, the toothed segment of the incomplete gear meshes with the toothed structure, so that the incomplete gear is adapted to be rotated along with a rotation of the modulation shaft, whereby to drive the toothed structure, which makes the cord reel rotate to further release the lift cord assembly, by which the bottom rail is further tilted to the second angle.

34. The window blind of claim 33, wherein the timing transmission mechanism further comprises an auxiliary gear, which is freely rotatable relative to the modulation shaft, and always meshes with the toothed structure.

35. The window blind of claim 30, wherein the driving module further comprises a transmission cord, which connects the cord reel and the lift cord assembly; the cord reel is adapted to be concurrently motivated by the actuating device to wind up or release the transmission cord, whereby to retract or release the lift cord assembly.

36. The window blind of claim 35, wherein the lifting mechanism further comprises a movable seat assembly, which comprises a movable seat and a positioning pin; the movable seat is movable in a longitudinal direction of the headrail, and the positioning pin is fixedly provided in the headrail; a segment of the lift cord assembly located in the headrail is arranged in a manner that runs back and forth between the movable seat and the positioning pin; an end of the transmission cord is connected to the movable seat, and another end thereof is connected to the cord reel; the cord reel is adapted to be concurrently motivated by the actuating device to retract or release the transmission cord, so that the lift cord assembly is, through the movable seat, concurrently motivated when the transmission cord is driven; when the driven member is driven by the timing transmission mechanism to concurrently motivate the cord reel to release the lift cord assembly, the motivating force provided by the actuating device has to be overcome.

37. The window blind of claim 35, wherein the driven member comprises an interference device located between the cord reel and the lift cord assembly; the lifting mechanism further comprises a movable seat assembly, which comprises a movable seat and a positioning pin, wherein the movable seat is movable in a longitudinal direction of the headrail, and the positioning pin is fixedly provided in the headrail; a segment of the lift cord assembly located in the headrail is arranged in a manner that runs back and forth between the movable seat and the positioning pin; the transmission cord passes through the interference device, and has an end connected to the cord reel and another end connected to the movable seat; the cord reel is adapted to be concurrently motivated by the actuating device to retract or release the transmission cord, so that the lift cord assembly is, through the movable seat, concurrently motivated when the transmission cord is driven.

* * * * *